US010585366B2

(12) United States Patent
Kami et al.

(10) Patent No.: US 10,585,366 B2
(45) Date of Patent: Mar. 10, 2020

(54) IMAGE FORMING APPARATUS

(71) Applicants: Hidetoshi Kami, Shizuoka (JP); Hiroki Orii, Yamanashi (JP); Ryohta Takahashi, Shizuoka (JP)

(72) Inventors: Hidetoshi Kami, Shizuoka (JP); Hiroki Orii, Yamanashi (JP); Ryohta Takahashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/290,995

(22) Filed: Mar. 4, 2019

(65) Prior Publication Data

US 2019/0285997 A1 Sep. 19, 2019

(30) Foreign Application Priority Data

Mar. 19, 2018 (JP) ..... 2018-051137

(51) Int. Cl.
*G03G 21/00* (2006.01)
*G03G 5/147* (2006.01)

(52) U.S. Cl.
CPC ..... *G03G 5/14721* (2013.01); *G03G 5/14734* (2013.01); *G03G 21/0011* (2013.01); *G03G 21/0017* (2013.01); *G03G 21/0094* (2013.01)

(58) Field of Classification Search
CPC ..... G03G 5/14721; G03G 5/14734; G03G 21/0011; G03G 21/0017; G03G 21/0094
See application file for complete search history.

(56) References Cited

U.S. PATENT DOCUMENTS

| | | | | |
|---|---|---|---|---|
| 5,721,085 | A | 2/1998 | Oshiba et al. | |
| 8,043,777 | B2 | 10/2011 | Kami et al. | |
| 8,119,317 | B2 | 2/2012 | Kami et al. | |
| 8,148,038 | B2 | 4/2012 | Fujiwara et al. | |
| 8,247,143 | B2 | 8/2012 | Egawa et al. | |
| 8,293,439 | B2 | 10/2012 | Fujiwara et al. | |
| 8,420,284 | B2 | 4/2013 | Ohshima et al. | |
| 8,512,924 | B2 | 8/2013 | Kami et al. | |
| 8,597,863 | B2 | 12/2013 | Kami et al. | |
| 8,795,935 | B2 | 8/2014 | Kami et al. | |
| 2004/0197122 | A1 * | 10/2004 | Nakano | G03G 21/0005 399/350 |

(Continued)

FOREIGN PATENT DOCUMENTS

| | | |
|---|---|---|
| JP | H09-090843 | 4/1997 |
| JP | 3467665 | 9/2003 |

(Continued)

*Primary Examiner* — David M. Gray
*Assistant Examiner* — Michael A Harrison
(74) *Attorney, Agent, or Firm* — Oblon, McClelland, Maier & Neustadt, L.L.P.

(57) ABSTRACT

Provided is an image forming apparatus including an image bearer capable of bearing a toner image, where a latent image is formed on the image bearer, a developing unit configured to develop the latent image formed on the image bearer with a toner, and a cleaning unit including a blade-shaped elastic body, where the elastic body is brought into contact with a surface of the image bearer, wherein a friction coefficient Ft/Fn between the image bearer and the elastic body is 0.85 or greater but 1.1 or less, and self-excited vibration WRFt(LMH) of shear force of the elastic body in a LMH band is 1.5 gf or greater but 3.5 gf or less.

6 Claims, 14 Drawing Sheets

(56) References Cited

U.S. PATENT DOCUMENTS

| | | | | |
|---|---|---|---|---|
| 2009/0208246 | A1 | 8/2009 | Kami | |
| 2010/0124712 | A1 | 5/2010 | Egawa et al. | |
| 2011/0033203 | A1 | 2/2011 | Watanabe et al. | |
| 2011/0076057 | A1 | 3/2011 | Kami et al. | |
| 2012/0237228 | A1* | 9/2012 | Kami | G03G 21/0094 399/31 |
| 2014/0193185 | A1 | 7/2014 | Kami et al. | |
| 2014/0234763 | A1 | 8/2014 | Sugino et al. | |
| 2015/0227063 | A1 | 8/2015 | Kami et al. | |
| 2015/0346613 | A1* | 12/2015 | Kami | G03G 5/043 430/56 |
| 2016/0187792 | A1 | 6/2016 | Toriu et al. | |

FOREIGN PATENT DOCUMENTS

| | | |
|---|---|---|
| JP | 2004-053892 | 2/2004 |
| JP | 2005-189509 | 7/2005 |
| JP | 3885751 | 12/2006 |
| JP | 2009-288729 | 12/2009 |
| JP | 4427867 | 12/2009 |
| JP | 4521199 | 5/2010 |
| JP | 2010-266811 | 11/2010 |
| JP | 2014-134605 | 7/2014 |

* cited by examiner

IMAGE FORMING APPARATUS

CROSS-REFERENCE TO RELATED APPLICATIONS

The present application claims priority under 35 U.S.C. § 119 to Japanese Patent Application No. 2018-051137 filed Mar. 19, 2018. The contents of which are incorporated herein by reference in their entirety.

BACKGROUND OF THE INVENTION

Field of the Invention

The present disclosure relates to an image forming apparatus.

Description of the Related Art

To date, most of documents have been printed by electrophotography that is utilized in photocopiers and electrophotography has been utilized in various scenes. In recent years, however, frequency of taking copies in offices is getting more and more reduced due to the trends for going paperless or reducing the cost.

While the existing roll of electrophotography is getting reduced, expansion of use of electrophotography for commercial printing from printing for office use has been searched. The electrophotography has an advantage that electrophotography realizes on-demand printing that can print various documents in a large quantity with the minimum lot, as the electrophotography does not require a plate-making process unlike offset printing. However, the current situation is that quality and uniformity of prints of electrophotography are significantly inferior to those of offset printing.

In commercial printing, prints having uneven image quality cannot be provided as commercial products. In order to use electrophotography in commercial printing, therefore uniformity of image quality is particularly important. Moreover, productivity and profitability are particularly important in commercial printing compared with printing for office use and therefore it is important to reduce the frequency for replacing a photoconductor. Currently, life of a photoconductor used till replacement in most of electrophotographic devices of high end class is set to around 1,000,000 sheets of printing.

For example, proposed for reducing image deterioration due to abrasion and damage of a photoconductor is an image forming method where static friction coefficient of the photoconductor to a cleaning blade, a supply amount of a lubricant, and surface roughness of image bearer are specified to certain numerical values (see, for example, Japanese Unexamined Patent Application Publication Nos. 09-90843, 2014-134605, 2010-266811, and 2005-189509).

According to these proposals, however, durability of a photoconductor is not sufficient for commercial printing. Copiers have not yet replaced offset printers, which tells that performance of electrophotography is still insufficient for use as commercial printing.

SUMMARY OF THE INVENTION

According to one aspect of the present disclosure, an image forming apparatus includes an image bearer capable of bearing a toner image, where a latent image is formed on the image bearer, a developing unit configured to develop the latent image formed on the image bearer with a toner, and a cleaning unit including a blade-shaped elastic body, where the elastic body is brought into contact with a surface of the image bearer. A friction coefficient Ft/Fn between the image bearer and the elastic body is 0.85 or greater but 1.1 or less. A size WRFt(LMH) of self-excited vibration of shear force of the elastic body in a LMH band as determined by a method described in (i) to (v) below is 1.5 gf or greater but 3.5 gf or less:

(i) generating waveform data WFt of a time change of shear force generated in the elastic body due to frictions with the image bearer; (ii) performing a multiresolution analysis to transform the waveform data WFt through wavelet transformation to separate the waveform data WFt into 6 frequency components (HHH, HHL, HMH, HML, HLH, and HLL) of the waveform data of shear force ranging from a high frequency component to a low frequency component;

(iii) generating waveform data of shear force through decimation performed on the lowest frequency component of the waveform data WFt(HLL) of shear force among the obtained 6 frequency components in a manner that a sampling number is reduced to 1/40;

(iv) further performing a multiresolution analysis to transform the generated waveform data through wavelet transformation to separate the waveform data into additional 6 frequency components (LHH, LHL, LMH, LML, LLH, and LLL) of the waveform data of shear force ranging from a high frequency component to a low frequency component; and (v) determining self-excited vibration WRFt(LMH) of shear force of the elastic body in the LMH band from the waveform data WFt(LMH) of shear force in the LMH band obtained in (iv) according to Formula (1), $$WRFt(LMH) = \frac{1}{L}\int_0^L |WFt[LHM](x)|dx \qquad \text{Formula (1)}$$

(L: a duration of the entire measurement, x: time, WFt [LMH](x): waveform data of a time change of shear force in the LMH band) where each frequency band satisfies a relationship below:

TABLE 1

| Abbreviations of frequency bands | Duration of 1 cycle [msec] | Frequency band [Hz] | Median of duration of 1 cycle [msec] | Median of frequency band [Hz] |
|---|---|---|---|---|
| HHH | 0.0 to 3.8 | 260.4 to ∞ | 1.9 | 520.8 |
| HHL | 1.3 to 7.7 | 130.2 to 781.3 | 4.5 | 223.2 |
| HMH | 2.6 to 16.6 | 60.1 to 390.6 | 9.6 | 104.2 |
| HML | 5.1 to 32 | 31.3 to 195.3 | 18.6 | 53.9 |
| HLH | 12.8 to 64 | 15.6 to 78.1 | 38.4 | 26 |
| HLL | 30.7 to 126.7 | 7.9 to 32.6 | 78.7 | 12.7 |
| LHH | 33.3 to 135.7 | 7.4 to 30 | 84.5 | 11.8 |
| LHL | 67.8 to 234.2 | 4.3 to 14.7 | 151 | 6.6 |
| LMH | 135.7 to 407 | 2.5 to 7.4 | 271.4 | 3.7 |
| LML | 273.9 to 705.3 | 1.4 to 3.7 | 489.6 | 2 |
| LLH | 551.7 to 1221.1 | 0.8 to 1.8 | 886.4 | 1.1 |
| LLL | 1109.8 to 2117.1 | 0.5 to 0.9 | 1613.4 | 0.6 |

Figure 1:
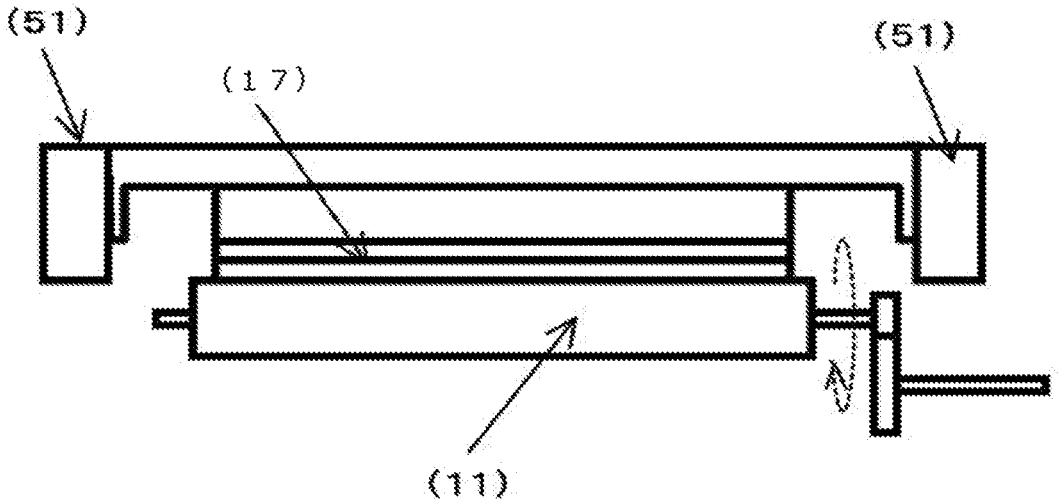
FIG. 1 is a structural view illustrating one example of a testing device for measuring acting force of an elastic body.

DESCRIPTION OF THE EMBODIMENTS (Image Forming Apparatus)

An image forming apparatus of the present disclosure includes an image bearer capable of bearing a toner image, where a latent image is formed on the image bearer, a developing unit configured to develop the latent image formed on the image bearer with a toner, and a cleaning unit including a blade-shaped elastic body, where the elastic body is brought into contact with a surface of the image bearer. A friction coefficient Ft/Fn between the image bearer and the elastic body is 0.85 or greater but 1.1 or less, and a size WRFt(LMH) of self-excited vibration of shear force of the elastic body in a LMH band as determined by a method described in (i) to (v) below is 1.5 gf or greater but 3.5 gf or less.

(i) generating waveform data WFt of a time change of shear force generated in the elastic body due to frictions with the image bearer;

(ii) performing a multiresolution analysis to transform the waveform data WFt through wavelet transformation to separate the waveform data WFt into 6 frequency components (HHH, HHL, HMH, HML, HLH, and HLL) of the waveform data of shear force ranging from a high frequency component to a low frequency component;

(iii) generating waveform data of shear force through decimation performed on the lowest frequency component of the waveform data WFt(HLL) of shear force among the obtained 6 frequency components in a manner that a sampling number is reduced to 1/40;

(iv) further performing a multiresolution analysis to transform the generated waveform data through wavelet transformation to separate the waveform data into additional 6 frequency components (LHH, LHL, LMH, LML, LLH, and LLL) of the waveform data of shear force ranging from a high frequency component to a low frequency component; and (v) determining self-excited vibration WRFt(LMH) of shear force of the elastic body in the LMH band from the waveform data WFt(LMH) of shear force in the LMH band obtained in (iv) according to Formula (1).

$$WRFt(LMH) = \frac{1}{L}\int_0^L |WFt[LHM](x)|dx \qquad \text{Formula (1)}$$

(L: a duration of the entire measurement, x: time, WFt [LMH](x): waveform data of a time change of shear force in the LMH band)

Note that, each frequency band satisfies a relationship below.

TABLE 2

| Abbreviations of frequency bands | Duration of 1 cycle [msec] | Frequency band [Hz] | Median of duration of 1 cycle [msec] | Median of frequency band [Hz] |
|---|---|---|---|---|
| HHH | 0.0 to 3.8 | 260.4 to ∞ | 1.9 | 520.8 |
| HHL | 1.3 to 7.7 | 130.2 to 781.3 | 4.5 | 223.2 |
| HMH | 2.6 to 16.6 | 60.1 to 390.6 | 9.6 | 104.2 |
| HML | 5.1 to 32 | 31.3 to 195.3 | 18.6 | 53.9 |
| HLH | 12.8 to 64 | 15.6 to 78.1 | 38.4 | 26 |
| HLL | 30.7 to 126.7 | 7.9 to 32.6 | 78.7 | 12.7 |
| LHH | 33.3 to 135.7 | 7.4 to 30 | 84.5 | 11.8 |
| LHL | 67.8 to 234.2 | 4.3 to 14.7 | 151 | 6.6 |
| LMH | 135.7 to 407 | 2.5 to 7.4 | 271.4 | 3.7 |
| LML | 273.9 to 705.3 | 1.4 to 3.7 | 489.6 | 2 |
| LLH | 551.7 to 1221.1 | 0.8 to 1.8 | 886.4 | 1.1 |
| LLL | 1109.8 to 2117.1 | 0.5 to 0.9 | 1613.4 | 0.6 |

The present disclosure has an object to provide an image forming apparatus which solves problem of trade-off between abrasion resistance of an image bearer and image blur, and is capable of printing high uniformity of image quality even when a large quantity of printing is performed by an electrophotographic process.

The present disclosure can provide an image forming apparatus which solves problem of trade-off between abrasion resistance of an image bearer and image blur, and is capable of printing high uniformity of image quality even when a large quantity of printing is performed by an electrophotographic process.

The following problems existing in the art have been found, and it has been found that the image forming apparatus of the present disclosure can solve the problems. As a result, the image forming apparatus of the present disclosure has been accomplished.

A service life of a photoconductor is determined by a trade-off relationship between abrasion resistance and prevention of blurred images. When the photoconductor is regarded as one type of condensers, it can be understood that an electrostatic capacity increases as abrasion of the photoconductor increases and thus charging performance is deteriorated. As a result, fogging of a print image tends to be caused. Since an electric field the photoconductive layer increases, moreover, charge blocking properties decrease and therefore background deposition tends to cause as well. In order to delay a deterioration process of the above-mentioned charging properties, it is important to improve abrasion resistance of a photoconductor. As the abrasion resistance increases, however, abrasion of the surface of the photoconductor is slow down. Therefore, the surface of the photoconductor is not refreshed, and dirt tend to be accumulated on the surface of the photoconductor. The dirty surface of the photoconductor tends to have low surface resistance. Therefore, an electrostatic latent image drifts and the image may be blurred. A service life of a photoconductor has reached the limit thereof due to the above-described trade-off relationship. Therefore, expansion of use of electrophotography has also been limited.

After developing photoconductors over nearly half a century, each manufacturer has currently achieved the ultimate high durability of photoconductors. However, it is a current situation that there are needs for image quality and durability, which are not asked in the past, when photoconductors are used for commercial printing, and the manufacturers are working to meet the needs. In order to replace offset printing with electrophotography, realization of high reliability of photoconductors are necessary.

The image forming apparatus of the present disclosure includes at least the image bearer, the developing unit, and a cleaning unit. The image forming apparatus preferably further includes a coating unit, a charging unit, an exposing unit, a transferring unit, and a fixing unit. The image forming apparatus may further include appropriately selected other units according to the necessity. Note that, the charging unit and the exposing unit may be collectively referred to as an electrostatic latent image forming unit.

The image forming method for use in the present disclosure includes at least a developing step and a cleaning unit. The image forming method preferably further includes a coating step, a charging step, an exposing step, a transferring step, and a fixing step. The image forming method may further include appropriately selected other steps according to the necessity. Note that, the charging step and the exposing step may be collectively referred to as an electrostatic latent image forming step.

The image forming method for use in the present disclosure is preferably performed by the image forming apparatus of the present disclosure. The charging step is performed by the charging unit. The exposing step is performed by the exposing unit. The developing step is performed by the developing unit. The transferring step is performed by the transferring unit. The fixing step is performed by the fixing unit. The cleaning step is performed by the cleaning unit. The above-mentioned other steps are performed by the above-mentioned other units.

Next, the detail of the image forming apparatus according to the present disclosure will be described.

Note that, the embodiments described below are preferably embodiments of the present disclosure and therefore includes various technically preferable limitations. However, the scope of the present disclosure is not limited to the embodiments below unless there is a description stating to limit the present disclosure.

<Cleaning Step and Cleaning Unit>

The cleaning step is a step including removing a material remained on a surface of the image bearer using a cleaning unit including an elastic body that is in a shape of blade and is in contact with a surface of the image bearer. The cleaning step is performed by the cleaning unit.

The elastic body (may be referred to as a "cleaning blade" hereinafter) is in contact with a surface of the image bearer and has a blade shape.

The cleaning unit is not particularly limited and may be appropriately selected depending on the intended purpose, as long as the cleaning unit includes the elastic body.

In electrophotography, a surface of an image bearer (may be referred to as a "photoconductor" or an "electrophotographic photoconductor" hereinafter) is regarded as a place where a material is input and output. Examples of the material to be input and output includes a toner, a developer, wax, a discharge generated product, and paper. An ideal state is that the input and output of the material is reset per cycle of the photoconductor. However, part of the material is accumulated on the surface of the photoconductor without being discharged from the surface thereof. The above-described reset of the surface of the photoconductor is typically performed by function of shear force generated by bringing the blade-shaped elastic body into contact with the surface of the photoconductor.

When the elastic body is brought into contact with a surface of the photoconductor, shear force, compressive stress, and self-excited vibration are generated depending on the state of the contact between the elastic body and the surface of the photoconductor. Moreover, the photoconductor and the elastic body themselves cause abrasion or modification depending on the state of the contact between the surface of the photoconductor and the elastic body. In order to prolong a service life of the photoconductor, therefore, it is important to improve the contact state between the elastic body and the surface of the photoconductor.

However, analysis of the above-mentioned contact state is currently still unclear. Therefore, it is not clear that designing of devices is logical.

Therefore, the present inventors has created an analysis method of shear force as a first step for achieving the object. First, an analysis device will be described.

FIG. 1 is a structural view illustrating one example of a testing device for measuring acting force of an elastic body when a photoconductor and an elastic body in the shape of a blade serving as a contact member are used.

A plate to which the elastic body (17) illustrated in FIG. 1 is fixed is hanged from a couple of three-component strain gauges (dynamic strain measuring instrument) (51), and is brought into contact with a photoconductor (11). At the time of the contact, a contact angle or a penetration amount of the elastic body against the photoconductor is appropriately changed. The photoconductor is connected to a power source (not illustrated) such as a motor, which is rotationally driven at appropriate speed. A torque gauge may be disposed to the power source to measure turning force.

A measured value of load obtained by the three-component strain gauge is collected by the data logger, and a sum of loads obtained from the left and right sides of the three-component strain gauges are calculated as acting force.

[Friction Coefficient Ft/Fn Between Image Bearer and Elastic Body]

Figure 2:
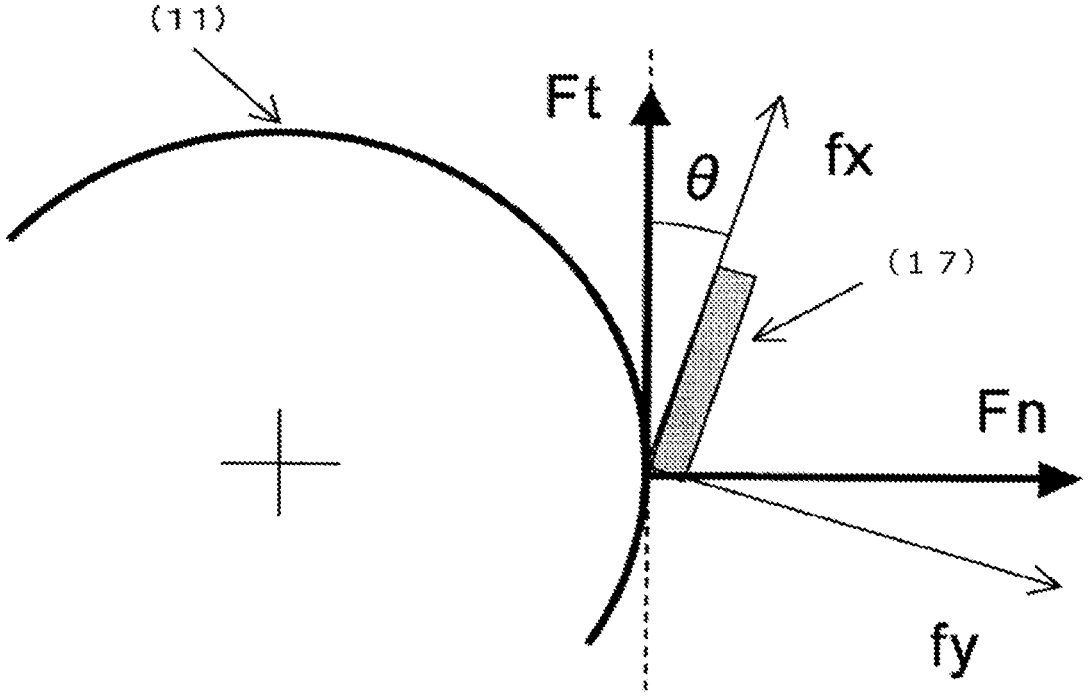
FIG. 2 is a conceptual view illustrating a relationship between tangential force and normal force.

Considering a length, a width, and a thickness in terms of a positional relationship of the elastic body, loads of the width direction (air surface) fx and the thickness direction (cut surface) fy can be obtained by the three-component strain gauge (see FIG. 2). When a contact angle between the elastic body (17) and the photoconductor (11) is determined as θ, acting force of the elastic body in the tangential direction and force of the elastic body in the vertical direction relative to the rotational direction are respectively calculated according to the following formulae (2) and (3), as tangential force Ft and normal force Fn.

$$Ft = fx \cdot \cos\theta - fy \cdot \sin\theta \quad \text{Formula (2)}$$

$$Fn = fx \cdot \sin\theta + fy \cos\theta \quad \text{Formula (3)}$$

The tangential force Ft reflects shear force between the photoconductor and the elastic body, and the normal force Fn reflects compressive stress between the photoconductor and the elastic body. The vector direction of the resultant force thereof can be estimated according to the following formula (4).

$$\text{Vector direction of resultant force} = \arctan(Ft/Fn) \quad \text{Formula (4)}$$

Moreover, the definition of the friction coefficient is a ratio of friction force to normal force. In the present disclosure, therefore, the friction coefficient is defined as follows.

$$\text{Friction coefficient between image bearer and elastic body} = Ft/Fn \quad \text{Formula (5)}$$

In view of generation of large shear force and suppressing variations from the initial state, a friction coefficient Ft/Fn between the image bearer and the elastic body is 0.85 or greater but 1.1 or less, and preferably 0.90 or greater but 1.00 or less.

Shear force accompanied by compressive stress is generated in the elastic body in contact with the photoconductor. The compressive stress and the shear force are respectively generated as force for acting in a normal direction relative to a surface of the photoconductor and force for acting in a rotational direction of the photoconductor by compression of the elastic body and sliding of the photoconductor. When the friction coefficient Ft/Fn is 1.1 or less, a problem that an elastic body is curled in due to excessively strong shear force can be prevented. When the friction coefficient Ft/Fn is 0.85 or greater, a problem that shear force of the elastic body cannot be resist against shear force of particles of a toner or a lubricant and the particles are passed through a gap can be prevented, and removal and discharge of the material can be appropriately performed.

[WRFt(LMH) of Self-Excited Vibration of Shear Force of Elastic Body in LMH Band]

The size WRFt(LMH) of self-excited vibration of shear force of the elastic body in the LMH band is 1.5 gf or greater but 3.5 gf or less, and more preferably 1.6 gf or greater but 3.3 gf or less.

When the WRFt(LMH) is 1.5 gf or greater, removal of the circulation material is not inhibited and unevenness of image density is not caused, and therefore printing of highly uniform image quality can be realized even when a large volume of printing is performed by an electrophotography process. When the WRFt(LMH) is 3.5 gf or less, printing of highly uniform image quality can be realized even when a large volume of printing is performed by an electrophotography process.

By applying self-excited vibration that appropriately softens stress of the elastic body as conditions for making the elastic body in contact with the photoconductor, strong shear force is generated in the elastic body to thereby prevent curling of the elastic body.

As a result of the research performed based on the conditions above, it has been found that large shear force can be stably maintained when the size of the self-excited vibration WRFt(LMH) of shear force of the elastic body in the LMH band is 1.5 gf or greater but 3.5 gf or less. Based on the insight as mentioned, the present disclosure has been accomplished.

The lower limit is a condition determined as a condition that is important for preventing curling of the blade due to shear force.

The elastic body has characteristics that the size WRFt (LLL) of self-excited vibration of the effective shear force in the LLL band is lost as the size WRFt(LMH) of self-excited vibration of the elastic body in the LMH band increases. The upper limit is determined as a condition under which the above-described loss is acceptable.

The size WRFt(LMH) of self-excited vibration of shear force of the elastic body in a LMH band can be determined by the method described in (i) to (v) below:

(i) generating waveform data WFt of a time change of shear force generated in the elastic body due to frictions with the image bearer;

(ii) performing a multiresolution analysis to transform the waveform data WFt through wavelet transformation to separate the waveform data WFt into 6 frequency components (HHH, HHL, HMH, HML, HLH, and HLL) of the waveform data of shear force ranging from a high frequency component to a low frequency component;

(iii) generating waveform data of shear force through decimation performed on the lowest frequency component of the waveform data WFt(HLL) of shear force among the obtained 6 frequency components in a manner that a sampling number is reduced to 1/40;

(iv) further performing a multiresolution analysis to transform the generated waveform data through wavelet transformation to separate the waveform data into additional 6 frequency components (LHH, LHL, LMH, LML, LLH, and LLL) of the waveform data of shear force ranging from a high frequency component to a low frequency component; and (v) determining self-excited vibration WRFt(LMH) of shear force of the elastic body in the LMH band from the waveform data WFt(LMH) of shear force in the LMH band obtained in (iv) according to Formula (1), $$WRFt(LMH) = \frac{1}{L}\int_0^L |WFt[LHM](x)|dx \quad \text{Formula (1)}$$

(L: a duration of the entire measurement, x: time, WFt [LMH](x): waveform data of a time change of shear force in the LMH band)

The self-excited vibration (may be referred to as "chatter vibration") of the elastic body directly reflects change of shear force over time.

For example, the size of self-excited vibration separated into each frequency band can be evaluated by performing the wavelet transformation of the sampling data (WFt) of the shear force obtained by the evaluation device illustrated in FIG. 1, using a numerical value analysis software MATLAB and Wavelettoolbox (available from MathWorks).

When the wavelet transformation on the waveform data (WFt) of a time change of shear force, which is raw data, waveform data separated into 6 frequency bands (HHH, HHL, HMH, HML, HLH, and HLL) is obtained. By further performing the wavelet transformation on the data obtained by decimating the waveform data of the lowest frequency band (referred to as the HLL band) among the 6 frequency bands to 1/40 the sampling number, waveform data separated into additional 6 frequency bands (LHH, LHL, LMH, LML, LLH, and LLL) to the side of low frequencies. Note that, an empirical value that is excellent for separation is selected as the 1/40 decimation.

As a result of the wavelet transformations, the waveform of the time change of the shear force is separated into 12 frequency bands presented in Table 3.

TABLE 3

| Abbreviations of frequency bands | Duration of 1 cycle [msec] | Frequency band [Hz] | Median of duration of 1 cycle [msec] | Median of frequency band [Hz] |
|---|---|---|---|---|
| HHH | 0.0 to 3.8 | 260.4 to ∞ | 1.9 | 520.8 |
| HHL | 1.3 to 7.7 | 130.2 to 781.3 | 4.5 | 223.2 |
| HMH | 2.6 to 16.6 | 60.1 to 390.6 | 9.6 | 104.2 |
| HML | 5.1 to 32 | 31.3 to 195.3 | 18.6 | 53.9 |
| HLH | 12.8 to 64 | 15.6 to 78.1 | 38.4 | 26 |
| HLL | 30.7 to 126.7 | 7.9 to 32.6 | 78.7 | 12.7 |
| LHH | 33.3 to 135.7 | 7.4 to 30 | 84.5 | 11.8 |
| LHL | 67.8 to 234.2 | 4.3 to 14.7 | 151 | 6.6 |
| LMH | 135.7 to 407 | 2.5 to 7.4 | 271.4 | 3.7 |
| LML | 273.9 to 705.3 | 1.4 to 3.7 | 489.6 | 2 |
| LLH | 551.7 to 1221.1 | 0.8 to 1.8 | 886.4 | 1.1 |
| LLL | 1109.8 to 2117.1 | 0.5 to 0.9 | 1613.4 | 0.6 |

The value of the following formula (6) for the waveform data of the time change of shear force separated into a plurality of frequency bands by the wavelet transformation is calculated, and a size of the self-excited vibration of each frequency band can be evaluated.

$$WRFt(x) = \frac{1}{L}\int_0^L |WFt(x)|dx \qquad \text{Formula (6)}$$

(L: a duration of the entire measurement, x: time, WFt(x): waveform data of a time change of shear force in each frequency band)

Therefore, a size WRFt(LMH) of self-excited vibration can be determined according to the following formula (1) based on WFt[LMH](x) that is a function of a time change of the self-excited vibration WFt(LMH) of shear force of the elastic body in the LMH band.

$$WRFt(LMH) = \frac{1}{L}\int_0^L |WFt[LHM](x)|dx \qquad \text{Formula (1)}$$

(L: a duration of the entire measurement, x: time, WFt [LMH](x): waveform data of a time change of shear force in the LMH band)

Formulae (1) and (6) above are numerical formulae utilizing the definition of the arithmetic mean roughness in a measurement of surface roughness. Conventionally, the same processing to the Wavelet analysis used for classification of a surface profile of a photoconductor is performed.

The waveform of the HLL band is converted into a waveform that is obtained by separating the waveform of LHH band into the waveform of the LLL band. At the time of the transformation, to leave the waveform of the HLL band itself is not effective and therefore the waveform of the HLL band is excluded from evaluation targets.

When the wavelet transformation of the waveform of shear force is performed compared with the surface roughness of the photoconductor, the difference to the surface roughness is that a comprehensive size of the shear force only in the LLL band is presented in the shear force (the surface roughness is represented by waveform data of positive and negative values representing the size of a projection and a recess with 0 as a standard, and the shear force is represented by waveform data of waves with an average value of the shear force as a standard without any negative values), whereas the size of wave is represented in the surface roughness.

In order to visually understand frequency properties of the self-excited vibration, WRFt of each frequency band may be represented as a spectrum.

As described above, an analysis of shear force of a blade-shaped elastic body generated by being in contact with a photoconductor can be realized. In the next step, a best mode of a contact state between the photoconductor and the blade-shaped elastic body is considered as follows using the above-described analysis method.

A function of removing or discharging a material from a surface of the photoconductor is influenced by shear force generating by bringing the elastic body into contact with the surface of the photoconductor. When shear force is zero, a material on the surface of the photoconductor is piled up. When the material receives large shear force, the material is easily discharged from the surface of the photoconductor.

In the case where a cylindrical photoconductor is rotated with a center of the cylinder as an axis, for example, an elastic body generates compressive stress, shear force, and self-excited vibration when the elastic body is pressed against the surface of the photoconductor in a state that the surface of the photoconductor moves. The shear force can be increased by changing a depth or angle of the elastic body to be pressed. When a degree of the change is large, the elastic body is curled up and a scale of shear force cannot be maintained. As a result, an ability of discharging a material from a surface of a photoconductor is lost. Even in a state where the above-mentioned curling up of the elastic body is not caused, an ability of discharging a material from a surface of a photoconductor is lost when shear force is unstable.

Figure 3:
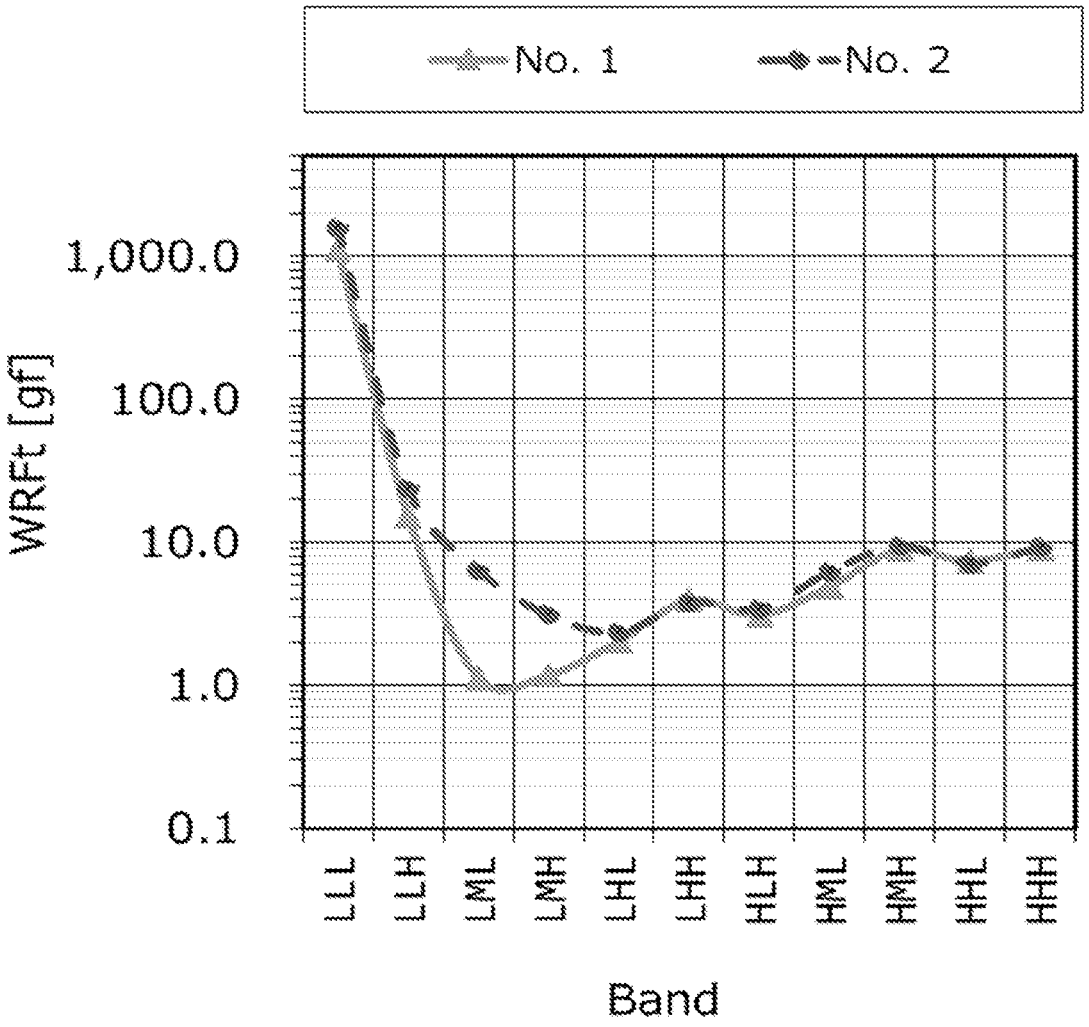
FIG. 3 is a graph depicting one example of a result of analysis of self-excited vibration of an elastic body.

One example of the analysis result of the above-described relationships is illustrated in FIG. 3. FIG. 3 is a graph in which a size of self-excited vibration of each frequency band obtained by performing the wavelet transformation of the shear force generated when a blade-shaped elastic body is brought into contact with a surface of a photoconductor is presented as a spectrum. No. 1 is an analysis result of an example where the blade-shaped elastic body is brought into contact with the surface of the photoconductor in a manner that the self-excited vibration of the LMH frequency band (from 2.5 Hz through 7.4 Hz) is made as small as possible, when the cylindrical photoconductor is rotated at 2.0 Hz. No. 1 is Comparative Example 1 in Examples. The state of No. 1 changes to the state of No. 2, and soon after the change, the elastic body is curled up.

Figure 4:
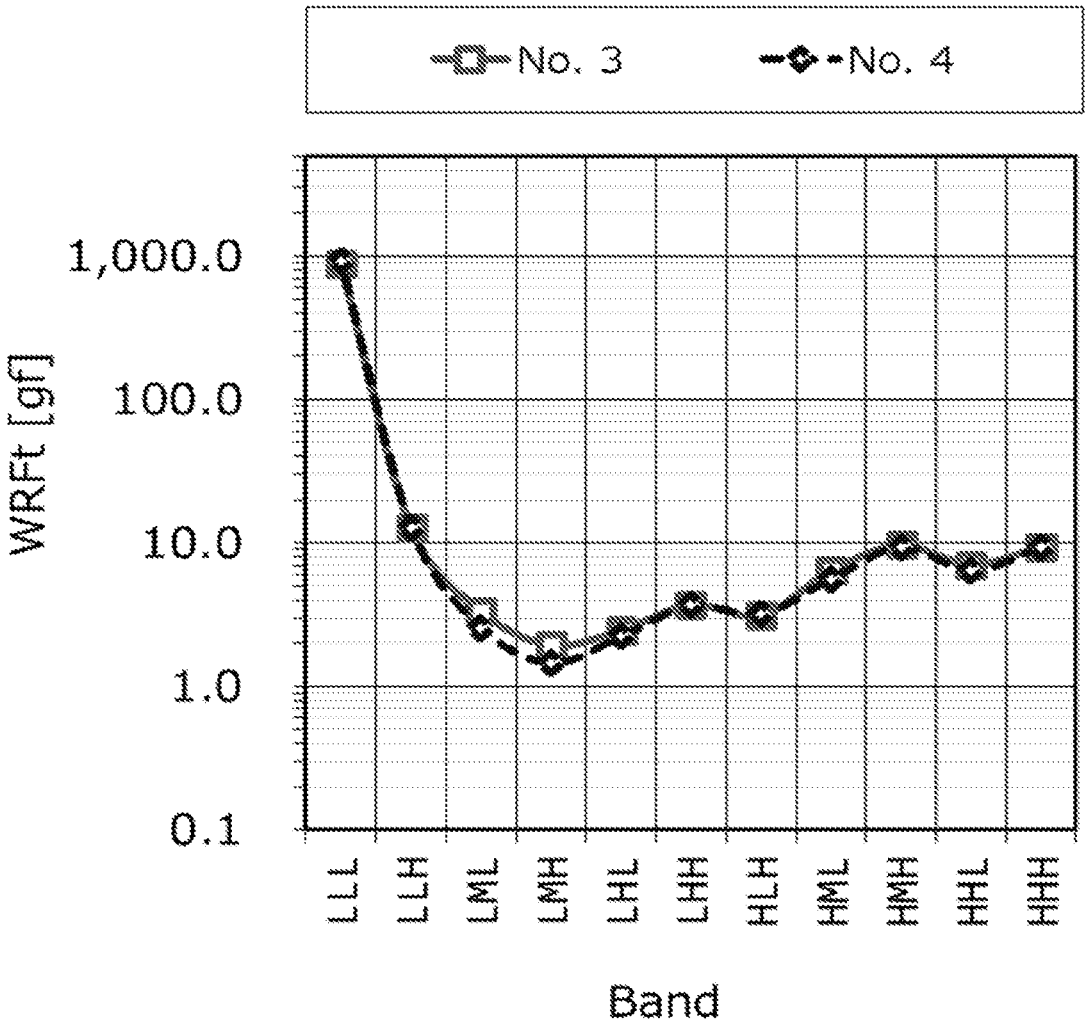
FIG. 4 is a graph depicting another example of a result of analysis of self-excited vibration of the elastic body.

One example of an analysis result of the relationship different from FIG. 3 is illustrated in FIG. 4. In FIG. 4, No. 3 is an analysis result of an example where the blade-shaped elastic body is brought into contact with the surface of the photoconductor in a manner that the self-excited vibration of the LMH frequency band (from 2.5 Hz through 7.4 Hz) is made as large as possible, when the cylindrical photoconductor is rotated under the same condition as in FIG. 3. No. 3 is Example 1 in Examples. The state of No. 3 changes between the state of No. 3 and the state of No. 4, but the state thereof hardly changes and is stably maintained.

<Image Bearer>

A material, shape, structure, size, etc. of the image bearer (may be referred to as a "photoconductor," or an "electrophotographic photoconductor") are not particularly limited and may be appropriately selected depending on the intended purpose.

The image bearer preferably includes a conductive support, and a photoconductive layer and an underlying surface layer disposed in this order on the conductive support.

Moreover, it is preferable that a coating film be formed on a surface of the image bearer and the coating film be a circulation surface layer. Note that, the coating film is coated and formed by the coating unit.

Moreover, an amount of a fluorine element on a surface of the image bearer as measured by XPS is preferably 0.5 atom % or greater but atom % or less.

[Amount of Fluorine Element on Surface of Image Bearer by XPS]

When a fluorine element is included in a surface of the photoconductor, shear force generated between the photoconductor and the elastic body changes. The presence of the fluorine elements affects especially an image forming apparatus including a photoconductor where wax or a fatty acid metal salt is applied to an underlying surface layer of the photoconductor. It is assumed that releasability increases when a fluorine element is included in the surface of the photoconductor. Moreover, an influence of a disturbance, such as an environment for use, can be reduced. This effect becomes significant when an amount of the fluorine element is 0.5 atom % or greater, as measured by XPS of the surface of the photoconductor. As the amount of the fluorine element in the surface of the photoconductor as determined by XPS increases, releasability is saturated but abrasion resistance may be deteriorated. Therefore, the upper limit of the amount thereof may be set to 30 atom %.

Examples of a quantitative method of the amount of the fluorine element in the surface of the image bearer by XPS include a method where the predetermined number (e.g., 10 pieces) of samples each in the size of 15 mm×15 mm are cut out at the identical interval along the longitudinal direction of the photoconductor, an amount of a fluorine element in the predetermined point in an area of 10 mm×10 mm by means of Quantera SXM (ULVAC-PHI, available from INCORPORATED), and an average value of the obtained values (atom %) of the fluorine atom is calculated.

[Arithmetic Mean Surface Roughness WRa(LML) of Underlying Surface Layer in LML Band]

When the image bearer includes a conductive support, and a conductive layer and an underlying surface layer disposed on the conductive support in this order, the arithmetic mean surface roughness WRa(LML) of the underlying surface layer in the LML band is preferably 0.02 μm or greater.

The WRa(LML) can be determined by a method described in (I) to (V) below.

(I) measuring a surface profile of the underlying surface layer by means of a surface roughness-outline shape measuring device to generate one-dimensional data array;

(II) performing a multiresolution analysis to transform the one-dimensional data array through the wavelet transformation to separate the one-dimensional data array into 6 frequency components (HHH, HHL, HMH, HML, HLH, and HLL) ranging from a high frequency component to a low frequency component;

(III) generating a one-dimensional data array through decimation performed on the lowest frequency component of the one-dimensional data array among the obtained 6 frequency components in a manner that the number of data arrays is reduced to 1/40;

(IV) further performing a multiresolution analysis to transform the generated one-dimensional data array through wavelet transformation into additional 6 frequency components (LHH, LHL, LMH, LML, LLH, and LLL) ranging from a high frequency component to a low frequency component; and (V) determining an arithmetic mean roughness (WRa) of each of the 12 frequency components obtained, where the obtained frequency components are as described below, WRa(HHH): Ra in a band where a length of one cycle of a projection and a recess is from 0.3 μm through 3 μm WRa(HHL): Ra in a band where a length of one cycle of a projection and a recess is from 1 μm through 6 μm WRa(HMH): Ra in a band where a length of one cycle of a projection and a recess is from 2 μm through 13 μm WRa(HML): Ra in a band where a length of one cycle of a projection and a recess is from 4 μm through 25 μm WRa(HLH): Ra in a band where a length of one cycle of a projection and a recess is from 10 μm through 50 μm WRa(HLL): Ra in a band where a length of one cycle of a projection and a recess is from 24 μm through 99 μm WRa(LHH): Ra in a band where a length of one cycle of a projection and a recess is from 26 μm through 106 μm WRa(LHL): Ra in a band where a length of one cycle of a projection and a recess is from 53 μm through 183 μm WRa(LMH): Ra in a band where a length of one cycle of a projection and a recess is from 106 μm through 318 μm WRa(LML): Ra in a band where a length of one cycle of a projection and a recess is from 214 μm through 551 μm WRa(LLH): Ra in a band where a length of one cycle of a projection and a recess is from 431 μm through 954 μm WRa(LLL): Ra in a band where a length of one cycle of a projection and a recess is from 867 μm through 1,654 μm.

A surface profile of the photoconductor strongly affects shear force generated between the above-described photoconductor and the blade-shaped elastic body.

In the same manner as in the above-described wavelet transformation, analysis of a cross-sectional curve of the photoconductor is performed in order to determine a surface profile of the photoconductor.

As the surface profile of the photoconductor, specifically, an arithmetic mean roughness (WRa) of 12 frequency components in total is determined by the (I) to (V) above.

In order to make classification of the surface profile simple, the above-described frequency bands are summarized into 3 groups and described according to Table 4.

TABLE 4

| Name of classification | Frequency band | Band names |
|---|---|---|
| Waviness | Low frequency band | LLL, LLH, LML, LMH |
| Roughness | Medium frequency band | LHL, LHH, HLH, HML |
| Fine irregularities | High frequency band | HMH, HHL, HHH |

A multiresolution analysis of a cross-sectional curve of a photoconductor will be described hereinafter.

First, a cross-sectional curve specified in JISB0601 is determined as a surface state of a part for an image forming apparatus, and a one-dimensional data array that is the cross-sectional curve is obtained.

The one-dimensional data array that is a cross-sectional curve may be obtained as a digital signal from a surface roughness-outline shape measuring device, or may be obtained by performing A/D conversion of an analog output of the surface roughness-outline shape measuring device.

A measurement length of a cross-section curve for obtaining a one-dimensional data array is preferably a measurement length determined by the JIS standard, and is preferably 8 mm or greater but 25 mm or less.

Moreover, a sampling gap is desirably 1 μm or less, and preferably 0.2 μm or greater but 0.5 μm or less. In the case where a measurement is performed with a measurement length of 12 mm and 30,720 sampling points, the sampling gap is 0.390625 μm, which is suitable for carrying out the present disclosure.

As described above, a multiresolution analysis (MRA, the first MRA may be referred to as "MRA-1") where the wavelet transformation of the one-dimensional data array is performed to separate into a plurality of frequency components (e.g., 6 components of (HHH), (HHL), (HMH), (HML), (HLH), and (HLL)) ranging from a high frequency component (HHH) to a low frequency component (HLL) is performed. Moreover, a second multiresolution analysis (may be referred to as "MRA-2") where the obtained lowest frequency component (HLL) is decimated to generate a one-dimensional data array, and the wavelet transformation of the one-dimensional data array is performed to separate into a plurality of frequency components (e.g., 6 components of (LHH), (LHL), (LMH), (LML), (LLH), and (LLL)) ranging from a high frequency component to a low frequency component is performed. An arithmetic mean roughness (WRa) of each of the obtained frequency components (12 components) is determined. To distinguish from the general Ra, the arithmetic mean roughness is referred to as WRa in the present specification.

In the present disclosure, software MATLAB is used for the actual wavelet transformation. The definition of the band width is a limitation in the software, and the scope of the definition does not have any particular meaning. Moreover, WRa depends on the above-described reason (a reason for the definition of the band width) and therefore the coefficient changes according to the change of the band width.

The frequency bands of the HML component and the HLH component, the frequency bands of the LHL component and the LMH component, the frequency bands of the LMH component and the LML component, the frequency bands of the LML component and the LLH component, and the frequency bands of the LLH component and the LLL components are each overlapped with each other. The reason for overlapping is as follows.

Specifically, in the wavelet transformation, the original signal is decomposed into L (low-pass components) and H (high-pass components) by the first wavelet transformation (Level 1), and the wavelet transformation is further performed on L to decompose into LL and HL. In the case a frequency component f included in the original signal is matched with the separating frequency F, f is just on a border for separation, and therefore after the separation, the signal is separated into both L and H. This phenomenon is a phenomenon that is unavoidable in the multiresolution analysis. Therefore, it is also important that the frequencies included in the original signal are set not to separate the frequency band that is a target for observation at the time of the wavelet transformation.

[Wavelet Transformation (Multiresolution Analysis) and Symbol of Each Frequency Wave]

In the present disclosure, multiresolution analysis is performed twice. The multiresolution analysis performed first may be referred to as first multiresolution analysis (may be referred to as MRA-1 for convenience), and the multiresolution analysis performed later may be referred to as second multiresolution analysis (may be referred to as MRA-2 for convenience). In order to distinguish between the first and second wavelet transformation, for matter of convenience, H (first) and L (second) are given to abbreviation of each frequency band as prefix.

As the mother Wavelet function used for the first and second wavelet transformations, various wavelet functions can be used. In the present disclosure, the Haar function is used, but the wavelet function for use is not limited to the Haar function.

In the present disclosure, the multiresolution analysis is performed as follows. The first wavelet transformation is performed to separate into a plurality of frequency components, the obtained lowest frequency component is decimated and collected (sampling) to generate a one-dimensional data array reflecting the lowest frequency component data, the second wavelet transformation is performed on the one-dimensional data array to separate into a plurality of frequency components ranging from a high frequency component and a low frequency component.

The decimation performed on the lowest frequency component (HLL) obtained as a result of the first wavelet transformation has characteristics that the number of the data arrays is reduced to 1/40.

The data decimation has an effect of increasing the frequency of the data (expanding a logarithmic scale width of the horizontal axis). In the case where the number of the arrays of the one-dimensional arrays obtained as a result of the first wavelet transformation is 30,000, the number of arrays becomes 750 as the 1/40 decimation is performed.

When the scale of decimation is small, e.g., 1/5, an effect of increasing the frequency of data is small, and therefore data is not sufficiently separated even by performing the second wavelet transformation to perform a multiresolution analysis.

As a method for the decimation, an average vale of 40 data is determined and the average value is treated as representative one point.

Figure 5:
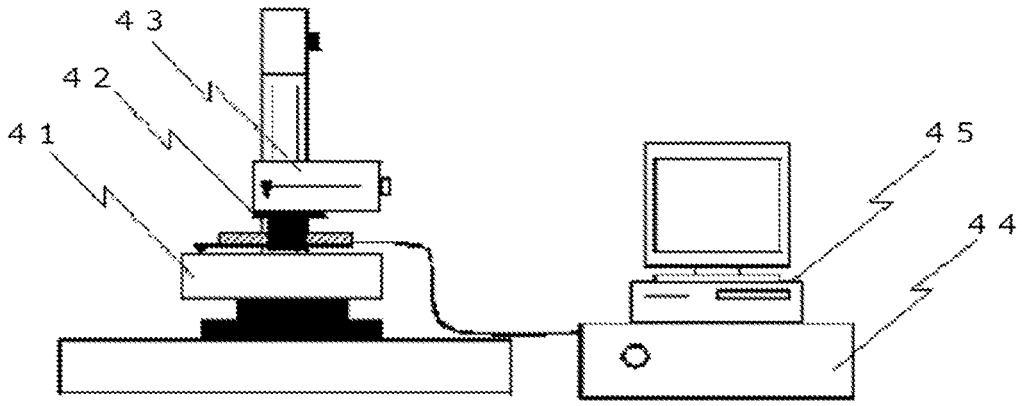
FIG. 5 is a structural view illustrating a surface roughness/outline shape measuring system.

FIG. 5 is a structural view schematically illustrating one structural example of a surface roughness evaluation device of a photoconductor, applied in the present disclosure.

In FIG. 5, (41) is a photoconductor, (42) is a jig equipped with a probe for measuring surface roughness, (43) is a system for moving the jig (42) along a measuring target, (44) is a surface roughness-outline shape measuring device, and (45) is a personal computer configured to perform signal analysis. In FIG. 5, a calculation of the multiresolution analysis above is performed by the personal computer (45). In the case where the photoconductor has a cylindrical shape, the surface roughness measurement of the photoconductor can be performed along any appropriate direction, such as a circumferential direction and a longitudinal direction.

FIG. 5 merely illustrates one example, and the structure may be another structure.

Next, a method for the multiresolution analysis of a surface profile of the photoconductor will be described through a specific example thereof.

A surface profile of the photoconductor is measured by means of a surface roughness-outline shape measuring device that is Surfcom1800G (pick up: E-DT-S01A, available from TOKYO SEIMITSU CO., LTD.).

The 30,720 sampling points are used for data processing with the first measuring length to be 10 mm. Four points are measured for one measurement. The measurement result is sent to a personal computer, and the first wavelet transformation thereof, 1/40 decimation processing to the lowest frequency component obtained by the first wavelet transformation, and the second wavelet transformation are performed by the program created by the present inventors.

An arithmetic mean roughness WRa, maximum height Rmax, ten-point mean roughness Rz of the results of the first and second multiresolution analysis are determined. One example of the calculation results is illustrated in FIG. 6.

Figure 6:
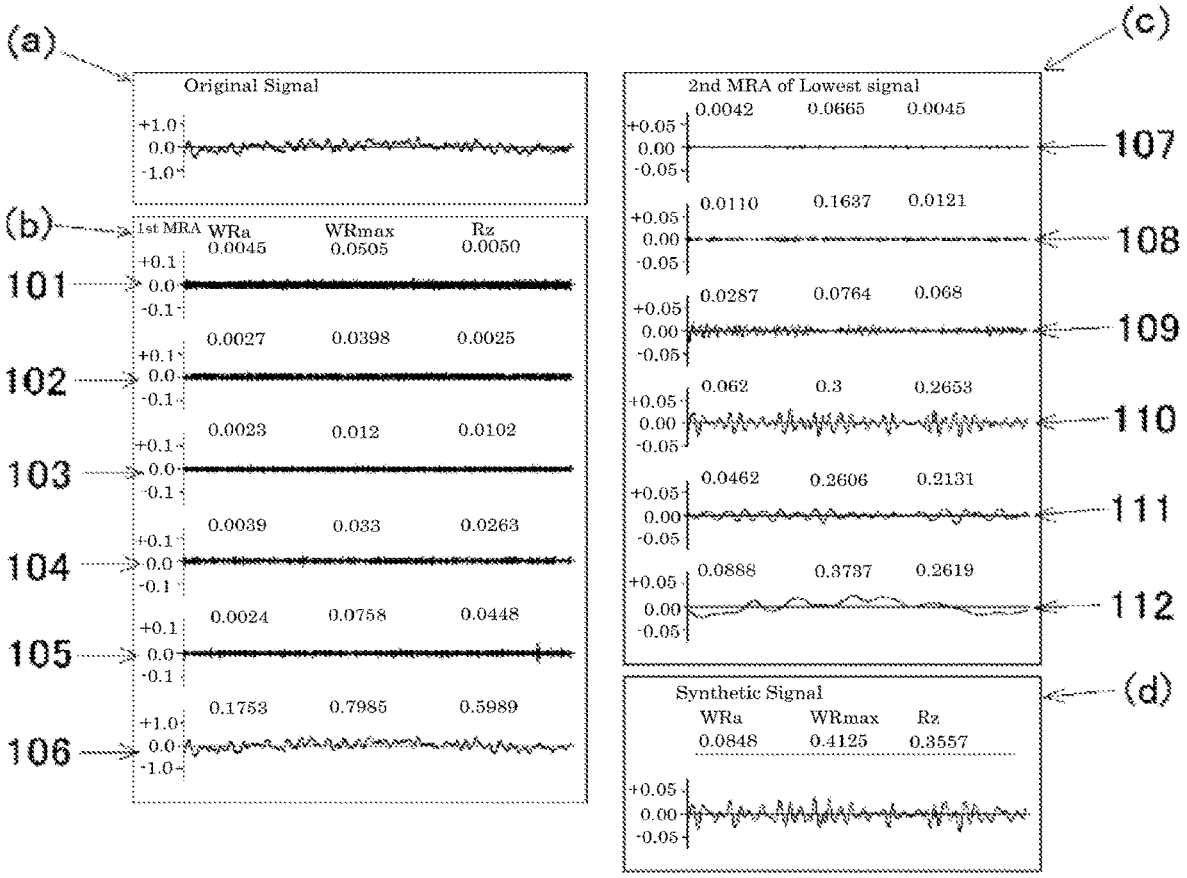
FIG. 6 is a diagram depicting one example of a result of multiresolution analysis by wavelet transformation.

In FIG. 6, the graph of FIG. 6(*a*) is the original data obtained by the measurement performed by Surfcom 1800G, and may be referred to as a roughness curve or a cross-section curve.

There are 14 graphs in FIG. 6. The vertical axes each denote a displacement of a surface profile and a unit thereof is μm. Moreover, the horizontal axes each denote a length, and the measurement length of 12 mm even though a scale is not marked.

Moreover, the 6 graphs of FIG. 6(*b*) are the results of the first multiresolution analysis (MRA-1), the uppermost graph is a graph of the highest frequency component (HHH), and the lowermost graph is a graph of the lowest frequency component (HLL).

In FIG. 6(*b*), the uppermost graph (101) is the highest frequency component of the result of the first multiresolution analysis and is called HHH in the present disclosure.

- Graph (102) is a frequency component that is the second highest frequency component of the result of the first multiresolution analysis and is called HHL in the present disclosure.
- Graph (103) is a frequency component that is the third highest frequency component of the result of the first multiresolution analysis and is called HMH in the present disclosure.
- Graph (104) is a frequency component that is the fourth highest frequency component of the result of the first multiresolution analysis by three and is called HML in the present disclosure.
- Graph (105) is a frequency component that is the fifth highest frequency component of the result of the first multiresolution analysis and is called HLH in the present disclosure.
- Graph (106) is a frequency component that is the lowest frequency component of the result of the first multiresolution analysis and is called HLL in the present disclosure.

Figure 7:
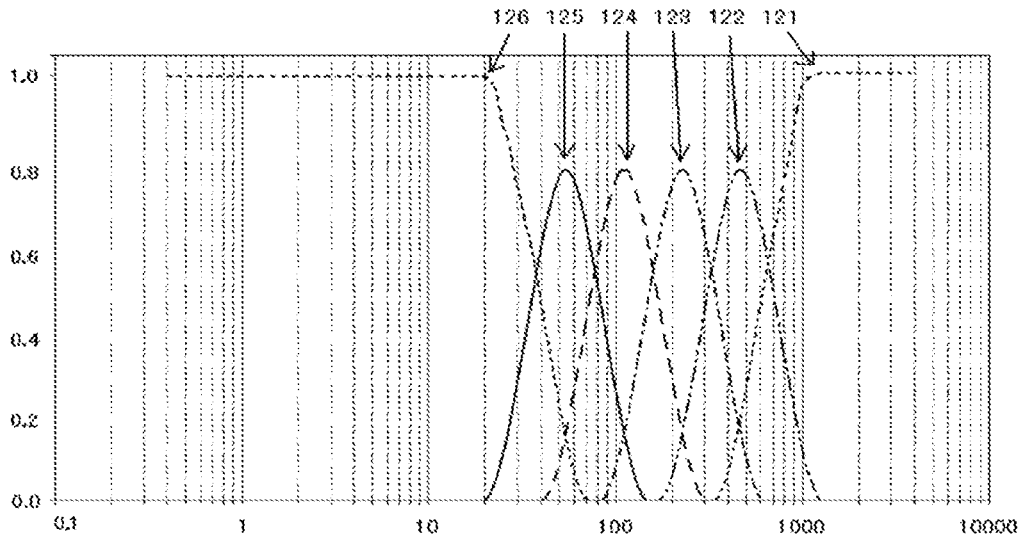
FIG. 7 is a graph depicting separation of a frequency band in the first multiresolution analysis.

In the present disclosure, the graph of FIG. 6(*a*) is separated into 6 graphs of FIG. 6(*b*) according to the frequency, and the state of the frequency separation is illustrated in FIG. 7.

In FIG. 7, the number of projections and recesses present per 1 mm in the length is plotted on the horizontal axis when a shape of the projection and recess is a sine wave. Moreover, a ratio of the size of the amplitude of the number of projections and recesses when separated in each band is plotted on the vertical axis.

In FIG. 7, (121) is a band of the highest frequency component (HHH) in the first multiresolution analysis (MRA-1), (122) is a band of the frequency component (HHL) that is the second highest frequency component in the first multiresolution analysis, (123) is a band of the frequency component (HMH) that is the third highest frequency component in the first multiresolution analysis, (124) is a band of the frequency component (HML) that is the fourth highest frequency component in the first multiresolution analysis, (125) is a band of the frequency component (HLH) that is the fifth highest frequency component in the first multiresolution analysis, and (126) is a band of the lowest frequency component (HLL) in the first multiresolution analysis.

FIG. 7 is more specifically explained. When the number of projections and recesses per 1 mm is 20 or less, the whole projections and recesses appear on the graph (126). When the number of the projections and recesses per 1 mm is 110, for example, the projections and recesses most strongly appear on the graph (124), which means the displacement of the surface profile appears in HML in FIG. 6(*b*). When the number of the projections and recesses per 1 mm is 220, the projections and recesses most strongly appears on the graph (123), which means the displacement of the surface profile appears in HMH in FIG. 6(*b*). In the case where the number of the projections and recesses per 1 mm is 310, moreover, the projections and recesses appear in the graphs (122) and (123), which means the displacement of the surface profile appears in both HHL and HMH in FIG. 6(*b*). Accordingly, which of the 6 graphs of FIG. 6(*b*) the displacement of the surface profile appears in is determined by the frequency of the surface roughness. In other words, the surface profile of the fine irregularities appears in the graph of the upper side in FIG. 6(*b*), and the surface profile of large surface waviness appears in the graph of the lower side in FIG. 6(*b*).

In the present disclosure, the surface roughness is decomposed according to the frequency thereof as described above. FIG. 6(*b*) illustrates the state thereof as graphs. The surface roughness of each frequency band is determined from the graph of each frequency band. As the surface roughness, arithmetic mean roughness, maximum height, and ten-point mean roughness can be calculated.

As described above, the arithmetic mean roughness WRa, maximum height WRmax, and ten-point mean roughness WRz are presented as numerical values in each graph in FIG. 6(*b*).

In order to distinguish from general notation, W is added to the beginning of the abbreviations of the arithmetic mean roughness Ra, maximum height Rmax, and ten-point mean roughness Rz of the roughness curve obtained by the wavelet transformation.

In the present disclosure, the data measured by the surface roughness-outline shape measuring device is separated into plurality of data according to the frequency thereof, and therefore a variation in the projections and recess in each frequency band can be measured.

In the present disclosure, moreover, the lowest frequency component, i.e., data of HLL, which is the data separated according to the frequency as in FIG. 6(*b*), is decimated.

In the present disclosure, how the decimation is performed, i.e., how many data is extracted, can be determined by experiments. By optimizing the scale of the decimation, the frequency band separation in the multiresolution analysis illustrated in FIG. 7 can be optimized and therefore a target frequency can be collected as a center of a band thereof.

In FIG. 6, decimation where one data is selected from 40 data is performed.

Figure 8:
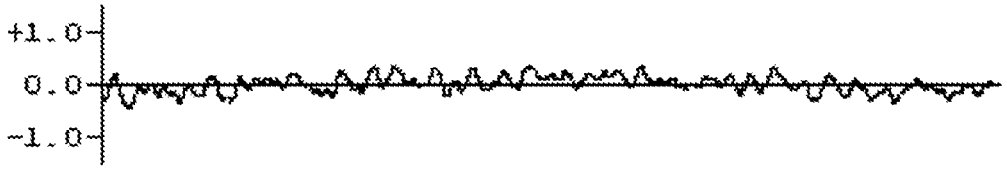
FIG. 8 is a graph depicting the lowest frequency data in the first multiresolution analysis.

The result of the decimation is presented in FIG. 8. In FIG. 8, a surface profile (projections and recesses) is plotted on the vertical axis and a unit thereof is μm. Moreover, the length is 12 mm even through no scale marks are given on the horizontal axis.

In the present disclosure, multiresolution analysis is further performed on the data of FIG. 8. Specifically, the second multiresolution analysis (MRA-2) is performed.

The 6 graphs of FIG. 6(*c*) are result of the second multiresolution analysis (MRA-2), and the uppermost graph (107) is the highest frequency component of the result of the second multiresolution analysis and is called LHH.

Graph (108) is a frequency component that is the second highest frequency component of the result of the second multiresolution analysis and is called LHL.

Graph (109) is a frequency component that is the third highest frequency component of the result of the second multiresolution analysis and is called LMH.

Graph (110) is a frequency component that is the fourth highest frequency component of the result of the second multiresolution analysis and is called LML.

Graph (111) is a frequency component that is the fifth highest frequency component of the result of the second multiresolution analysis and is called LLH.

Graph (112) is the lowest frequency component of the result of the second multiresolution analysis and is called LLL.

Figure 9:
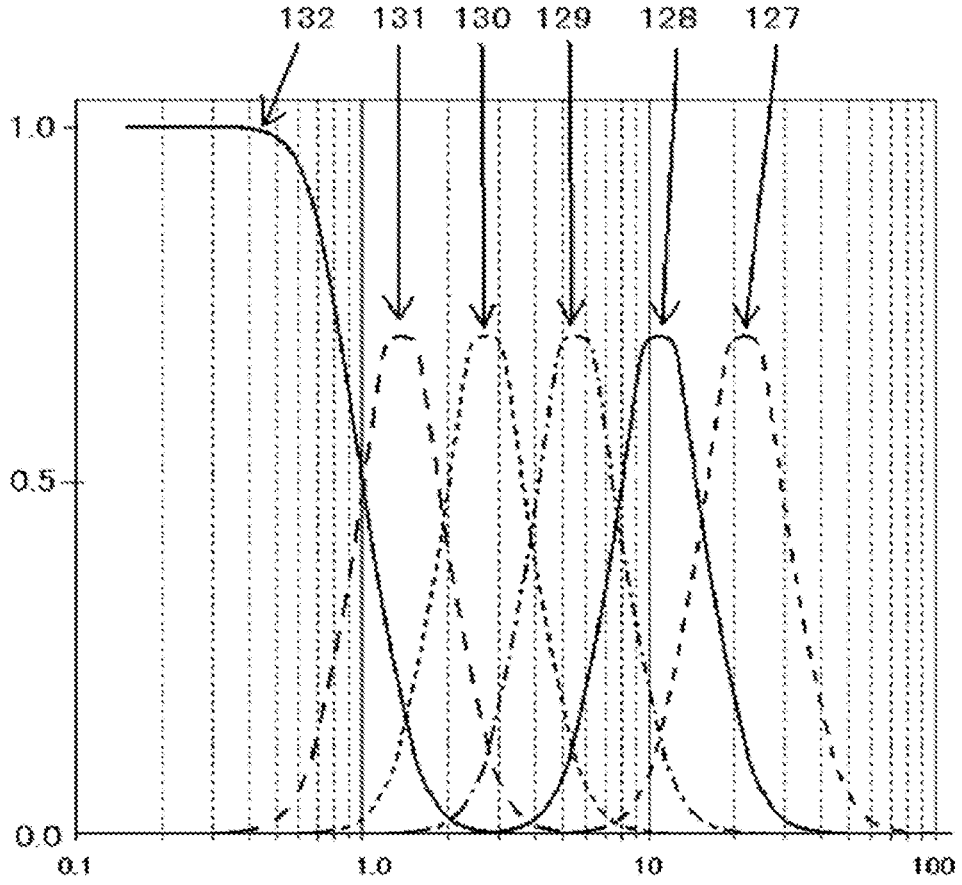
FIG. 9 is a graph depicting separation of a frequency band in the second multiresolution analysis.

In the present disclosure, the result is separated into 6 graphs in FIG. 6(*c*) according to the frequency and the state of the frequency separation is illustrated in FIG. 9.

In FIG. 9, the number of projections and recesses present per 1 mm in the length is plotted on the horizontal axis when a shape of the projection and recess is a sine wave. Moreover, a ratio of the size of the amplitude of the number of projections and recesses when separated in each band is plotted on the vertical axis.

In FIG. 9, (127) is a band of the highest frequency component (LHH) in the second multiresolution analysis, (128) is a band of a frequency component (LHL) that is the second highest frequency component in the second multiresolution analysis, (129) is a band of a frequency component (LMH) that is the third highest frequency component in the second multiresolution analysis, (130) is a band of a frequency component (LML) that is the fourth highest frequency component in the second multiresolution analysis, (131) is a band of a frequency component (LLH) that is the fifth highest frequency component in the second multiresolution analysis, and (132) is a band of the lowest frequency component (LLL) in the second multiresolution analysis.

FIG. 9 is more specifically explained. When the number of projections and recesses per 1 mm is 0.2 or less, the whole projections and recesses appear on the graph (132).

When the number of the projections and recesses per 1 mm is 11, for example, the graph (128) is the highest, which means that the projections and recesses most strongly appear in the band of the frequency component that is the second highest frequency component in the second multiresolution analysis, and means that the displacement of the surface profile appears in LML in FIG. 6(*c*).

Accordingly, which of the 6 graphs of FIG. 6(*c*) the displacement of the surface profile appears in is determined by the frequency of the surface roughness.

In other words, the surface profile of the fine irregularities appears in the graph of the upper side in FIG. 6(*c*), and the surface profile of large surface waviness appears in the graph of the lower side in FIG. 6(*c*).

In the present disclosure, the surface roughness is decomposed according to the frequency thereof as described above. FIG. 6(*c*) illustrates the state thereof as graphs. The surface roughness of each frequency band is determined from the graph of each frequency band. As the surface roughness, arithmetic mean roughness Ra(WRa), maximum height Rmax(WRmax), ten-point mean roughness Rz(WRz) can be calculated.

As described above, a multiresolution analysis where the wavelet transformation of the one-dimensional data array obtained by measuring the projection-recess profile of the surface of the photoconductor by means of the surface roughness-outline shape measuring device to separate into a plurality of frequency components ranging from a high frequency component to a low frequency component is performed. Moreover, a one-dimensional data array is generated by decimating the obtained lowest frequency component. A multiresolution analysis where the wavelet transformation of the obtained one-dimensional data array is performed to separate into a plurality of frequency components ranging from a high frequency component to a low frequency component. An arithmetic mean roughness Ra(WRa), maximum height Rmax(WRmax), ten-point mean roughness Rz(WRz) of each frequency component obtained are determined. The results are presented in Table 5.

TABLE 5

| | | Surface roughness determined from result of multiresolution analysis | | |
|---|---|---|---|---|
| The number of multiresolution analyses | Signal name | Arithmetic mean roughness (WRa) | Maximum height (WRmax) | 10 point mean roughness (WRz) |
| First | HHH | 0.0045 | 0.0505 | 0.0050 |
| | HHL | 0.0027 | 0.0398 | 0.0025 |
| | HMH | 0.0023 | 0.0120 | 0.0102 |
| | HML | 0.0039 | 0.0330 | 0.0263 |
| | HLH | 0.0024 | 0.0758 | 0.0448 |
| | HLL | 0.1753 | 0.7985 | 0.6989 |
| Second | LHH | 0.0042 | 0.0665 | 0.0045 |
| | LHL | 0.0110 | 0.1637 | 0.0121 |
| | LMH | 0.0287 | 0.0764 | 0.0680 |
| | LML | 0.0620 | 0.3000 | 0.2653 |
| | LLH | 0.0462 | 0.2606 | 0.2131 |
| | LLL | 0.0888 | 0.3737 | 0.2619 |

Figure 10:
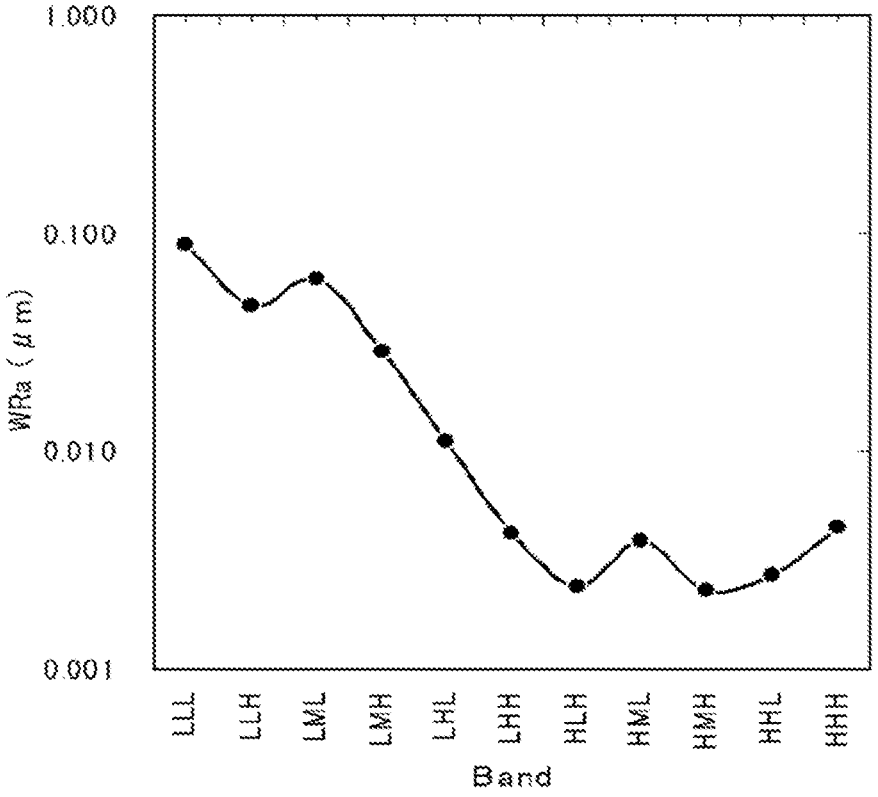
FIG. 10 is a graph depicting one example of a roughness spectrum.

The profile of FIG. 10 is obtained by plotting the values of the arithmetic mean roughness (WRa) obtained by the multiresolution analysis performed on the cross-section curve of FIG. 6 in the present disclosure in the order of the signals, and connecting with a line.

On calculation, the HLL component gives an outstanding value, and therefore surface roughness of the HLL band obtained by the multiresolution analysis is omitted. In the present disclosure, the profile of FIG. 10 is referred to as a surface roughness spectrum or a roughness spectrum. Note that, there is no problem in omitting the HLL component because after performing the wavelet transformation on the roughness curve of the omitted HLL component, it becomes the LHH component or the LLL component, and therefore information related to the HLL reflects on the LHH component or the LLL component.

The shear force and self-excited vibration of the elastic body in contact with the photoconductor largely varies depending on the above-described surface profile (e.g., a size of waviness, roughness, and fine irregularities) of the photoconductor. In the case where the photoconductor is OPC, shaping of a surface of the photoconductor can be controlled by a formulation of a coating material and coating conditions. An example thereof is as follows. The waviness can be controlled by controlling a boiling point of a solvent of the coating material formulation, the roughness can be controlled by controlling the particle diameter of the filler of the coating material formulation, and the fine roughness can be controlled by controlling conditions of a polishing treatment with a wrapping film or conditions of a spraying treatment of a dispersion liquid of filler having particle diameters of nano order.

In the case of an image forming process where wax or a fatty acid metal salt is applied to a photoconductor, a coating film of the wax or fatty acid metal salt is regarded as a surface of the photoconductor in the present disclosure. Therefore, the surface of the photoconductor at which the coating film does not exist may be referred to as an underlying surface layer. The underlying surface layer may be a protective layer, a charge-transporting layer, or a photoconductive layer having functions of both charge generation and charge transportation.

The underlying surface layer of the photoconductor is shaped into a plurality of shaped by the above-described method and sizes of each shape and the self-excited vibration of the elastic body are evaluated. A relationship between the surface profile of the photoconductor and the size WRFt(LMH) of the self-excited vibration of the elastic body, especially in the shape of a blade, in the LMH band is calculated by multivariate analysis. A surface profile that can maximize the satisfaction function when the value of WRFt (LMH) is 1.5 gf or greater but 3.5 gf or less can be specified. In the present disclosure, the neural network analysis according to the back-propagation algorithm is used as the multivariate analysis. The optimization of the multivariate analysis and the maximization of the satisfaction function can be calculated by means of statistical analysis software JMP available from SAS Institute.

The above-described novel surface profile of the underlying surface layer of the photoconductor gives an effect of significantly improving coating ability of the circulation material. In order to make the effect as mentioned permanent, to increase strength of the underlying surface profile is advantageous. When the photoconductor is worn by image formation performed by an electrophotographic process, the surface profile changes, which can be seen from the change in the surface roughness. The present inventors have experimentally confirmed the tendency that surface roughness increases as wear of the photoconductor progresses.

Film formation performed by a wet process is effective for shaping of the surface profile of the underlying surface layer. Use of the wet process is advantageous in techniques and cost compared with mechanical processing because the shaping is to control the surface profile in the scale of microns to millimeters. In the film formation by the wet process, viscosity of a coating material is preferably 0.9 mPa·s or greater but 10 mPa·s or less because a range of shape control can be wide with the coating material of low viscosity. The lower limit of the viscosity of the coating material is determined from a value asymptotic to the viscosity of the solvent, and the upper limit is determined because it is difficult to control the shape above the upper limit. In order to obtain low viscosity of the coating material and sufficient strength of the underlying surface layer after the film formation for practical use, a reactive resin monomer having a three-dimensional crosslinked structure is preferably included in the coating material as a main component.

Since a resin having a three-dimensional crosslinked structure is used in the underlying surface layer of the photoconductor, the underlying surface layer having excellent abrasion resistance can be obtained. The reason thereof is probably because, even when part of chemical bonds constituting the resin film is cut due to deterioration in durability, the cut is not necessarily directly linked to abrasion as long as other sites of the chemical bonds are remained. The excellent abrasion resistance directly contributes to the stability of the surface profile. As a result, the coating ability of the circulation material is stabilized by using the resin having a three-dimensional crosslinked structure in the underlying surface layer.

Among resins having a three-dimensional crosslinked structure, an acrylic resin has an advantage that the acrylic resin has large dielectric constant compared with a solid solution between polycarbonate and a charge-transporting material, and therefore an influence of a projection and recess shape on the electrostatic properties is small.

As described above, use of the resin having a three-dimensional crosslinked structure in the underlying surface layer can make shaping of the circulation surface layer and the underlying surface layer easy, and easily improves coating ability of the circulation material. Moreover, an effect of suppressing a change of the specific surface profile of the underlying surface layer and stabilizing coating ability of the circulation material can be obtained.

In order to shape of the underlying surface layer, projections and recesses can be imparted by adding filler to a coating material having a relatively low viscosity that is a base. Various shapes of projections and recesses can be obtained by controlling an aggregation state of the filler.

The technique where a rein having a three-dimensional crosslinked structure is used in the undermost surface layer of a photoconductor and moreover filler is added has been known in the past, but most of such proposals are focused on improving mechanical strength. Surprisingly, the technology disclosing use of a dispersing agent of the filler in combination has been rarely found. Moreover, it seems that controlling a surface profile of the photoconductor by varying the aggregation state of the filler with the dispersing agent is a novel idea.

Among fillers, the filler to be formulated is preferably metal oxide filler having an average primary particle diameter of nano order and metal oxide filler, such as α-alumina, tin oxide, titania, silica, and ceria, is effective.

Some of fillers, such as organic particles and inorganic particles, are not easily dispersed, only have surface roughness of micron order or greater, or have many spiky projections to cause breakage of a coating blade or blade. On the other hand, the metal oxide filler does not have the above-described problems and therefore the metal oxide filler is preferable. For the same reason, an amount of the metal oxide is preferably 1% by mass or greater but 20% by mass or less relative to the underlying surface layer. The lower limit and upper limit of the amount of the metal oxide are defined because a shape control of the underlying surface layer becomes difficult outside the range defined by the lower limit and the upper limit.

Moreover, an effect of improving mechanical strength obtained by using metal oxide can be also obtained in the present disclosure.

In the rare case where the coating of circulation material happens to be insufficient, it is expected that paper dusts or a toner component may be filmed on the underlying surface layer of the photoconductor, or filming may occur in the shape of killifish. As a result, wettability of the underlying surface layer changes and therefore an expected circulation process of the circulation material may be failed. Meanwhile, it has been experimentally proven that the above-mentioned filming can be significantly reduced by adding α-alumina particles having a hexagonal close-packed structure to the underlying surface layer of the photoconductor, and such use of the α-alumina particles is effective.

The reason for this is not yet clear, but it is assumed that height hardness of the α-alumina has an effect of preventing the underlying surface layer from being damaged or cuts and this effect rarely give an opportunity for filming to occur. Moreover, another reason seems to be that projections and recesses of the photoconductor the α-alumina forms have an effect of relatively stably maintaining a rubbing state between the photoconductor and the coating blade or blade-shaped elastic body.

In most of cases, formation of extreme irregularities, such as spikes, can be prevented at the time of film formation, when a volume average particle diameter of the filler that is α-alumina having a hexagonal close-packed structure is 0.01 μm or greater but 2.0 μm or less, more preferably 0.03 μm or greater but 1.5 μm or less. Therefore, a shape satisfying the conditions in the present disclosure that WRa(LLH) is less than 0.04 μm and WRa(HLH) is less than 0.005 μm can be easily formed. Therefore, the above-mentioned range of the volume average particle diameter of the filler is advantageous.

As described above, an effect of preventing modification of the surface of the photoconductor can be obtained by adding the α-alumina having the average primary particle diameter of 0.01 μm or greater but 2.0 μm or less. Therefore, the photoconductor which includes the circulation surface layer at the outermost surface thereof can be stabilized. As described later, the average primary particle diameter of the α-alumina is particularly preferably 0.2 μm or greater but 0.5 μm or less.

<Coating Step and Coating Unit>

The coating step is a step including coating a surface of the image bearer with a film of the circulation material.

The coating unit is not particularly limited and may be appropriately selected depending on the intended purpose, as long as the coating unit is a unit configured to coat a surface of the image bearer with a film of the circulation material. Examples of the coating unit include: a coating unit, in which a circulation material formed into a shape to be held by a support is pressed against a coating brush with a press spring having a spring constant with which the predetermined consumption is obtained and a coating film of the circulation material is formed on a photoconductor as the coating brush rotates; and a coating unit including a blade-shaped elastic body (may be referred to as a "coating blade") configured to apply wax or fatty acid metal salt onto a surface of the photoconductor where the coating blade is disposed as part of a supply unit of a circulation material, and is different from an elastic body of the cleaning unit.

It is preferred that the shear force Ft of the coating blade be 1.15 kgf or greater but 1.35 kgf or less and the friction coefficient Ft/Fn be 0.90 or greater but 0.96 or less because an equilibrium state of input and output of the material is easily maintained.

The circulation material (may be also referred to as a "lubricant") is preferably wax or a fatty acid metal salt, or both thereof.

The wax is not particularly limited and may be appropriately selected depending on the intended purpose. Examples of the wax include: vegetable wax, such as haze wax, sumac wax, palm wax, and carnauba wax; animal wax such as bees wax, spermaceti, privet wax, and wool wax; and mineral wax, such as montan wax and paraffin wax.

The fatty acid metal salt is not particularly limited and may be appropriately selected depending on the intended purpose. Examples of the fatty acid metal salt include: fatty acid metal salts that can have a lamellar structure, such as zinc salts, aluminium salts, calcium salts, magnesium salts, and lithium salts of stearic acid, palmitic acid, myristic acid, or oleic acid; and mixtures of any of the above-listed metal salts. Among the above-listed examples, zinc stearate is preferable because zinc stearate is produced in an industrial scale, has been used in various field, and has desirable cost, quality, stability, and reliability. Moreover, zinc stearate has an advantage that various conventional coating techniques accumulated as an effective coating method of a lubricant are easily applied.

Note that, a higher fatty acid metal salt typically industrially used is not a single composition of a compound of a name of the higher fatty acid metal salt, and includes another similar fatty acid metal salt, metal oxide, or free fatty acid in a greater or lesser degree. The same can be said to the fatty acid metal salt for use in the present disclosure.

High reliability and reduction in the cost can be obtained in the formation of the circulation surface layer by using the circulation material. Moreover, it is convenient in terms of a development of a device that can easily apply the coating techniques that have been accumulated as coating techniques of lubricants.

Shear force generated between the photoconductor and the elastic body changes as wax or fatty acid metal salt is applied onto a surface of the photoconductor. The wax or fatty acid metal salt has lubricity and affects self-excited vibration of the elastic body.

Since the wax or fatty acid metal salt forms a coating film on a surface of the photoconductor, deterioration of the underlying surface layer is prevented to thereby prevent variations in self-excited vibration of the elastic body.

The circulation material having excellent coating ability, such as zinc stearate has a lamellar structure (a structure where layers formed by regularly folding molecules are aligned), and is widely spread as the molecules are sheared. Therefore, a surface of a photoconductor can be effectively covered with a small amount of the circulation material. In order to properly remove the circulation material, specific shear force is required. In order to circulate the material with maintaining the equilibrium state of input and output of the material that is supplied to and removed from the surface of the photoconductor, conditions for supplying the material need to be controlled as well as shear force generated in the elastic body configured to remove the above-mentioned material from the photoconductor.

The coating film is preferably a circulation surface layer.

In the present specification, the term "circulation surface layer" is defined as a coating layer where a defect of the coating film is 10% by mass or less and an increase of the coating film is 0% by mass or less (i.e., a case where the below-described coating film circulatory is −0.10 or greater but 0 or less).

When the circulation material is applied at the same time as an image formation process including various disturbances, the deposition efficiency of the circulation material needs to compensate loss due to the process, and loss due to the degree of pollution of the underlying surface layer to be coated. The loss and the coating film circulatory are calculated from the deposition efficiency difference of the circulation material between the presence and absence of the disturbance.

In the case of the image forming apparatus in which a circulation surface layer is formed, a coating film defect of the circulation material and the degree of filming on the surface of the photoconductor are evaluated by simply increasing or decreasing the circulation material and the conditions with which a circulation surface layer is formed can be specified.

The coating film circulatory can be judged from a change in a mass film thickness of the surface layer formed of the circulation material due to usage.

The circulation material is not accumulated and therefore the film thickness of the circulation surface layer does not increase, unless a supply amount of the circulation material supplied to the underlying surface layer of the photoconductor exceeds the removal amount of the circulation material. The coating film circulatory of a brand new photoconductor can be judged by determining a mass film thickness of a surface layer at a relatively initial stage and a mass film thickness of the surface layer after use for a while.

Examples of a method for measuring the coating film circulatory include a method where the number of rotations of the photoconductor and the number of coating are determined as the same meaning, a mass film thickness when a photoconductor is rotated with the number of rotations (the number of rotations of a drum in the case where the photoconductor is in the shape of a drum) being 2,500 and 25,000 in a print test and a mass film thickness when a circulation material is applied is calculated by ICP or XRF, and dependency of the mass film thickness to the number of coating is evaluated. For convenience, the number of rotations of the drum can be calculated by dividing a total running distance of the photoconductor with a circumference length of the photoconductor. The number of rotations of the drum being 2,500 is determined to avoid an unreasonable situation that a mass film thickness of a circulation material is determined in an unsteady state with the extremely small number of rotations. The number of rotations of the drum being 25,000 is determined as a condition that is sufficient to evaluate a variation of the mass film thickness. Accordingly, the number of rotations adjacent but outside the above-mentioned range does not fall outside a scope of the present disclosure.

As the proportion coefficient f indicating the coating film circulatory, a change in the mass film thickness relative to the number of coating performed is preferably 0 or less because the supply amount of the circulation material to a surface of the photoconductor does not exceed the removal amount, and is more preferably satisfies the relationship represented by the following formula (7) because it is effective in maintenance of the stable surface and the stability of the surface is solidified.

$$\tau = f\alpha + \beta \quad \text{Formula (7)}$$

$$(-0.1 \leq f \leq 0)$$

τ: mass film thickness (nm) of the circulation material

α: the number of coating performed (in case of the drum, the rotational number of the drum (unit: 1,000 rotations))

β: arbitrary constant

In order form a circulation surface layer, the circulation material is preferably a material that is easily removed from and easily coats the underlying surface layer of the photoconductor. In order to make the circulation surface layer permanent, it is particularly preferable that an amount of the material to coat per cycle and an amount of the material removed by cleaning be equivalent.

Moreover, it is also important that a consumption amount of the circulation material is not excessive. The consumption amount of the circulation material is determined as input (mg/km) of the circulation material relative to a run distance of the photoconductor generated in an image forming process.

Examples of a method for controlling the coating state of the circulation material include: a method where contact pressure between a solid circulation material and a coating brush is enhanced; a method where rotational speed of the coating brush is controlled; and a method where the number of revolutions is controlled according to image forming information. As the circulation material, wax or a higher fatty acid metal salt may be used alone, or the circulation material may be used as a binder and mixed with another functional material, such as a charge-transporting material and an antioxidant.

An effect of easily obtaining equivalent of an amount of the material when removal and coating of the circulation material are repeated is obtained by using the above-described circulation material, and specifying a material that is easily formed into a film and removed within an image forming apparatus. Accordingly, a module for applying and removing the circulation material can be simple. Moreover, the circulation surface layer can be formed over a long period. In combination with the profile of the underlying surface layer, furthermore, covering capability per cycle can be significantly enhanced, and the consumption amount of the circulation material can be reduced.

<Charging Step and Charging Unit>

The charging step is a step including charging a surface of the image bearer and is performed by the charging unit.

The charging unit is not particularly limited and may be appropriately selected depending on the intended purpose as long as the charging unit is a unit capable of charging a surface of the image bearer. Examples of the charging unit include a contact charger, known in the art as itself, equipped with a conductive or semiconductive roller, brush, film, or rubber blade, and a non-contact charger utilizing corona discharge, such as corotron and scorotron.

<Exposing Step and Exposing Unit>

The exposing step is a step including exposing the charged surface of the image bearer to light to form a latent image. The exposing step is performed by the exposing unit. For example, the exposing can be performed by exposing a surface of the image bearer imagewise using the exposing unit.

The exposing unit is not particularly limited as long as the exposing unit is a unit capable of exposing the charged image bearer to light to form an electrostatic latent image, and may be appropriately selected depending on the intended purpose. Examples of the exposing unit include various exposure devices, such as a reproduction optical exposure device, a rod-lens array exposure device, a laser optical exposure device, and a liquid crystal shutter optical device.

Note that, in the present disclosure, a back light system where exposing is performed imagewise from a back side of the electrostatic latent image bearer may be employed.

<Developing Step and Developing Unit>

The developing step is a step including developing the latent image formed on the image bearer with a toner, and is performed by the developing unit.

The developing unit is not particularly limited and may be appropriately selected depending on the intended purpose, as long as the developing unit is a unit capable of developing a latent image formed on the image bearer with a toner. Preferable examples of the developing unit include a unit including at least a developing device that stored therein the toner and is capable of applying the toner to the electrostatic latent image in a contact or non-contact manner.

The developing unit preferably a developer that includes α-alumina having a hexagonal close-packed structure in an amount of 0.1% by mass or greater but 0.3% by mass or less.

Addition of α-alumina having a hexagonal close-packed structure to a developer affects shear force generated between the photoconductor and the elastic body. It is considered that, when the α-alumina having a hexagonal close-packed structure is supplied from the alumina developer to the surface of the photoconductor, the surface of the photoconductor is polished, or the α-alumina having a hexagonal close-packed structure remained in the contact area between the photoconductor and the elastic body to change the slidability of the elastic body.

In case of the α-alumina having a hexagonal close-packed structure, it has been experimentally proven that shear force increases or the self-excited vibration of the elastic body is increased or decreased depending on the amount of the α-alumina having a hexagonal close-packed structure.

<Transferring Step and Transferring Unit>

The transferring step is a step including transferring the toner image onto a recording medium, and is performed by the transferring unit.

For example, the transferring step is preferably an embodiment where an intermediate transfer member is used, and the transferring step includes a primary transferring step and a secondary transferring step, where the primary transferring step includes transferring the toner images to a surface of the intermediate transfer member to form a composite transfer image, and the secondary transferring step includes transferring the composite transfer image onto a recording medium.

The transferring unit is not particularly limited and may be appropriately selected depending on the intended purpose, as long as the transferring unit is a unit capable of transferring the toner image onto a recording medium. A preferable embodiment of the transferring unit is a transferring unit including a primary transferring unit and a secondary transferring unit, where the primary transferring unit is configured to transfer the toner images onto a surface of the intermediate transfer member to form a composite transfer image and the secondary transferring unit is configured to transfer the composite transfer image onto a recording medium.

<Fixing Step and Fixing Unit>

The fixing step is a step including fixing the toner image transferred onto the recording medium and is performed by the fixing unit. In the case where toners of two or more colors are used, fixing may be performed every time a toner of each color is transferred onto a recording medium, or fixing may be performed in a state where toners of all the colors are transferred and laminated on a recording medium.

The fixing unit is not particularly limited and may be appropriately selected depending on the intended purpose, as long as the fixing unit is a unit capable of fixing the toner image transferred onto the recording medium. As the fixing unit, a heat fixing system using a heat press unit known in the art may be employed.

<Other Steps and Other Units>

Examples of the above-mentioned other steps include a charge-eliminating step, a recycling step, and a controlling step.

The photoconductor of the present disclosure will be described in detail with reference to FIGS. 11 and 12 hereinafter.

Figure 11:
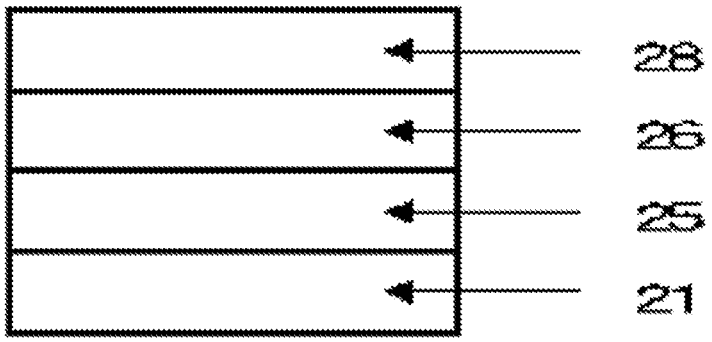
FIG. 11 is a cross-sectional view illustrating a layer structure of a photoconductor according to one embodiment of the present disclosure.

FIG. 11 is a cross-sectional view schematically illustrating one example of a photoconductor having a layer structure of the present disclosure. The layer structure is a structure where a charge-generating layer (25), a charge-transporting layer (26), and an underlying surface layer (28) are disposed on a conductive support (21).

Figure 12:
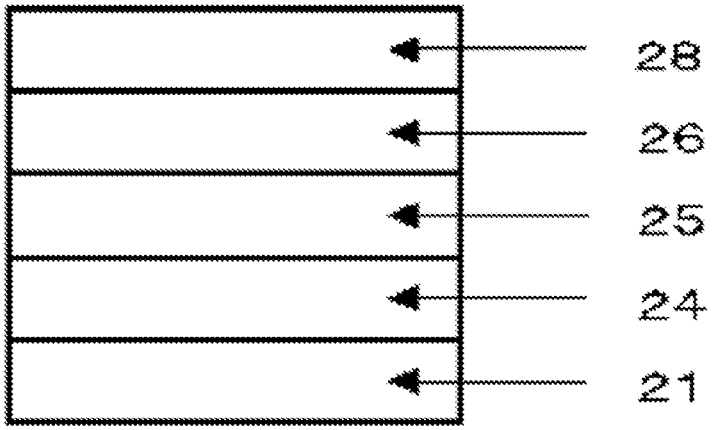
FIG. 12 is a cross-sectional view illustrating a layer structure of a photoconductor according to another embodiment of the present disclosure.

FIG. 12 is a cross-sectional view schematically illustrating one example of a photoconductor having another layer structure of the present disclosure. The layer structure is a structure where an undercoat layer (24) is disposed between a conductive support (21) and a charge-generating layer (25), and a charge-transporting layer (26) and an underlying surface layer (28) are disposed on the charge-generating layer (25).

—Conductive Support—

As a conductive support (21), a support exhibiting conductivity that is volume resistance of $10^{10}$ Ω·cm or less can be used. Examples thereof include: a film-shaped or cylindrical plastic or paper covered with a metal (e.g., aluminium, nickel, chromium, nichrome, copper, silver, gold, platinum, and iron) or oxide (e.g., tin oxide, and indium oxide) through vapor deposition or sputtering; a plate of aluminium, an aluminium alloy, nickel, or stainless steel; and a tube obtained by forming the above-listed plate into a tube by a method (e.g., drawing ironing, impact ironing, extruded ironing, extruded drawing, and cutting) and subjected to a surface treatment (e.g., cutting, super finishing, and polishing).

—Undercoat Layer (24)—

In the photoconductor for use in the present disclosure, an undercoat layer (24) can be disposed between a conductive support and a photoconductive layer (a layer where the charge-generating layer 25 and the charge-transporting layer 26 are laminated). The undercoat layer is disposed for the purpose of improving adhesion, preventing moire, improving coatability of an upper layer, and preventing charge injection from the conductive support.

The undercoat layer typically includes a resin as a main component. Since a photoconductive layer is generally applied onto the undercoat layer, a resin for use in the undercoat layer is preferably a thermosetting resin that is insoluble to an organic solvent. Polyurethane, a melamine resin, and an alkyd-melamine resin sufficiently satisfy the above-mentioned object and are particularly preferable materials. The resin is appropriately diluted with a solvent (e.g., tetrahydrofuran, cyclohexanone, dioxane, dichloroethane, and butanone) and a resultant solution may be used as a coating material.

Moreover, particles of metal or metal oxide may be added to the undercoat layer for the purpose of adjusting conductivity and preventing moire. As the particles of metal or metal oxide, titanium oxide is particularly preferably used.

The particles are dispersed in a solvent (e.g., tetrahydrofuran, cyclohexanone, dioxane, dichloroethane, and butanone) by means of a ball mill, an attritor, and a sand mill) and the dispersion liquid and a resin component are mixed to prepare a coating material.

The undercoat layer is formed by applying the above-mentioned coating film onto the conductive support by dip coating, spray coating, or bead coating. If necessary, the coated film is heated to cure to thereby form the undercoat layer.

A film thickness of the undercoat layer is often appropriately from about 2 μm to about 5 μm. When accumulation of residual potential of the photoconductor becomes large, the film thickness of the undercoat layer may be adjusted to less than 3 μm.

The photoconductive layer for use in the present disclosure is preferably a laminate photoconductive layer where a charge-generating layer and a charge-transporting layer are sequentially laminated. However, the photoconductive layer for use in the present disclosure may be a single layer photoconductive layer having both a charge-generating function and a charge-transporting function.

—Charge-Generating Layer (25)—

Among the layers of the laminate photoconductor, a charge-generating layer (25) will be described.

The charge-generating layer is part of the laminate photoconductive layer and has a function of generating charge through exposure (charge-generating function). The charge-generating layer includes, among compounds included therein, a charge-generating material as a main component. The charge-generating layer may include a binder resin according to the necessity. As the charge-generating material, an inorganic material or an organic material can be used.

Examples of the inorganic material include crystalline selenium, amorphous selenium, selenium-tellurium, selenium-tellurium-halogen, a selenium-arsenic compound, and amorphous silicon. As amorphous silicon, amorphous silicon whose dangling bond is terminated with a hydrogen atom or a halogen atom, or amorphous silicon-doped with a boron atom or a phosphorus atom is preferably used.

As the organic charge-generating material, any of materials known in the art can be used. Examples of the organic charge-generating material include metal phthalocyanine (e.g., titanyl phthalocyanine and chlorogallium phthalocyanine), non-metal phthalocyanine, an azlenium salt pigment, a squaric acid methine pigment, a symmetric or asymmetric azo pigment having a carbazole skeleton, a symmetric or asymmetric azo pigment having a triphenylamine skeleton, a symmetric or asymmetric azo pigment having a fluorenone skeleton, and a perylene-based pigment. Among the above-listed examples, metal phthalocyanine, a symmetric or asymmetric azo pigment having a fluorenone skeleton, a symmetric or asymmetric azo pigment having a triphenylamine skeleton, and a perylene-based pigment are preferable because all of the above-mentioned materials have high quantum efficiency of charge generation. The above-listed charge-generating materials may be used alone or in combination.

Examples of a binder resin optionally used for the charge-generating layer include polyamide, polyurethane, an epoxy resin, polyketone, polycarbonate, polyarylate, a silicone resin, an acrylic resin, polyvinyl butyral, polyvinyl formal, polyvinyl ketone, polystyrene, poly-N-vinylcarbazole, and polyacrylamide. Moreover, a below-mentioned polymer charge-transporting material can be also used. Among above-listed examples, polyvinyl butyral is often used and is effective. The above-listed binder resins may be used alone or in combination.

A method for forming the charge-generating layer is roughly classified into a vacuum film forming method and a casting method using a solution dispersion system.

As the vacuum film forming method, there are a vacuum vapor deposition method, a glow discharge decomposition method, an ion plating method, a sputtering method, a reactive sputtering method, and a chemical vapor deposition (CVD) method. By the above-listed methods, a layer formed of any of the above-listed inorganic materials and organic materials can be formed excellently.

In order to dispose a charge-generating layer using the casting method, moreover, the above-mentioned inorganic or organic charge-generating material is dispersed, optionally together with a binder resin, in a solvent, such as tetrahydrofuran, cyclohexanone, dioxane, dichloroethane, and butanone, by means of a ball mill, an attritor, or a sand mill to obtain a dispersion liquid, and the dispersion liquid is appropriately diluted and applied. Among the above-mentioned solvents, methyl ethyl ketone, tetrahydrofuran, and cyclohexanone are preferable because these solvents have a lower degree of environmental load compared with chlorobenzene, dichloromethane, toluene, and xylene. The application of the dispersion liquid can be performed by dip coating, spray coating, or bead coating.

A film thickness of the charge-generating layer disposed in the above-described manner is typically preferably from 0.01 μm through 5 μm.

In the case where reduction of residual potential or increase in sensitivity is desired, the above-mentioned properties are often improved by increasing a film thickness of the charge-generating layer. On the other hand, the increased thickness of the charge-generating layer tends to cause deteriorations in charging properties, such as retention of charge or formation of space charge. In view of a balance between the above-mentioned advantages and disadvantages, an average thickness of the charge-generating layer is more preferably from 0.05 μm through 2 μm.

Moreover, a low molecular weight compound (e.g., an antioxidant, a plasticizer, a lubricant, and a UV absorber) and a leveling agent may be optionally added to the charge-generating layer. The above-listed compounds may be used alone or in combination. Use of the low molecular weight compound and the leveling agent in combination often causes deterioration in sensitivity. Therefore, an amount of the low molecular weight compound and the leveling agent for use is generally preferably from 0.1 phr through 20 phr, and more preferably from 0.1 phr through 10 phr. An amount of the leveling agent for use is preferably from 0.001 phr through 0.1 phr.

—Charge-Transporting Layer (26)—

The charge-transporting layer is part of a laminate photoconductive layer and has a function of injecting and transporting charge generated in the charge-generating layer to neutralize the charge of a surface of the photoconductor generated by the charging. Main components of the charge-transporting layer are a charge-transporting component and a binder component configured to bind the charge-transporting component.

Examples of a material used as the charge-transporting material include a low molecular weight electron-transporting material, a hole-transporting material, and a polymeric charge-transporting material.

Examples of the electron-transporting material include an electron-accepting material, such as an asymmetric diphenoquinone derivative, a fluorene derivative, and a naphthalimide derivative. The above-listed electron-transporting materials may be used alone or in combination.

As the hole-transporting material, an electron-donating material is preferably used. Examples of the hole-transporting material include an oxazole derivative, an oxadiazole derivative, an imidazole derivative, a triphenylamine derivative, a butadiene derivative, 9-(p-diethylaminostyrylanthracene), 1,1-bis-(4-dibenzylaminophenyl)prop ane, styrylanthracene, styrylpyrazoline, phenylhydrazones, an α-phenylstilbene derivative, a thiazole derivative, a triazole derivative, a phenazine derivative, an acridine derivative, a benzofuran derivative, a benzimidazole derivative, and a thiophene derivative. The above-listed hole-transporting materials may be used alone or in combination.

Moreover, the polymeric charge-transporting material presented below can be used. Examples thereof include a polymer including a carbazole ring (e.g., poly-N-vinylcarbazole), a polymer having a hydrazone, a polysilylene polymer, and aromatic polycarbonate. The above-listed charge-transporting materials may be used alone or in combination.

The polymeric charge-transporting material is a material suitable for preventing a curing failure of an underlying surface layer because components constituting the polymeric charge-transporting material bleed out less on the underlying surface layer, compared with a low molecular weight charge-transporting material, when the underlying surface layer is disposed. As a molecular weight of the charge-transporting material increases, heat resistance improves more. Therefore, deteriorations due to curing heat at the time of film formation of the underlying surface layer unlikely to occur and thus use of the polymeric charge-transporting material is advantageous.

Examples of a polymer compound that can be used as the binder component of the charge-transporting layer include thermoplastic or thermosetting resins, such as polystyrene, polyester, polyvinyl, polyarylate, polycarbonate, an acrylic resin, a silicone resin, a fluororesin, an epoxy resin, a melamine resin, a urethane resin, a phenol resin, and an alkyd resin. Among the above-listed examples, polystyrene, polyester, polyarylate, and polycarbonate are effective because most of the above-listed compounds exhibit excellent charge-transporting properties when the above-listed compounds are used as the binder component of the charge-transporting component.

Since an underlying surface layer is disposed on the charge-transporting layer, moreover, the charge-transporting layer does not need to provide mechanical strength, unlike a charge-transporting layer known in the art. Therefore, a material relatively low mechanical strength but high transparency, such as polystyrene, which is determined as inapplicable in the related art, can be effectively used as a binder component of the charge-transporting layer.

The above-listed polymer compounds may be used alone or in combination, or as a copolymer formed of two or more starting material monomers thereof, or as a copolymer with a charge-transporting material.

When an electrically inert polymer compound is used for improving the charge-transporting layer, cardo polymer-type polyester having a bulky skeleton, such as fluorene, polyester, such as polyethylene terephthalate and polyethylene naphthalate, polycarbonate, in which 3,3' site of a phenol component of bisphenol polycarbonate, such as C-type polycarbonate, is substituted with an alkyl group, polycarbonate, in which a germinal methyl group of bisphenol A is substituted with a long-chain alkyl group having 2 or more carbon atoms, polycarbonate having a biphenyl or biphenyl ether skeleton, polycaprolactone, polycarbonate including a long-chain alkyl skeleton, such as polycaprolactone, an acrylic resin, polystyrene, or hydrogenated butadiene is effective.

The electrically inert polymer compound means a polymer compound free from chemical structure exhibiting photoconductivity, such as a triaryl amine structure. When the electrically inert polymer compound is used as an additive in combination with a binder resin, an amount thereof is preferably 50% by mass or less relative to a total solid content of the charge-transporting layer in view of limitation of light attenuation sensitivity.

When the low molecular weight charge-transporting material is used, an amount thereof is from about 40 phr through about 200 phr, and preferably from about 70 phr through about 100 phr. When the polymeric charge-transporting material is used, moreover, a material where from about 0 parts through about 200 parts, preferably from about 80 parts through about 150 parts of the resin component is copolymerized with 100 parts of the charge-transporting component is preferably used.

Examples of the dispersing solvent that can be used for preparing the charge-transporting layer coating material include: ketones, such as methyl ethyl ketone, acetone, methyl isobutyl ketone, and cyclohexanone; ethers, such as dioxane, tetrahydrofuran, and ethylcellosolve; aromatics, such as toluene and xylene; halogens, such as chlorobenzene, and dichloromethane; and esters, such as ethyl acetate, and butyl acetate. Among the above-listed examples, methyl ethyl ketone, tetrahydrofuran, and cyclohexanone are preferable because methyl ethyl ketone, tetrahydrofuran, and cyclohexanone have the lower degree of environmental load compared with chlorobenzene, dichloromethane, toluene, and xylene. The above-listed solvents may be used alone or in combination.

The charge-transporting layer can be formed by dissolving or dispersing, in an appropriate solvent, a mixture or copolymer including a charge-transporting component and a binder component as main components to prepare a charge-transporting layer coating material, and applying and drying the coating material. As the application method, dipping, spray coating, ring coating, a roll coater method, gravure coating, nozzle coating, or screen coating is applied.

Since the underlying surface layer is disposed above the charge-transporting layer, a film thickness of the charge-transporting layer in such a structure does not need to be made thick considering potential film abrasion on practical use. In order to secure necessary sensitivity and charging ability on practice, the average thickness of the charge-transporting layer is preferably from 10 μm through 40 μm, and more preferably from 15 μm through 30 μm.

Moreover, a low molecular weight compound (e.g., an antioxidant, a plasticizer, a lubricant, and an UV absorber) and a leveling agent may be optionally added to the charge-transporting layer. The above-listed compounds may be used alone or in combination. Use of the low molecular weight compound and the leveling agent in combination often cause deterioration in sensitivity. Therefore, an amount of the low molecular weight compound and the leveling agent for use is generally from 0.1 phr through 20 phr and more preferably from 0.1 phr through 10 phr. An amount of the leveling agent for use is preferably from 0.001 phr through 0.1 phr.

—Underlying Surface Layer (28)—

The underlying surface layer is a protective layer formed on a surface of the photoconductor. The protective layer is formed by after applying a coating material including a resin (monomer) component, performing a polycondensation reaction or addition polymerization reaction to form a film of a resin having a crosslinked structure. Since the resin film has a crosslinked structure, the protective layer has the most excellent abrasion resistance among all layers of the photoconductor. Since the underlying surface layer includes a crosslinkable charge-transporting structure unit, moreover, the underlying surface layer has similar charge-transporting properties to those of the charge-transporting layer.

[Roughening Surface of Photoconductor]

The arithmetic mean surface roughness WRa(LML) of the underlying surface layer in the LML band is preferably 0.02 μm or greater. Therefore, special roughening needs to be performed on a surface of the photoconductor. As a specific method thereof, a method where filler is added to a coating material of the underlying surface layer and difference in aggregation state of the filler is utilized is particularly effective because a degree of freedom for controlling a surface profile is high.

The aggregation state of the filler significantly varies depending on a deference with a functional group, branched amount, molecular weight, and molecular skeleton of the dispersing agent used in combination. Moreover, the aggregation state of the filler also varies depending on an amount of the dispersing agent or dispersion duration. Therefore, the shape control can be performed by adjusting the conditions considering a balance between the properties as mentioned and a surface profile to be obtained.

Moreover, it is also effective as a method for controlling a surface profile that, after forming a cured film, a dilute solution including filler and a small amount of a binder component is applied again and cured. In the present disclosure, such a dilute solution may be referred to as a filler liquid.

The crosslinked resin surface layer is formed by curing a binder component, which is a trifunctional or higher radical polymerizable monomer that does not have a charge-transporting structure. The crosslinked resin film is preferable because a balance between sensitivity of the photoconductor and durability of the photoconductor is excellent and the above-descried recycling is easily performed.

The trifunctional or higher binder component is preferably caprolactone-modified dipentaerythritol hexaacrylate or dipentaerythritol hexaacrylate. Use of the trifunctional or higher binder component often improves abrasion resistance of the crosslinked film itself or increases toughness.

The trifunctional or higher radical polymerizable monomer that does not have a charge-transporting structure is preferably trimethylolpropane triacrylate, caprolactone-modified dipentaerythritol hexaacrylate, or dipentaerythritol hexaacrylate.

The above-listed trifunctional or higher radical polymerizable monomers may be obtained from reagent manufacturers, such as Tokyo Chemical Industry Co., Ltd. For example, KAYARDDPCA series and DPHA series available from Nippon Kayaku Co., Ltd. may be obtained.

In order to accelerate or stabilize curing, moreover, an initiator, such as IRGACURE 184 available from Chiba Specialty Chemicals may be added in an approximate amount of from about 5% by mass through about 10% by mass.

Examples of the crosslinkable charge-transporting material include a chain-polymerizable compound having an acryloyloxy group or a styrene group, and a sequential-polymerizable compound having a hydroxyl group, an alkoxysilyl group, or an isocyanate group. As the crosslinkable charge-transporting material, a compound including a charge-transporting structure and including at least one (meth)acryloyloxy group can be used. Moreover, the crosslinkable charge-transporting material may have a composition where a monomer or oligomer that does not include a charge-transporting structure and includes at least one (meth)acryloyloxy group is used in combination. At least the compound including a charge-transporting structure and including at least one (meth)acryloyloxy group is added to coating material to form a surface layer, and energy, such as heat, light, and radiation (e.g., electron beams, and y rays), is applied to crosslink and cure the surface layer, to thereby form an underlying surface layer. Examples of the crosslinkable charge-transporting material include a charge-transporting compound represented by General Formula 1 below.

General Formula 1

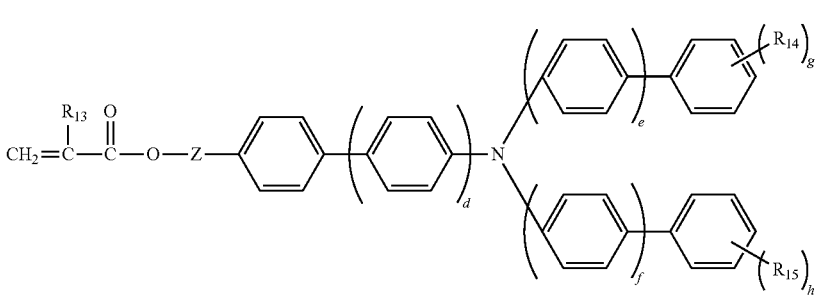

In General Formula 1, d, e, and f are each an integer of 0 or 1; g and h are each an integer of from 0 through 3; R13 is a hydrogen atom or a methyl group; R14 and R15 are each an alkyl group having from 1 through 6 carbon atoms where R14 and R15 may be identical or different; and Z is a single bond, a methylene group, and an ethylene group, or a divalent group represented by Formulae (2) to (4) below.

Formula (2)

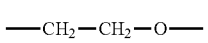

Formula (3)

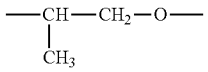

Formula (4)

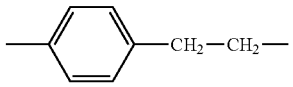

Examples of specific compounds includes compounds represented by Structural Formula Nos. 1 to 26 below.

No. 1
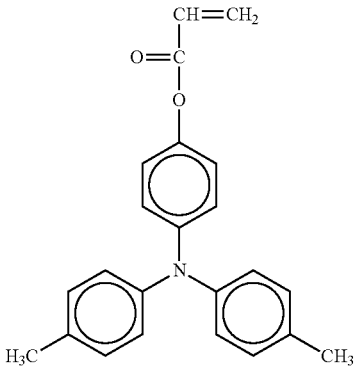
No. 2
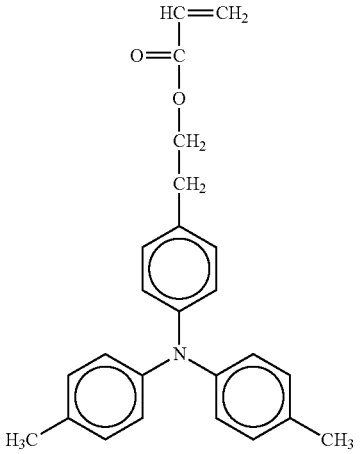
No. 3
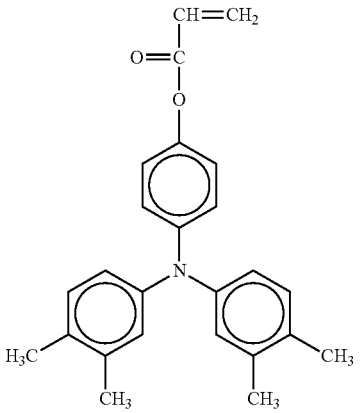
-continued
No. 4
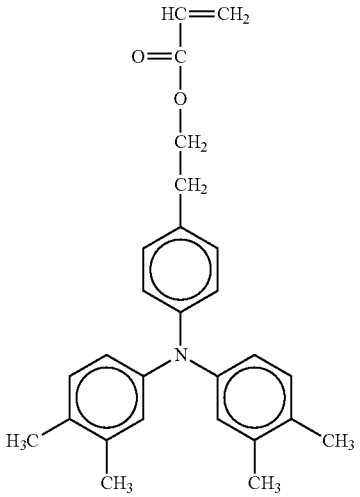
No. 5
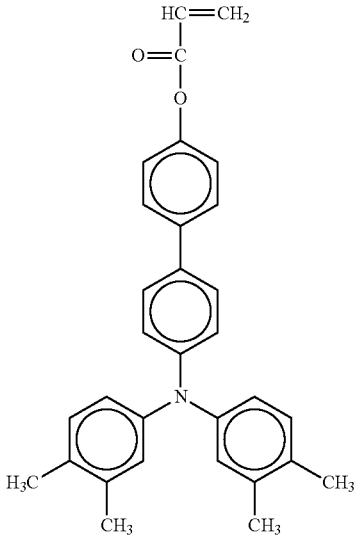
No. 6
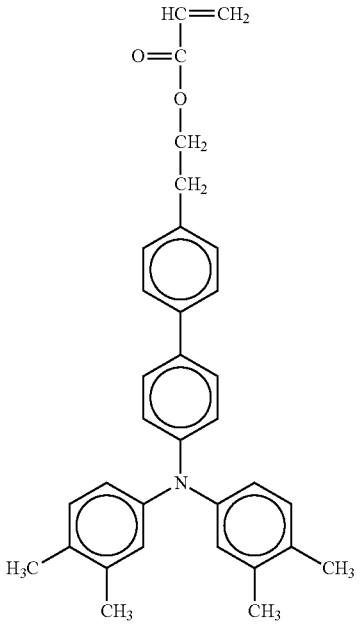

-continued
No. 7
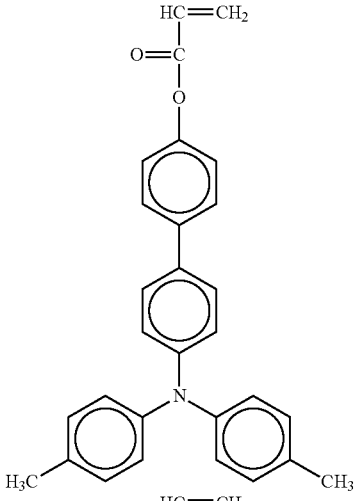
No. 8
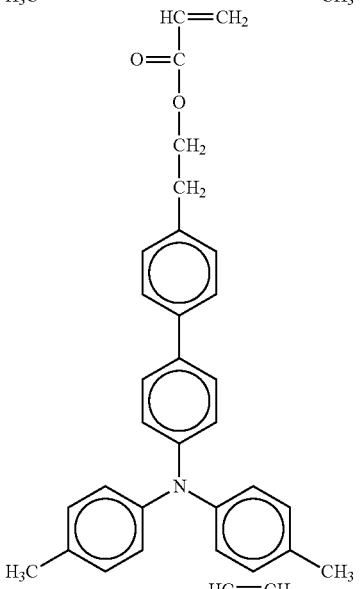
No. 9
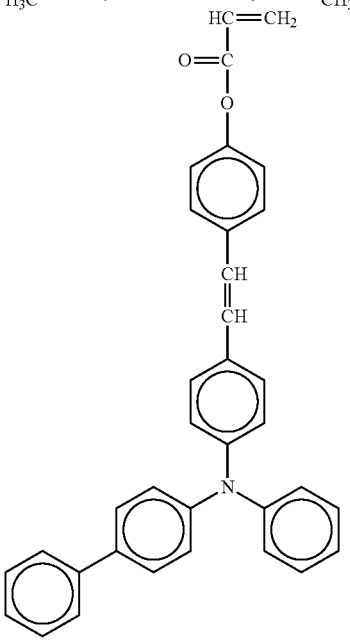
-continued
No. 10
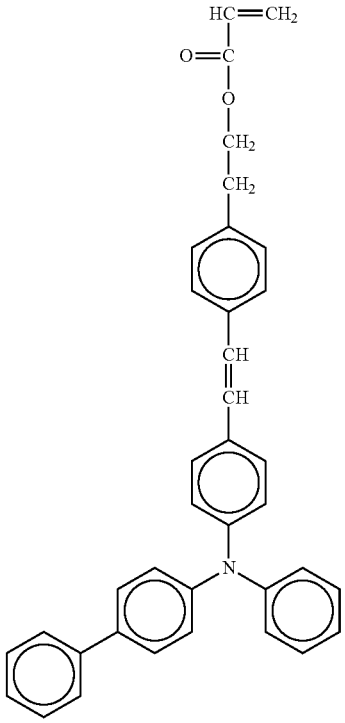
No. 11
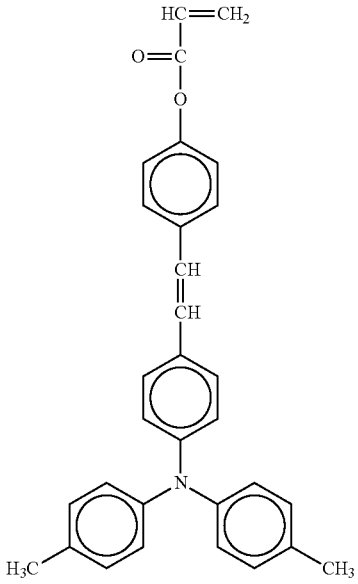

No. 12
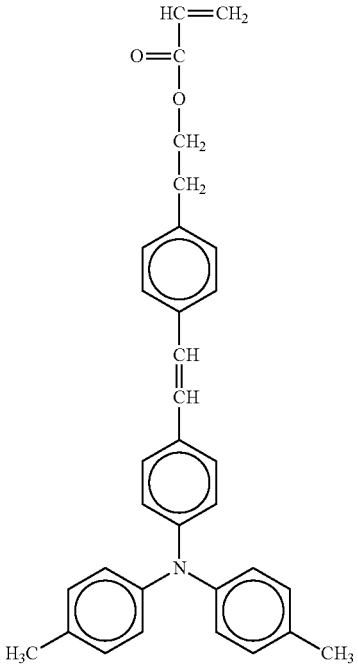
No. 13
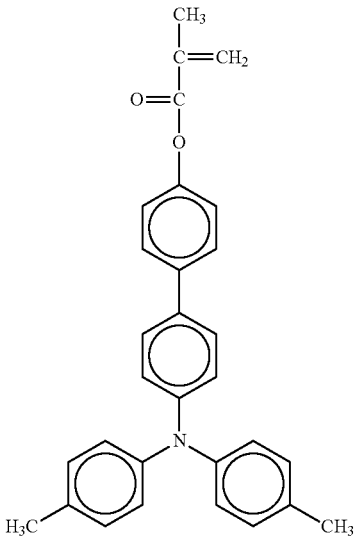
No. 14
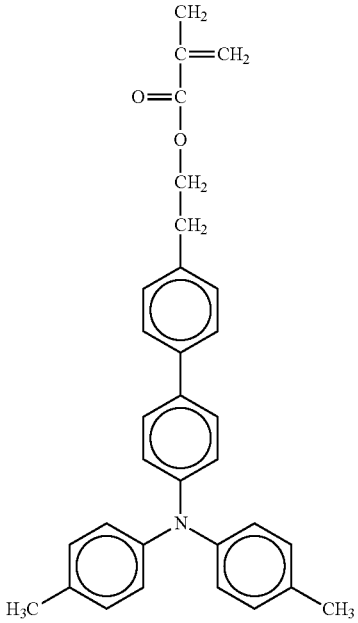
No. 15
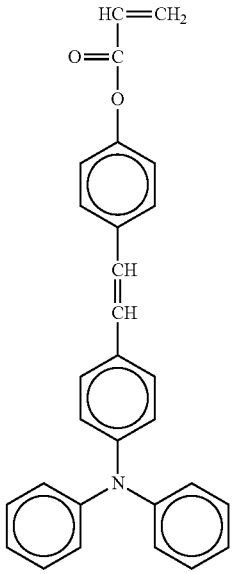

No. 16
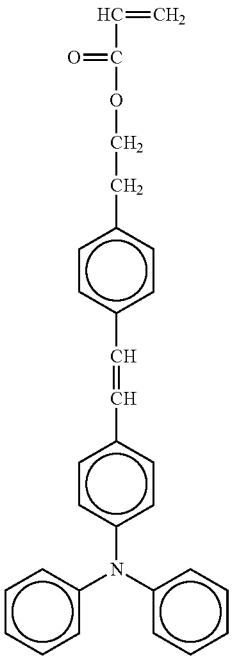
No. 17
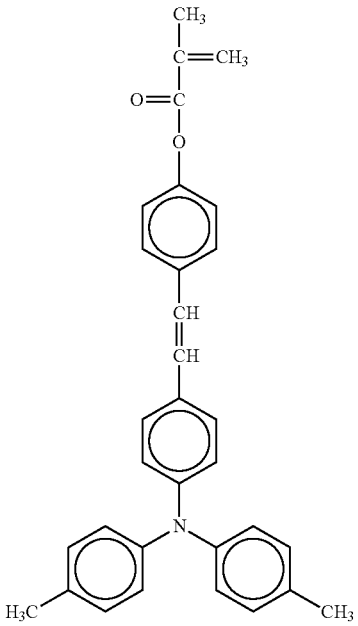
No. 18
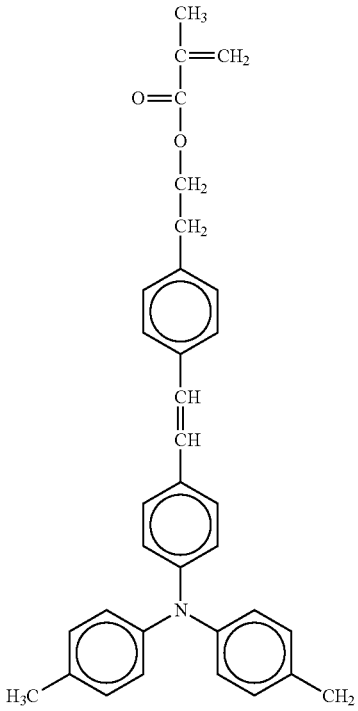
No. 19
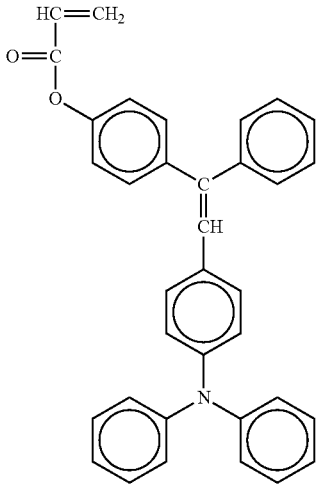

-continued
No. 20
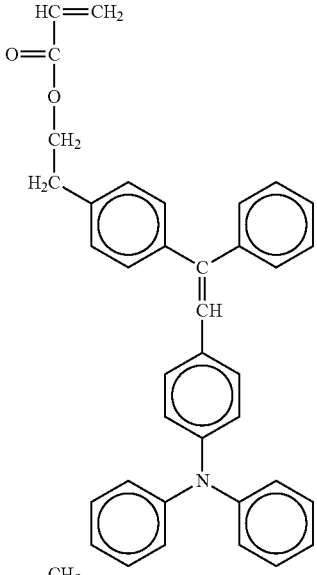
No. 21
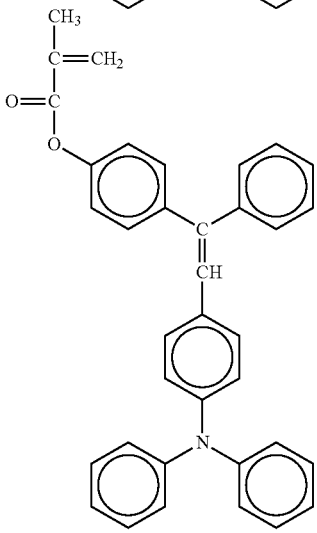
No. 22
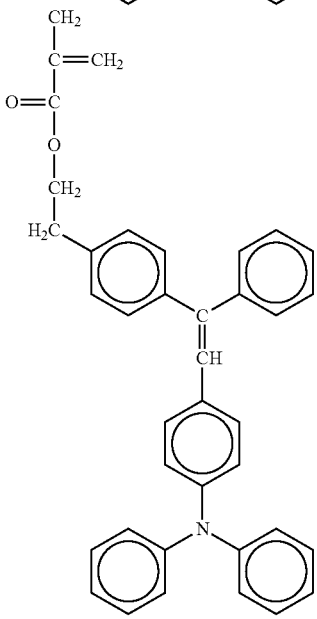
-continued
No. 23
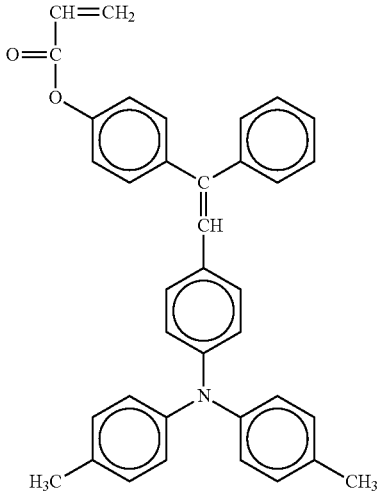
No. 24
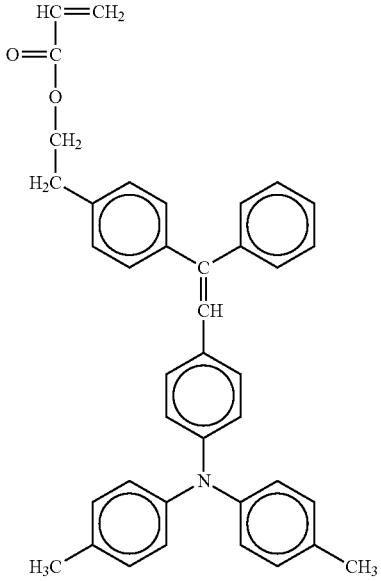
No. 25
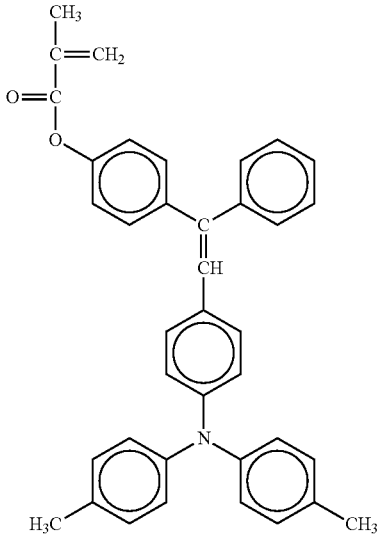

-continued

No. 26

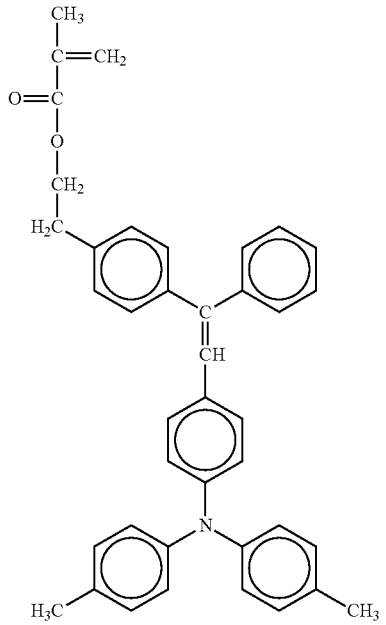

In order to enhance abrasion resistance of the underlying surface layer, filler having high hardness may be included. Examples of the typical filler include silica, alumina, and ceria. Particularly, α-alumina having a hexagonal close-packed structure obtained by gas-phase polymerization is preferable because cost thereof is low and high surface hardness can be imparted. The above-mentioned filler has approximately spherical and does not form spikes on a surface of the photoconductor, and therefore a damage applied to a member slides with the photoconductor can be reduced. An amount of the filler is appropriately from 1% by mass through 30% by mass relative to a total solid mass of the underlying surface layer.

When the filler is included, potential of an exposure area may be increased. On the other hand, blending tin oxide is effective because an increase in the potential of the exposure area can be suppressed. The hardness of tin oxide is small compared with the α-alumina. Therefore, mechanical strength reduces as the above-described filler is replaced with the tin oxide. A blending ratio of the tin oxide is effectively from 5% by mass through 50% by mass relative to a total mass of the filler mixture in view of both mechanical strength and potential of the exposure area. In addition, addition of organic acid, such as citric acid and maleic acid, is effective for reducing the potential of the exposure area.

The dispersing solvent for use in preparation of the underlying surface layer coating material is preferably a solvent that can sufficiently dissolve a monomer. Examples of the dispersing solvent include, in addition to the above-listed ethers, aromatics, halogens, and esters, cellosolves (e.g., ethoxyethanol), and propylene glycols (e.g., 1-methoxy-2-propanol). Among the above-mentioned solvents, methyl ethyl ketone, tetrahydrofuran, cyclohexanone, and 1-methoxy-2-propanol are preferable because these solvents have a lower degree of environmental load compared with chlorobenzene, dichloromethane, toluene, and xylene. The above-listed solvents are used alone or in combination.

Examples of a coating method of the underlying surface layer coating include dip coating, spray coating, ring coating, roll coating, gravure coating, nozzle coating, and screen printing. Most of cases, a pot life of a coating material is not long. Therefore, a method that can coat a necessary area with a small amount of a coating material is advantageous in view of consideration for the environment and cost. Among the above-listed methods, spray coating and ring coating are preferable. Moreover, an inkjet system may be used for applying special shapes according to the present disclosure.

When a film of the underlying surface layer is formed, a UV irradiation light source, such as a high pressure mercury lamp or metal halide lamp having emission wavelengths mainly in UV light. Moreover, a visible light source may be selected depending on absorption wavelengths of a radical polymerizable component or a photopolymerizable initiator. The irradiation light dose is preferably 50 mW/cm$^2$ or greater but 1,000 mW/cm$^2$ or less. When the irradiation light dose is less than 50 mW/cm$^2$, a long time is required for performing a curing reaction. When the irradiation light dose is greater than 1,000 mW/cm$^2$, the progress of the reaction becomes uneven, and therefore, a surface of the crosslinked charge-transporting layer may be locally creased or the large number of unreacted residues or reaction termination terminal groups may be remained. Moreover, internal stress increases due to drastic crosslinking, leading to cracking or peeling of the film.

Moreover, a low molecular weight compound (e.g., an antioxidant, a plasticizer, a lubricant, and a UV absorber) and a leveling agent well known in the art, and the polymer compounds described in the section of the charge-transporting layer may be optionally added to the underlying surface layer. The above-listed compounds may be used alone or as a mixture. Use of the low molecular weight compound and the leveling agent in combination often causes deterioration in sensitivity. Therefore, an amount of the low molecular weight compound and the leveling agent for use is preferably from 0.1% by mass through 20% by mass, and more preferably from 0.1% by mass through 10% by mass relative to a total solid content of the coating material. An amount of the leveling agent for use is preferably from 0.1% by mass through 5% by mass.

A film thickness of the underlying surface layer is preferably from 3 μm through 15 μm. The lower limit is a value calculated considering a degree of an effect against the cost of film formation. The upper limit is set in view of electrostatic properties (e.g., charging stability and light attenuation sensitivity) and uniformity of a film quality.

(Embodiment of Image Forming Apparatus)

The image forming apparatus used in the present disclosure will be described with reference to drawings hereinafter. In the image forming apparatus of the present disclosure, a unit configured to supply the below-mentioned circulation material to a surface of a photoconductor is disposed. For simplicity, the unit will be described separately after the descriptions of the image forming apparatus.

Figure 13:
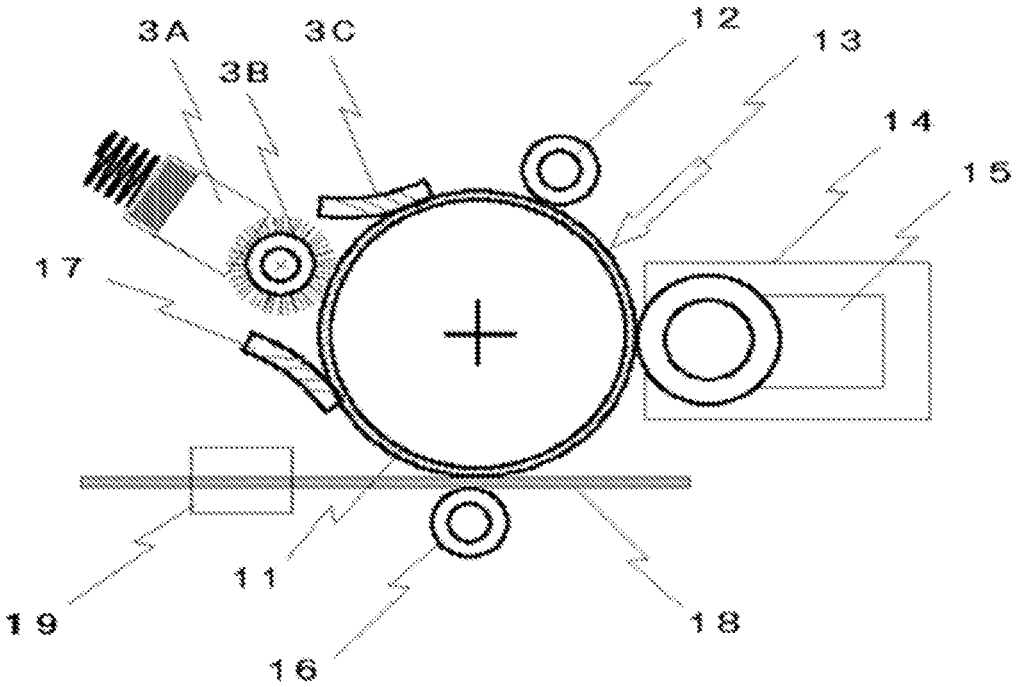
FIG. 13 is a schematic cross-sectional view of an image forming apparatus according to one embodiment of the present disclosure.

FIG. 13 is a schematic view for describing the image forming apparatus of the present disclosure, and a modified examples thereof described below is also included in the scope of the present disclosure.

In FIG. 13, a photoconductor (11) is a photoconductor where an underlying surface layer is laminated. Although the photoconductor (11) has a drum shape, but the photoconductor may be sheet shaped, or an endless belt.

A charging device (12) is a unit configured to uniformly charge a surface of the photoconductor (11). As the charging device, any of units known in the art, such as corotron, scorotron, a solid charger (solid state charger), and a charging roller, can be used. In view of reduction in energy consumption, the charging device is preferably disposed in contact with or near the photoconductor. Among them, desired is a charging system where an appropriate gap is provided between the photoconductor and a surface of the charging device and the charging device is disposed bear the photoconductor for the purpose of preventing pollution to the charging device. As a transferring device (16), the above-mentioned charger is typically used. As the transferring device, a transferring device where a transfer charger and a separation charger are used in combination is effective.

Examples of a light source used in an exposing device (13) or a charge-eliminating device (1A) described in another embodiment include general light emitters, such as a fluorescent lamp, a tungsten lamp, a halogen lamp, a mercury lamp, a sodium-vapor lamp, a light emitting diode (LED), a semiconductor laser diode (LD), and electroluminescence (EL). In order to irradiate with only light in a desired wavelength range, moreover, various filters can be used, where the various filters include a sharp cut filter, a band pass filter, a near-infrared cut filter, a dichroic filter, an interference filter, and a color conversion filter.

A toner (15) deposited on the photoconductor through developing performed by a developing device (14) is transferred to a print medium (18), such as a printing sheet and a slide for OHP. However, all of the toner may not be transferred and some of the toner may remain on the photoconductor. Such the residual toner is removed from the photoconductor by a cleaning device (17). As the cleaning device, an elastic body in the form of a blade formed of rubber, or a brush, such as a fur brush and a magfur brush, can be used.

When positive (negative) charge is applied to the photoconductor by the charging device (12) and image exposure is performed by the exposing device (13), a positive (negative) electrostatic latent image is performed on a surface of the photoconductor. When the electrostatic latent image is developed with a toner (electroscopic particles) having negative (positive) polarity by the developing device (14), a positive image is obtained. When the electrostatic latent image is developed with a toner (electroscopic particles) having positive (negative) polarity, a negative image is obtained. A method known in the art can be applied for the developing device. Moreover, a method known in the art can be applied for the charge-eliminating device. The developed toner image deposited on the print medium (18) is transported from a counter position between the photoconductor (11) and the transferring device (16) to the fixing device (19). The toner image is fixed on the print medium (18) by the fixing device (18).

A circulation material (3A) and a coating blade (3C) configured to apply the circulation material are disposed between the cleaning device (17) and the charging device (12) relative to the moving direction of the photoconductor.

Specifically, the circulation material (3A) and the coating blade (3C) are disposed downstream of the cleaning device (17) and upstream of the charging device (12) relative to the moving direction of the photoconductor (11). The positional relationship of the circulation material, the coating blade is identical in another embodiment.

Figure 14:
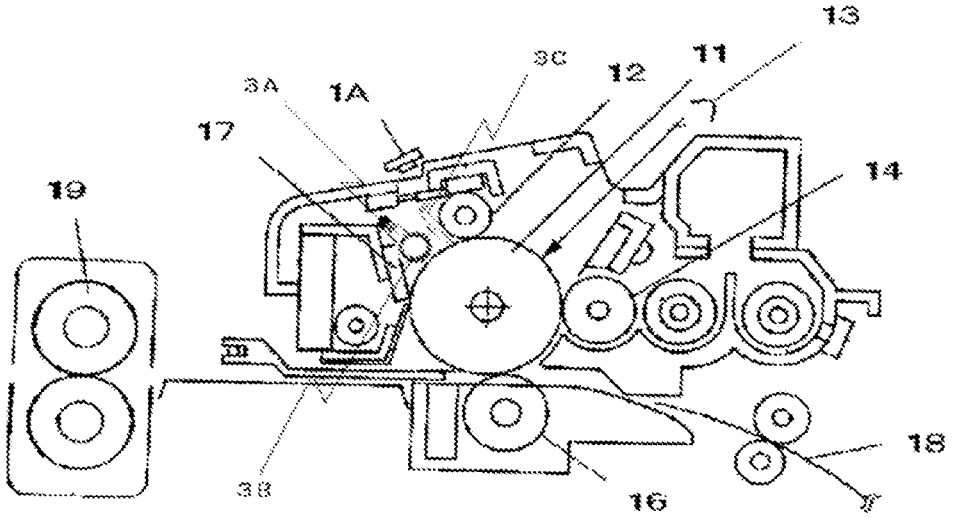
FIG. 14 is a schematic cross-sectional view of an image forming apparatus according to another embodiment of the present disclosure.

Moreover, the above-described image forming unit may be fixed and mounted in a copier, facsimile, or printer, or the image forming unit may be mounted therein as a process cartridge. There are various examples of a shape of the process cartridge. A typical example thereof include a process cartridge illustrated in FIG. 14. The photoconductor (11) has a drum shape, but the photoconductor may be sheet shaped, or an endless belt.

Figure 15:
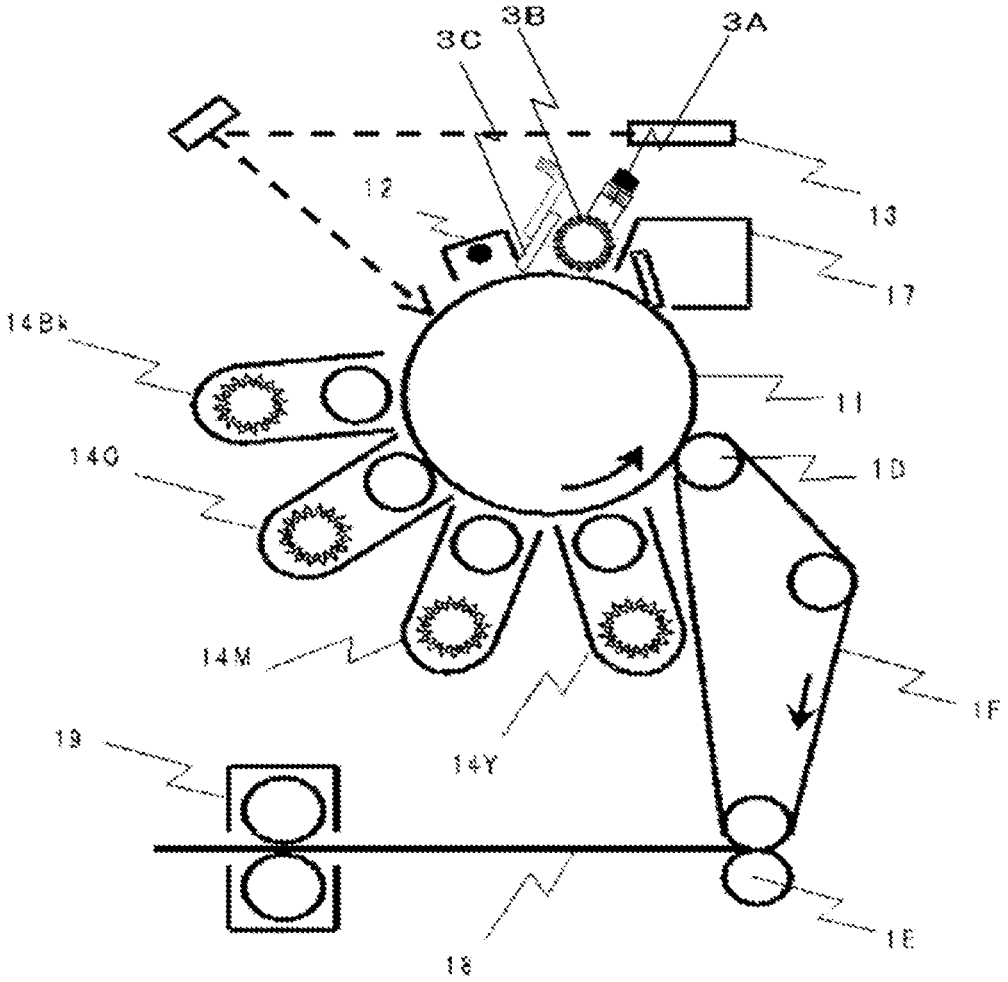
FIG. 15 is a schematic cross-sectional view of an image forming apparatus according to yet another embodiment of the present disclosure.

Another example of the image forming apparatus of the present disclosure is illustrated in FIG. 15.

In the image forming apparatus, a charging device (12), an exposing device (13), developing devices (14Bk, 14C, 14M, and 14Y) for black (Bk), cyan(C), magenta (M), and yellow (Y), an intermediate transfer belt (1F) that is an intermediate transfer member, and a cleaning device (17) are disposed in this order around a photoconductor (11). The subscripts (Bk, C, M, and Y) in FIG. 15 correspond to colors of the toner. The subscripts are optionally added or appropriately omitted. The photoconductor (11) is a photoconductor where an underlying surface layer is laminated. The developing device (14Bk, 14C, 14M, or 14Y) of each color can be controlled independently, and only the developing device of the color with which image formation is performed is driven. A toner image formed on the photoconductor (11) is transferred onto the intermediate transfer belt (1F) by a first transferring device (1D) disposed on the inner side of the intermediate transfer belt (1F). The first transferring device (1D) is disposed in a manner that the first transferring device can be in contact with and detached from the photoconductor (11). The intermediate transfer belt (1F) is brought into contact with the photoconductor (11) only during a transfer operation. Image formation of the above-mentioned colors is sequentially performed, and the toner images superimposed on the intermediate transfer belt (1F) are collectively transferred onto a print medium (18) by a second transferring device (1E), followed by fixing the transferred composite toner image on the print medium by the fixing device (19), to thereby form an image. The second transferring device (1E) is also disposed in a manner that the second transferring device can be in contact with or detached from the intermediate transfer belt (1F). The second transferring device is brought into contact with the intermediate transfer belt (1F) only during a transfer operation.

An image forming apparatus of a transfer drum system has a restriction in selection of print media because toner images of all colors are sequentially transferred onto a print medium electrostatically adsorbed on the transfer drum and therefore printing cannot be performed on thick paper. On the other hand, the image forming apparatus of an intermediate transfer system, as illustrated in FIG. 15, does not have a restriction in selection of print media because toner images of all colors are superimposed on the intermediate transfer member (1F). The above-described intermediate transfer system can be applied for the image forming apparatuses illustrated in FIGS. 13 and 14 described above and the image forming apparatus illustrated in FIG. 16 (specific examples thereof is illustrated in FIG. 17) described later, as well as the image forming apparatus illustrated in FIG. 15.

A circulation material (3A) and a coating blade (3C) configured to apply the circulation material are disposed between the cleaning device (11) and the charging device (12) relative to the moving direction of the photoconductor.

Figure 16:
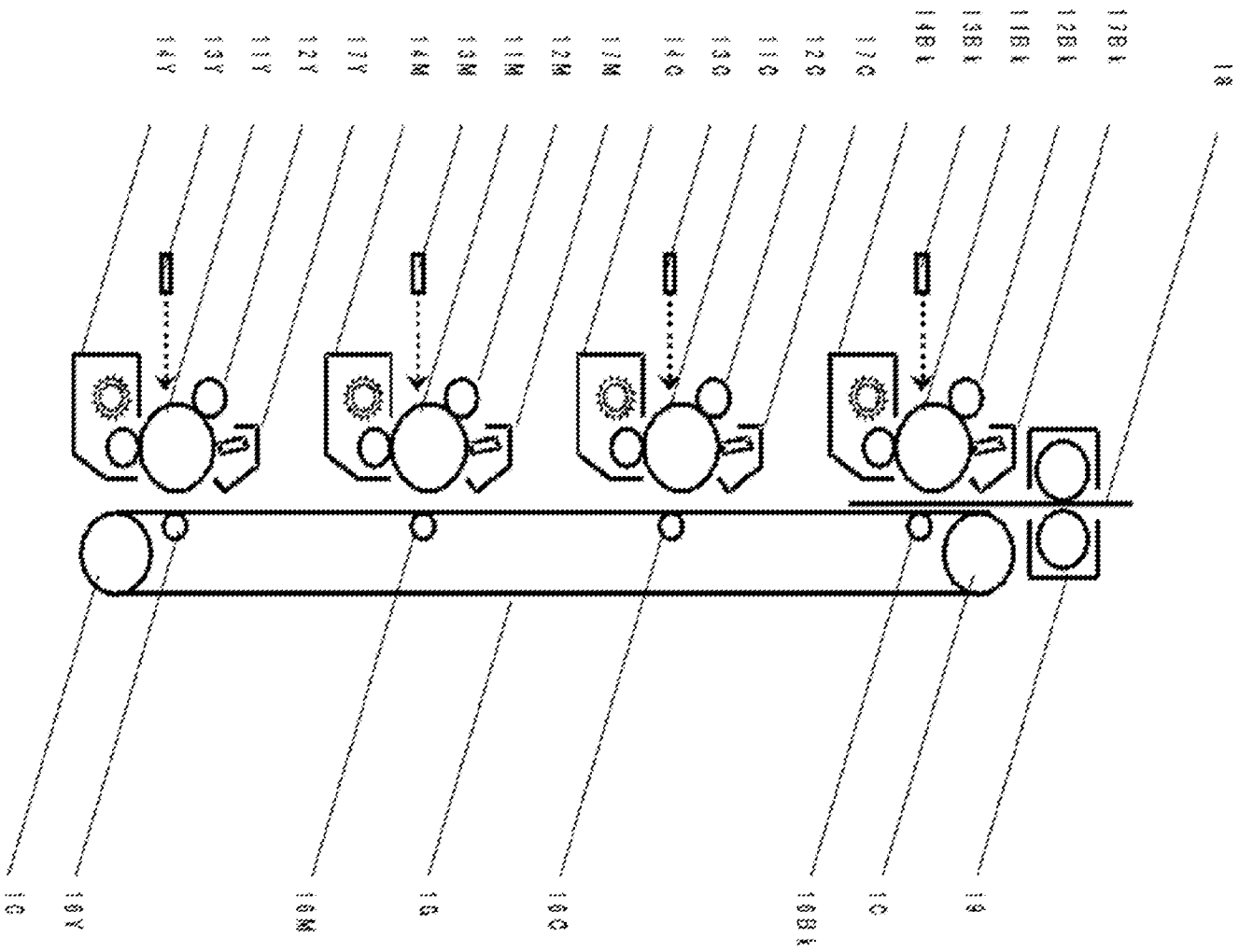
FIG. 16 is a schematic cross-sectional view of an image forming apparatus according to yet another embodiment of the present disclosure.
Figure 17:
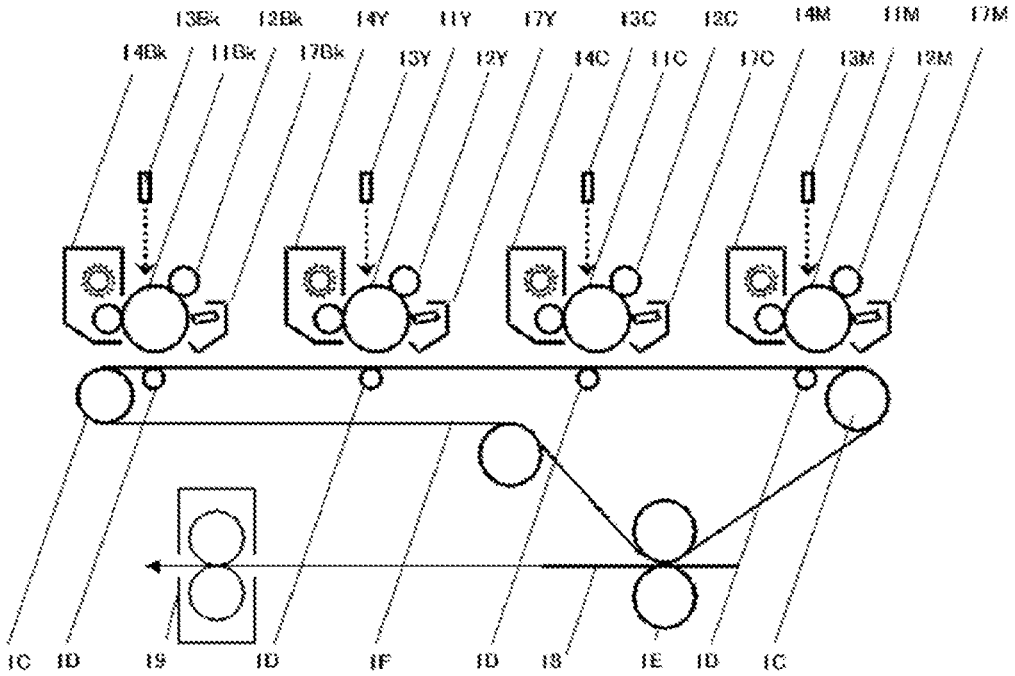
FIG. 17 is a schematic cross-sectional view of an image forming apparatus according to yet another embodiment of the present disclosure.

Another example of the image forming apparatus of the present disclosure is illustrated in FIG. 16.

The image forming apparatus uses 4 colors, yellow (Y), magenta (M), cyan (C), and black (Bk) as the toner, and an image forming unit is disposed for each color. Moreover, a photoconductor (11Y, 11M, 11C, or 11Bk) is disposed for each color. The photoconductor 11 used in the image forming apparatus is a photoconductor where an underlying surface layer is laminated. A charging device (12Y, 12M, 12C, or 12Bk), an exposing device (13Y, 13M, 13C, or 13Bk), a developing device (14Y, 14M, 14C, or 14Bk), and a cleaning device (17Y, 17M, 17C, or 17Bk) are disposed around each photoconductor (11Y, 11M, 11C, or 11Bk).

Moreover, a conveying transfer belt (1G) is disposed and supported by a driving unit (1C) as a transfer material bearer that is in contact with and detached from transfer positions of the photoconductors (11Y, 11M, 11C, and 11Bk) linearly disposed. Transferring devices (16Y, 16M, 16C, and 16Bk) are disposed at the transfer positions facing the photoconductors (11Y, 11M, 11C, and 11Bk) via the conveying transfer belt (1G). A circulation material (3A) and a coating blade (3C) configured to apply the circulation material (not illustrated) are disposed between a cleaning device (17) and a charging device (12) relative to the moving direction of the photoconductor.

The image forming apparatus of the tandem system, as in the embodiment of FIG. 16, has photoconductors (11Y, 11M, 11C, and 11Bk) for all colors for use, and enables to subsequently transfer toner images of all the colors onto a print medium (18) held on the conveying transfer belt (1G). Therefore, the tandem system image forming apparatus enables significantly high speed output of full-color images compared with a full-color image forming apparatus including only a photoconductor. The developed toner image on the print medium (18) as a transfer material is transported from the counter position between the photoconductor (11Bk) and the transferring device (16Bk) to the fixing device (19), and then is fixed on the print medium (18) by the fixing device (19).

Note that, the present disclosure is not limited to the structure of the embodiment illustrated in FIG. 16. For example, the present disclosure may have a structure of the embodiment illustrated in FIG. 17.

Specifically, the present disclosure may have a structure where the intermediate transfer belt (1F) illustrated in FIG. 17 is used instead of a direct transfer system using the conveying transfer belt (1G) illustrated in FIG. 16.

In the example illustrated in FIG. 17, a photoconductor (11Y, 11M, 11C, or 11Bk) for each color is disposed, toner images of all the colors formed on the respective photoconductors are sequentially transferred and superimposed by a primary transferring unit (1D) onto an intermediate transfer belt (1F) driven by a roller (1C), to thereby form a full-color image. Subsequently, the intermediate transfer belt (1F) is further driven and the full-color image born on the intermediate transfer belt (1F) is transported to a counter position to the roller (1C) at which a secondary transferring unit (1E) and a secondary transferring unit (1E) are disposed to face each other. Then, the full-color image is secondary transferred to a transfer material (18) by the secondary transferring unit (1E), to thereby form a desired image on the transfer material.

Figure 18:
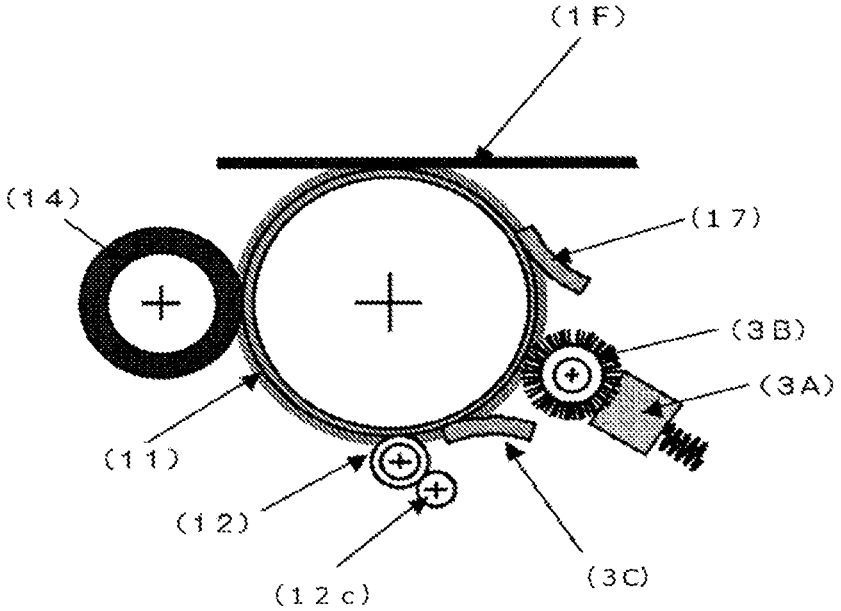
FIG. 18 is a schematic cross-sectional view of an image forming apparatus according to one embodiment of the present disclosure.

One example of the image forming apparatus using a circulation material will be described with reference to FIG. 18. In the apparatus of FIG. 18, a circulation material (3A) is supplied to a surface of a photoconductor by a coating brush (3B), followed by levelling the circulation material with a coating blade (3C). Then, the circulation material is removed by a blade shaped elastic body (17), and the circulation material is again returned to the coating brush (3B). Since a toner is supplied and removed from the surface of the photoconductor (11) as well as the circulation material (3A), the circulation material (3A) is present in a state that the circulation material is mixed with the toner.

Note that, a charging device cleaner (12*c*) configured to clean the charging device (12) is disposed in contact with the charging device (12).

Figure 19:
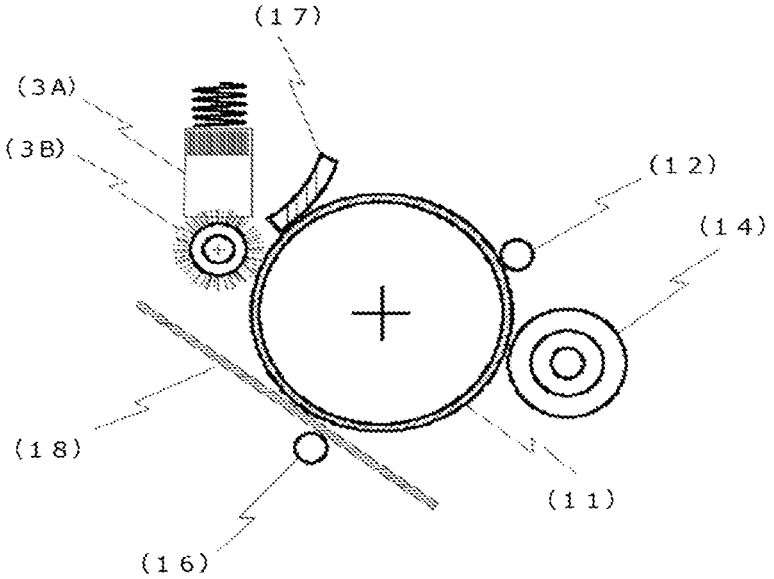
FIG. 19 is a schematic cross-sectional view of an image forming apparatus according to yet another embodiment of the present disclosure.

Moreover, the present disclosure may employ an image forming system where a toner image is transferred directly from a surface of the photoconductor (11) to a transfer material (18) by a transferring device (16) without using an intermediate transfer member as illustrated in FIG. 19.

Since circulation efficiency of the circulation material is high in the present disclosure, moreover, to enhance properties, which are deposition when the circulation material is input on the surface of the photoconductor, levelling when the circulation material is spread, and removability when the circulation material is discharged from the photoconductor to the outside of the system on a timely basis, is expected. For levelling of the circulation material, a coating blade configured to spread the circulation material is often used.

When the resin having a crosslinked structure having excellent abrasion resistance is used as a material of the underlying surface layer, an underlying surface layer having excellent abrasion resistance is obtained. As a result, sustainability of the surface profile can be obtained. The reason thereof is probably because, even when part of chemical bonds constituting the resin film is cut due to deterioration in durability, abrasion is prevented as long as other sites of the chemical bonds are remained.

Among resins having crosslinked structure, an acrylic resin has an advantage that the acrylic resin has large dielectric constant compared with a solid solution between polycarbonate and a charge-transporting material, and therefore an influence of a projection and recess shape on the electrostatic properties is small.

It is advantageous to dispose a mechanism for scraping the circulation material and inputting the scraped circulation material to the surface of the photoconductor in an image forming apparatus where the circulation material is applied to a surface of the photoconductor, because the consumption amount of the circulation material can be easily controlled and the circulation material can be supplied to the entire photoconductor. Moreover, the amount of the circulation material supplied to the surface of the photoconductor can be controlled, or levelling can be accelerated by disposing, in addition to a blade-shaped elastic body, a coating blade that rubs against the photoconductor at the position that is downstream from the above-mentioned brush but upstream from the blade-shaped elastic body. The brush and coating blade are effective for adjusting circulation of the circulation material.

(Coating Unit of Circulation Material)

Figure 20:
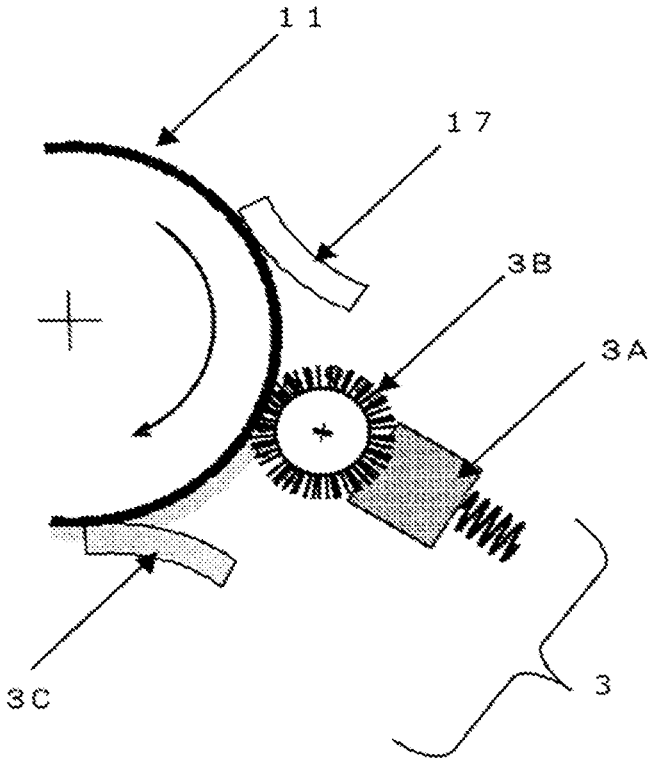
FIG. 20 is a schematic cross-sectional view illustrating a coating unit of a circulation material according to one embodiment of the present disclosure.

In the present disclosure, as a circulation material coating unit configured to supply a circulation material (3A) to a surface of a photoconductor, a circulation material coating device (3) as illustrated in FIG. 20 is disposed in all of the above-mentioned image forming apparatuses. The circulation material coating device (3) includes a fur brush (3B) serving as a coating member, a circulation material (3A), a press spring (not illustrated) configured to press the circulation material in the direction of the fur brush, and a coating blade (3C) configured to regulate or level the circulation material (3A). The circulation material (3A) is a circulation material shaped into a bar. An edge of the fur brush (3B) is brought into contact with the surface of the photoconductor (11). As the fur brush is rotated with a center thereof as an axis, the circulation material (3A) is taken by the brush once and is born thereon to transport the circulation material to the contact position with the surface photoconductor, and then the circulation material is applied onto the surface of the photoconductor. Note that, the numeral sign 17 represents a blade-shaped elastic body serving as the cleaning blade.

Moreover, the circulation material (3A) is pressed to the side of the fur brush (3B) at the predetermined pressure by a press spring (not illustrate) in order to prevent the fur brush (3B) from being detached from the circulation material when the circulation material (3A) is scraped and reduced over time by the fur brush (3B). Therefore, the circulation material (3A) is always uniformly taken by the fur brush (3B) even when an amount of the circulation material (3A) remained is small.

Moreover, a coating material coating unit configured to coat a surface of the photoconductor (11) with a circulation material may be disposed. The coating material coating unit may be a unit configured to press a plate, such as a blade-shaped elastic body, against a photoconductor by a trailing system or counter system.

Examples of the circulation material (3A) include: fatty acid metal salts, such as lead oleate, zinc oleate, copper oleate, zinc stearate, cobalt stearate, iron stearate, copper stearate, zinc palmitate, copper palmitate, and zinc linoleate; and fluororesins, such as polytetrafluoroethylene, polychlorotrifluoroethylene, polyvinylidene fluoride, polytrifluorochloroethylene, dichlorodifluoroethylene, a tetrafluoroethylene-ethylene copolymer, and a tetrafluoroethylene-oxafluoropropylene copolymer. Particularly, a material having a lamellar structure has a high circulation efficiency and moreover, zinc stearate is advantageous in view of a cost.

EXAMPLES

Examples of the present disclosure will be described below. However, it is construed that the present disclosure should not be limited to these Examples. Note that, "part(s)" in the descriptions below means "part(s) by mass."

<Production of Image Forming Apparatus>

Example 1

—Production of Photoconductor—

An undercoat layer coating material having the following composition, a charge-generating layer having the following composition, and a charge-transporting layer having the following composition were sequentially applied onto an aluminium drum having an outer diameter of 100 mm and dried to thereby form an undercoat layer having a thickness of 3.5 μm, a charge-generating layer having a thickness of 0.2 μm, a charge-transporting layer having a thickness of 22 μm. A photoconductor, in which an underlying surface layer having a film thickness of from 2 μm through 3 μm was formed, was obtained.

Note that, preparation of the underlying surface layer coating material was performed in the following manner. An empty mayonnaise bottle (UM sample bottle) for 50 mL was charged with 60 g of alumina balls having a diameter of 5 mm in advance. To the bottle, 9 g of α-alumina having an average primary particle diameter of 0.3 μm, 0.18 g of a dispersant (BYK-P105, available from BYK) and 10 g of a solvent (cyclopentanone) were added. The resultant mixture was dispersed by means of a ball mill for 24 hours at the rotational intensity of 150 rpm, to thereby obtain a mill base. To the obtained mill base, a vehicle (a liquid component that was an underlying surface layer coating material from which the mill base component was taken away) was added to thereby obtain a coating material.

The following materials were mixed and the resultant mixture was stirred for 24 hours at 1,500 rpm by means of a vibration mill with zirconia beads having a diameter of 0.5 mm, to thereby prepare an undercoat layer coating material.

[Undercoat Layer Coating Material]

Zinc oxide particles (MZ-300, available from TAYCA CORPORATION, average particle diameter: 35 μm): 350 parts Salicylic acid derivative [3,5-di-t-butylsalicylic acid (available from Tokyo Chemical Industry Co., Ltd.)]: 1.5 parts Binder resin [blocked isocyanate (solid content: 75% by mass, SUMIDUR BL3175, available from Sumitomo Bayer Urethane Co., Ltd.)]: 60 parts Binder resin [20% by mass diluted solution obtained by diluting (BM-S, available from SEKISUI CHEMICAL CO., LTD.) in 2-butanone]: 225 parts Solvent (2-Butanone): 105 Parts Onto the undercoat layer, the following charge-generating layer coating material was applied through dip coating. The applied charge-generating layer coating material was heated and dried for 20 minutes at 95° C., to thereby form a charge-generating layer having a film thickness of 0.2 μm.

The following materials were mixed. The resultant mixture was stirred by means of a bead mill with glass beads having a diameter of 1 mm for 8 hours, to thereby prepare a charge-generating layer coating material.

[Charge-Generating Layer Coating Material]

Charge-generating material [Y-type titanyl phthalocyanine (available from Ricoh Company Limited)]: 8 parts Binder resin [polyvinyl butyral (BX-1, available from SEKISUI CHEMICAL CO., LTD.)]: 5 parts Solvent (2-butanone): 400 parts Onto the charge-generating layer, the following charge-transporting layer coating material was applied through dip coating. The applied charge-transporting layer coating material was heated and dried for 20 minutes at 120° C., to thereby form a charge-transporting layer having a film thickness of 22 μm.

(Charge-Transporting Layer Coating Liquid)

Charge-transporting material [compound having the following structure (available from Ricoh Company Limited)]: 10 parts

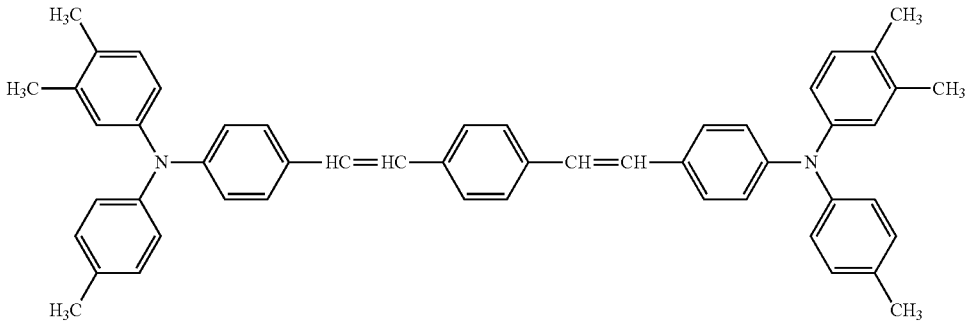

Binder resin [Z-type polycarbonate (PANLITE TS-5050, available from Teijin Chemicals Ltd.): 10 parts
Solvent (tetrahydrofuran): 80 parts
Leveling agent [1% tetrahydrofuran solution of silicone oil (KF50-100CS, Shin-Etsu Chemical Co., Ltd.): 1 part An underlying surface layer coating material having the following composition was applied by spray coating. The spray coating was performed by means of PC-WIDE308 (available from Olympus) and at a position at which a distance between an edge of a nozzle of the spray gun and a photoconductor was 50 mm at atomizing pressure of 2.5 kgf/cm$^2$. The ejected amount was about 25 mL.

After the spray coating, light irradiation was performed in a UV irradiation booth purged with nitrogen gas to adjust an oxygen concentration thereof to be 2% or less. Thereafter, the coating layer was heated and dried for 20 minutes at 135° C.

(Light Irradiation Conditions)
Metal halide lamp: 160 W/cm
Irradiation distance: 120 mm
Irradiation intensity: 700 mW/cm$^2$
Irradiation duration: 60 seconds
[Underlying Surface Layer Coating Material]
Crosslinkable charge-transporting material [compound having the following structure (Ricoh Company Limited)]: 43 parts

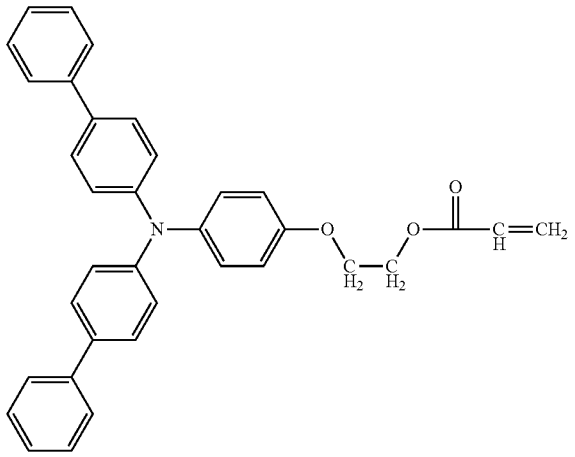

Cross-linkable resin monomer [trimethylolprop ane triacrylate (KAYARADTMPTA, available from Nippon Kayaku Co., Ltd.): 43 parts Leveling agent [1% tetrahydrofuran solution of silicone oil (KF50-100CS, available from Shin-Etsu Chemical Co., Ltd.)]: 1 part
Polymerization initiator [1-hydroxycyclohexylphenylketone (IRGACURE 184, available from Chiba Specialty Chemicals)]: 4 parts
Metal oxide filler [α-alumina (SUMICORUNDUM AA-03, available from Sumitomo Chemical Co., Ltd.)]: 10 parts
Dispersing agent (BYK-P105, available from BYK): 0.35 parts
Solvent (tetrahydrofuran): 566 parts —Circulation Material Coating Device—

A unit configured to supply a circulation material to a photoconductor and a unit configured to coat the photoconductor with the supplied circulation material were mounted as a circulation material coating device in an image forming apparatus.

As the unit for supplying the circulation material, mounted was a device configured to press a solid circulation material formed into a prism shape to be held with a support against a coating brush with a press spring of the spring constant at which the predetermined consumption was obtained and configured to rotate the coating brush to scrape the circulation material and to deposit the scraped powder on the photoconductor. As the press spring, an appropriate spring was selected in view of a relationship between the spring constant and the consumption. A tension spring having a spring constant of 10 N was used as the conditions with which a consumption amount of the circulation material (i.e., an amount of the circulation material reduced including loss thereof due to scattering or falling off from the coating brush in addition to the coating amount onto the photoconductor) was to be 200 mg/km. Movable fins each supported by one point were respectively disposed at the both sides of the support, and the tension spring was rotated to adjust the contact pressure between the coating brush and the circulation material with the tensile stress of the spring. As the circulation material, a mixture of zinc stearate and zinc palmitate was used.

As the coating brush, a genuine produce where a fur brush was bonded to a metal shaft was used as it was. The coating brush was set to rotate in a counter direction relative to the traveling direction of the surface of the photoconductor.

As the coating blade, polyurethane rubber (Shore A hardness: 84, impact resilience: 52%, thickness: 1.3 mm) supported by a blade holder that was a steel plate in the manner that the urethane rubber was to be in contact with the photoconductor at 190 was used.

As the blade-shaped elastic body, polyurethane rubber (Shore A hardness: 72, impact resilience: 17%, thickness: 1.8 mm) supported by a blade holder that was a steel plate in the manner that the urethane rubber was to be in contact with the photoconductor at 23° was used.

The friction coefficient (Ft/Fn) between the photoconductor and the blade-shaped elastic body, which was measured by the later-described measuring method, was 0.90.

After preparing the above-produced photoconductor of Example 1 for mounting, the photoconductor was mounted in a black developing station of an image forming apparatus (Ricoh Pro C901, available from Ricoh Company Limited), and a continuous print test of 100,000 sheets was performed in the environment of 30° C. and relative humidity of 90%. The consumption amount of the circulation material relative to the running distance of the photoconductor during the test was 200 mg/km. After completing the test, the switch of the power source was turned off and the image forming apparatus was left to stand for 16 hours. Thereafter, an intermediate tone image pattern where a white dot and a black dot were written per dot as an evaluation image and a pattern of solid white (no jet of black) were printed. As the image evaluation, the image blur of the evaluation image was evaluated by classifying into 5 step ranks.

Comparative Example 1

A test was performed in the same manner as in Example 1, except that the spring constant of the spring configured to press the stick-shaped circulation material against the coating brush was changed from 10 N to 11 N to adjust the consumption of the circulation material to 220 mg/km.

Comparative Example 2

A test was performed in the same manner as in Example 1, except that the friction coefficient (Ft/Fn) between the photoconductor and the blade-shaped elastic body was changed from 0.90 to 0.80.

Note that, the change of the friction coefficient was performed by replacing the nickel sheet nipped with the mounting part of the cleaning blade mounted in the image forming apparatus with a nickel sheet having a different thickness to change the contact angle of the cleaning blade.

Example 2

A test was performed in the same manner as in Example 1, except that the friction coefficient (Ft/Fn) between the photoconductor and the blade-shaped elastic body was changed from 0.90 to 0.85.

Example 3

A test was performed in the same manner as in Example 1, except that the friction coefficient (Ft/Fn) between the photoconductor and the blade-shaped elastic body was changed from 0.90 to 1.10.

Comparative Example 3

A test was performed in the same manner as in Example 1, except that the friction coefficient (Ft/Fn) between the photoconductor and the blade-shaped elastic body was changed from 0.90 to 1.20.

Example 4

A test was performed in the same manner as in Example 1, except that a blade-shaped elastic body having a mirror surface that was coated with diamond-like carbon (DLC) in an average thickness of 0.3 μm was used in the image forming apparatus.

<Formation of Diamond-Like Carbon Layer>

Figure 21:
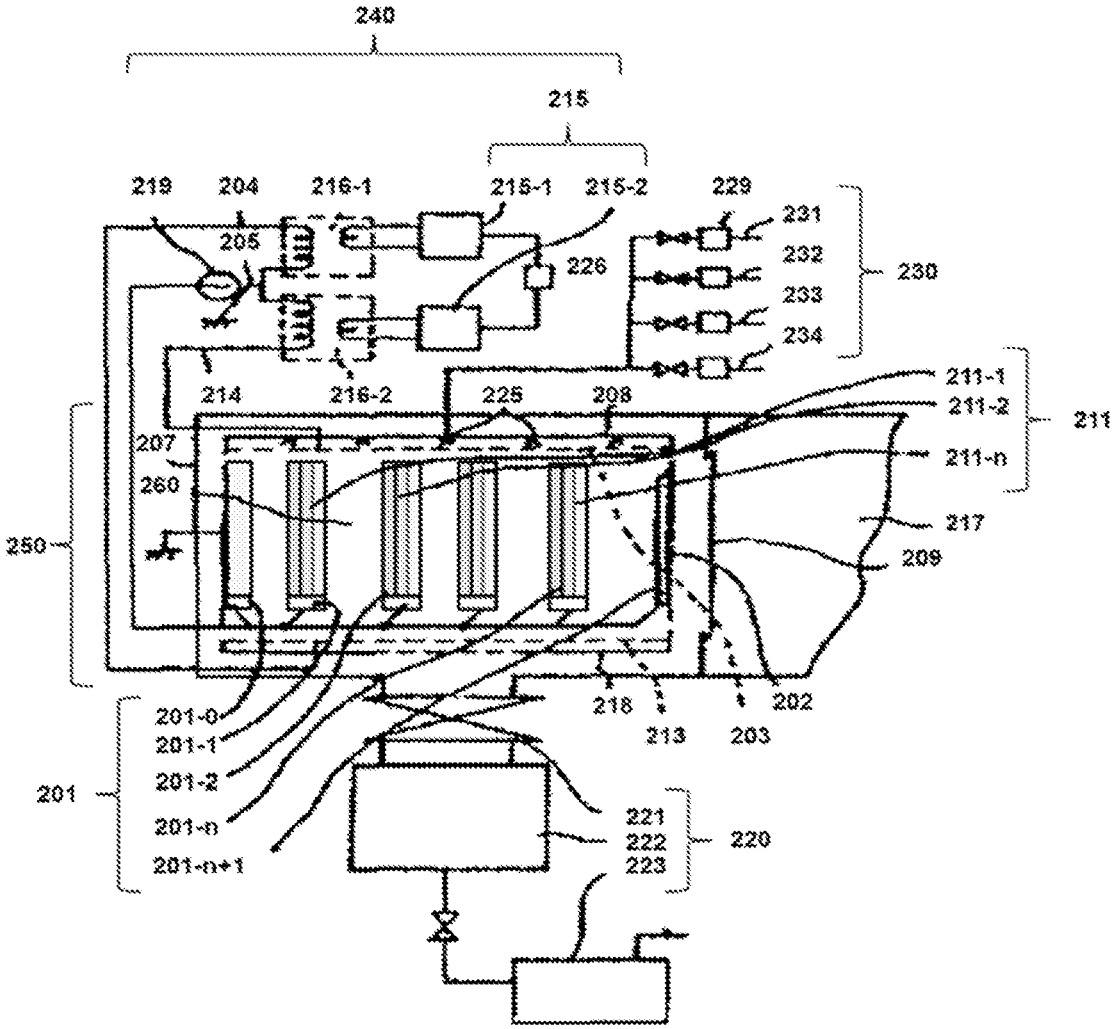
FIG. 21 is an explanatory view illustrating a specific example of a plasma CVD device for use in formation of a diamond-like carbon layer.

The blade-shaped elastic body illustrated in FIG. 21 was set in a plasma CVD device and a diamond-like carbon layer was formed under the following conditions.

<<Conditions>>

$C_2H_4$ flow rate: 200 mL/min

Air flow rate: 50 mL/min

Reaction pressure: 0.2 Pa

First alternating voltage output: 200 W (10 MHz)

Bias voltage (DC component): 0 V

Average thickness of diamond-like carbon: 0.3 μm

In FIG. 21, 207 is a vacuum chamber of a plasma CVD device, and the vacuum chamber was divided from a spare chamber for loading/unloading 217 by a gate valve 209. The vacuum chamber 207 was evacuated by a pumping system 220 (including a pressure adjustment valve 221, a turbo molecular pump 222, and a rotary pump 223) to maintain the interior atmosphere to constant pressure. A reaction chamber is disposed in the vacuum chamber 207. 230 represents a gas line configured to introduce gas into the reaction chamber 250, and various material gas containers are connected to the gas line. Each material gas is introduced into the reaction vessel 250 from a gas inlet nozzle 225 via a flowmeter 229. Inside a frame structure 202, blade-shaped elastic bodies 211 (211-1, 211-2, . . . **211-*n***, . . . ) to each of which the photoconductive layer had been formed were disposed.

Note that, supports 201 (201-1, 201-2, . . . **201-*n*, . . . ) respectively attached to the blade-shaped elastic bodies were each disposed as a third electrode as described later. To each of electrodes 203 and 213, a pair of power sources 215 (215-1 and 215-2) configured to apply first alternating voltage were provided. The frequency of the first alternating voltage was 10 MHz. The power sources were respectively connected to matching transformers 216-1 and 216-2. Phases of the matching transformers were adjusted by a phase adjuster 226 and were supplied with a difference of 180° or 0° from each other. One end 204 and the other end 214 of the matching transformer were respectively linked to the first and second electrodes 203 and 213. Moreover, a center point 205** at the side of the output of the transformer was maintained at an earth level.

Note that, in FIG. 21, the numeral signs 208 and 218 each represent a hood, the numeral sign 219 represents a power source, and the numeral sign 240 represents an alternating power source system.

Comparative Example 4

A test was performed in the same manner as in Example 4, except that the average thickness of DLC was changed to 0.6 μm.

Example 5

A test was performed in the same manner as in Example 1, except that the spring constant of the spring configured to press the stick-shaped circulation material against the coating brush was changed from 10 N to 13 N to adjust the consumption of the circulation material to 250 mg/km.

Example 6

A test was performed in the same manner as in Example 1, except that the spring constant of the spring configured to press the stick-shaped circulation material against the coating brush was changed from 10 N to 8 N to adjust the consumption of the circulation material to 150 mg/km.

Comparative Example 5

A test was performed in the same manner as in Example 1, except that the spring constant of the spring configured to press the stick-shaped circulation material against the coating brush was changed from 10 N to 5 N to adjust the consumption of the circulation material to 100 mg/km.

Example 7

A test was performed in the same manner as in Example 1, except that the underlying surface layer of the photoconductor was changed to the following underlying surface layer coating material.

[Underlying Surface Layer Coating Material]

Crosslinkable charge-transporting material [compound having the following structure (available from Ricoh Company Limited)]: 43 parts

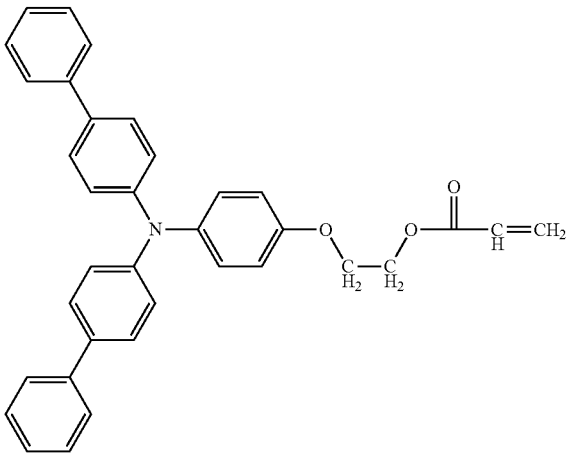

Crosslinkable resin monomer [trimethylolpropane triacrylate (KAYARADTMPTA, available from Nippon Kayaku Co., Ltd.)]: 42 parts Leveling agent [1% tetrahydrofuran solution of silicone oil (KF50-100CS, available from Shin-Etsu Chemical Co., Ltd.)]: 1 part
Polymerization initiator [1-hydroxycyclohexylphenylketone (IRGACURE 184, available from Chiba Specialty Chemicals)]: 4 parts Metal oxide filler [α-alumina (SUMICORUNDUM AA-03, available from Sumitomo Chemical Co., Ltd.)]: 10 parts
Dispersant (BYK-P105, available from BYK): 0.35 parts
Fluororesin particles [PTFE (LUBRON L-2, available from DAIKIN INDUSTRIES, LTD.)]: 1 part
Fluorine-based surfactant (MODIPER F210, available from NOF CORPORATION): 0.5 parts
Solvent (tetrahydrofuran): 560 parts
Solvent [fluorine-based solvent (ZEORORA H, available from Zeon Corporation)]: 6 parts Example 8

A test was performed in the same manner as in Example 1, except that the underlying surface layer of the photoconductor was changed to the following underlying surface layer coating material.
[Underlying Surface Layer Coating Material]
Crosslinkable charge-transporting material [compound having the following structure (available from Ricoh Company Limited)]: 38 parts

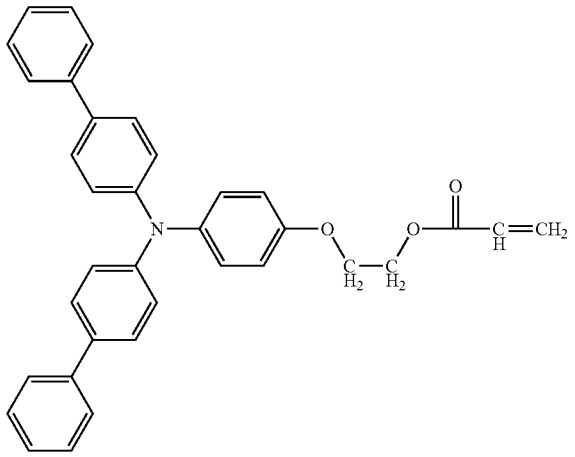

Crosslinkable resin monomer [trimethylolpropane triacrylate (KAYARADTMPTA, available from Nippon Kayaku Co., Ltd.)] 38 parts
Leveling agent [1% tetrahydrofuran solution of silicone oil (KF50-100CS, available from Shin-Etsu Chemical Co., Ltd.)]: 1 part
Polymerization initiator [1-hydroxycyclohexylphenylketone (IRGACURE 184, available from Chiba Specialty Chemicals)]: 4 parts
Metal oxide filler [α-alumina (SUMICORUNDUM AA-03, available from Sumitomo Chemical Co., Ltd.)]: 10 parts
Dispersing agent (BYK-P105, available from BYK): 0.35 parts Fluororesin particles [PTFE (LUBRON L-2, available from DAIKIN INDUSTRIES, LTD.)]: 10 parts
Fluorine-based surfactant (MODIPER F210, available from NOF CORPORATION): 10 parts
Solvent (tetrahydrofuran): 509 parts
Solvent [fluorosolvent (ZEORORA H, available from Zeon Corporation)]: 57 parts Example 9

A test was performed in the same manner as in Example 1, except that the a filler liquid having the following composition was sprayed on the photoconductor on which the underlying surface layer material had been applied in a manner that an increased amount of the film thickness was to be 0.4 μm, and then light irradiation was performed in a UV irradiation booth purged with nitrogen gas to adjust an oxygen concentration to 2% or less, followed by heating and drying for 20 minutes at 135° C.

(Light Irradiation Conditions)

Metal halide lamp: 160 W/cm

Irradiation distance: 120 mm

Irradiation intensity: 700 mW/cm$^2$

Irradiation duration: 60 seconds (Filler liquid)

Crosslinkable charge-transporting material [compound having the following structure (available from Ricoh Company Limited)]: 4.3 parts

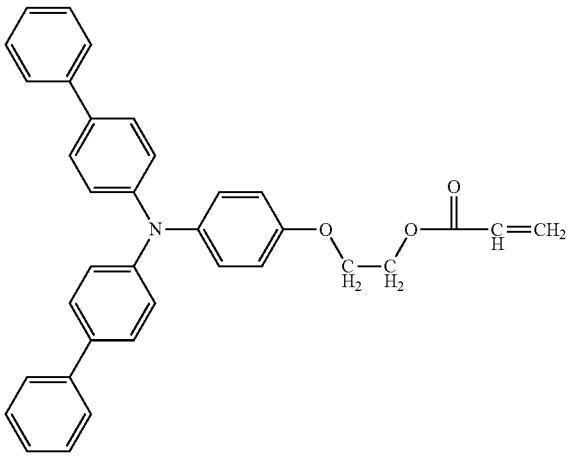

Crosslinkable resin monomer [trimethylolprop ane triacrylate (KAYARADTMPTA, available from Nippon Kayaku Co., Ltd.)]: 4.3 parts Leveling agent [1% tetrahydrofuran solution of silicone oil (KF50-100CS, available from Shin-Etsu Chemical Co., Ltd.)]: 0.1 parts Polymerization initiator [1-hydroxycyclohexylphenylketone (IRGACURE 184, available from Chiba Specialty Chemicals)]: 0.4 parts Metal oxide filler [α-alumina (SUMICORUNDUM AA-03, available from Sumitomo Chemical Co., Ltd.): 150 parts Dispersing agent (BYK-P105, available from BYK): 5.25 parts Solvent (tetrahydrofuran): 500,433 parts Example 10

A test was performed in the same manner as in Example 9, except that the composition of the filler liquid was changed to a filler liquid having the following composition.

(Filler Liquid)

Crosslinkable charge-transporting material [compound having the following structure (Ricoh Company Limited)]: 1 part

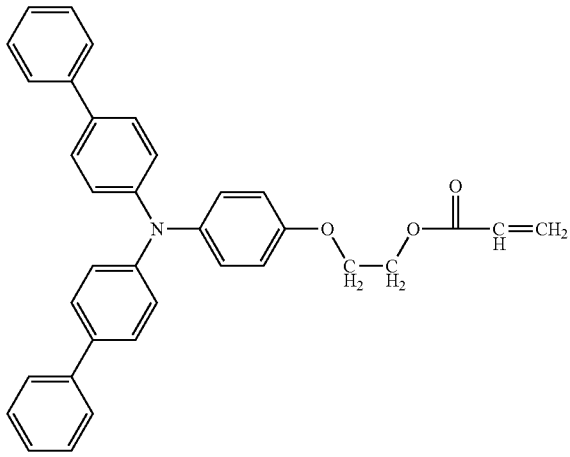

Crosslinkable resin monomer [trimethylolprop ane triacrylate (KAYARADTMPTA, available from Nippon Kayaku Co., Ltd.)]: 1 part Leveling agent [1% tetrahydrofuran solution of silicone oil (KF50-100CS, available from Shin-Etsu Chemical Co., Ltd.)]: 0.025 parts Polymerization initiator [1-hydroxycyclohexylphenylketone (IRGACURE 184, available from Chiba Specialty Chemicals)]: 0.01 parts Metal oxide filler [α-alumina (SUMICORUNDUM AA-03, available from Sumitomo Chemical Co., Ltd.)]: 30 parts Dispersing agent (BYK-P105, available from BYK): 3 parts Solvent (tetrahydrofuran): 450,233 parts Example 11

A test was performed in the same manner as in Example 1, except that α-alumina particles having a hexagonal close-packed structure (SUMICORUNDUM AA-03, available from Sumitomo Chemical Co., Ltd.) were mixed with the genuine developer used in the image forming apparatus in an amount of 0.1% by mass relative to a total mass of the developer.

Example 12

A test was performed in the same manner as in Example 11, except that the amount of the α-alumina particles relative to the developer was changed to 0.2% by mass.

Example 13

A test was performed in the same manner as in Example 11, except that the amount of the α-alumina particles relative to the developer was changed to 0.3% by mass.

Comparative Example 6

A test was performed in the same manner as in Example 11, except that the amount of the α-alumina particles relative to the developer was changed to 0.4% by mass.

<Measurements>

The following measurements (1) to (3) were performed on the photoconductors and image forming apparatuses of Examples 1 to 13 and Comparative Examples 1 to 6. The results are presented in Table 6.

(1) Measurement of Blade Acting Force

Shear force Ft and compressive stress Fn generated by the contact mainly between the blade-shaped elastic body called a cleaning blade and the photoconductor, a friction coefficient Ft/Fn, and a size of self-excited vibration WRFt(LMH) in the LMH band of the elastic body were measured by the device illustrated in FIG. 1.

In the device illustrated in FIG. 1, specifically, a plate to which the blade-shaped elastic body had been fixed was hanged from a couple of three-component strain gauges (dynamic strain measuring instrument, device name: TYPE LSM-B-50NSA1-P, available from Kyowa Electronic Instruments Co., Ltd.) (51) and the blade-shaped elastic body was brought into contact with the photoconductor (11). At the time of the contact, a contact angle and penetration amount of the blade-shaped elastic body against the photoconductor and the linear speed of the surface of the photoconductor were adjusted to the same conditions as in each Example and image forming apparatus and then the measurement was performed. The photoconductor was connected to a motor (not illustrated) and the motor was driven to rotate at the speed of (122 rpm).

Measured values of loads obtained by the three-component strain gauges were collected by a data logger (device name: NR-ST04, available from KEYENCE CORPORATION), and a sum of the loads obtained from the left and right three-component strain gauges was calculated as acting force.

The shear force Ft and compressive stress Fn were measured by the method illustrated in FIG. 2 and described below.

As a positional relationship of the rubber plate of the blade-shaped elastic body, a load of the width direction (air surface) fx and a load of the thickness direction (cut surface) fy were obtained by the three-component strain gauge. The contact angle between the blade-shaped elastic body and the photoconductor was determined as θ, acting force (shear force Ft) of the blade-shaped elastic body in tangential direction and force (compressive stress Fn) of the vertical direction relative to the rotational driving direction of the photoconductor were calculated from the following formulae (2) and (3).

$$Ft = fx \cdot \cos\theta - fy \cdot \sin\theta \qquad \text{Formula (2)}$$

$$Fn = fx \cdot \sin\theta + fy \cos\theta \qquad \text{Formula (3)}$$

Moreover, the friction coefficient Ft/Fn between the photoconductor and the blade-shaped elastic body was determined according to the following formula (5).

$$\text{Friction coefficient between photoconductor and blade-shaped elastic body} = Ft/Fn \qquad \text{Formula (5)}$$

The self-excited vibration WRFt(LMH) of the shear force of the elastic body in the LMH band was determined by the method described in (i) to (v) below:

(i) Wave data WFt of a time change of shear force generated in the elastic body due to frictions with the image bearer was measured by means of a couple of three-component strain gauges (dynamic strain measuring instrument, device name: TYPE LSM-B-50NSA1-P, available from Kyowa Electronic Instruments Co., Ltd.), and a data logger (device name:

NR-ST04, available from KEYENCE CORPORATION) at a sampling rate of 2,000 S/sec.

(ii) The wavelet transformation of the waveform data WFt was performed by a multiresolution analysis to separate the waveform data WFt into 6 frequency components (HHH, HHL, HMH, HML, HLH, and HLL) of the waveform data of the shear force ranging from a high frequency component to a low frequency component.

(iii) Subsequently, decimation of the lowest frequency component of the waveform data WFt(HLL) of the shear force among the obtained 6 frequency component was performed in a manner that the sampling number was reduced to 1/40, to thereby generate waveform data (A) of the shear force.

(iv) The wavelet transformation of the waveform data (A) was further performed by a multiresolution analysis to separate the waveform data (A) into additional 6 frequency components (LHH, LHL, LMH, LML, LLH, and LLL) of waveform data of the shear force ranging from a high frequency component to a low frequency component.

(v) Self-excited vibration WRFt(LMH) of shear force of the elastic body in the LMH band was determined from the above-obtained waveform data WFt(LMH) of the shear force in the LMH band according to Formula (1) below.

$$WRFt(LMH) = \frac{1}{L}\int_0^L |WFt[LHM](x)|dx \quad \text{Formula (1)}$$

(L: a duration of the entire measurement, x: time, WFt [LMH](x): waveform data of a time change of shear force in the LMH band)

Note that, WaveletToolbox of MATLAB (available from TheMathWorks) was used as it was for the wavelet transformation. In this example, wavelet transformation was performed twice as described above.

(2) Circulatory Evaluation Test of Coating Film of Wax or Fatty Acid Metal Salt on Surface of Photoconductor A print test was performed with a solid white (no jet of black) pattern was performed by means of the photoconductor and image forming apparatus above with 2,500 rotations and 25,000 rotation of the photoconductor drum. Thereafter, the photoconductor was taken out from the image forming apparatus.

In order to determine the deposition amount of the circulation material, the surface of the photoconductor was blown with compressed air of 4 MPa when the test was suspended, and then part of the photoconductive layer ranging from the charge-transporting layer to the outermost surface layer was peeled in the size of 34 mm×34 mm from 3 regions with identical gaps between the adjacent regions within the downstream area that was slightly away from the circulation material coated area relative to the circumferential direction of the photoconductor drum during the suspension of the test.

A mass film thickness of the peeled film was calculated from a peak area of IR spectroscopy according to the ATR method performed by the method described below.

A difference in the deposition amount between when the number of rotations of the photoconductor drum was 2,500 and when the number of rotations of the photoconductor drum was 25,000 was calculated from the following formula, and a variation of the deposition amount of the circulation material on the surface of the photoconductor (coating film circulatory) was evaluated. It was judged that there was a problem in removal of the circulation material when a change of the variation of the deposition amount of the circulation material relative to the number of rotations was plus. It was judged that a case where a change of the variation was minus but the variation was large (less than −0.10) was judged as a failure because surface stability of the photoconductor was impaired.

$$\tau = f\alpha + \beta \quad \text{Formula (7)}$$

τ: mass film thickness of circulation material (unit: nm)

α: the number of coating (unit: ×1,000 times)

β: arbitrary constant

The coefficients f and β were calculated in the following manner.

The number of rotations (unit: 1,000 rotations) was plotted on the horizontal axis, and as the deposition amount, the deposition amount at 2.5 (1,000 rotations) and the deposition amount at 25 (1,000 rotations) were plotted on the vertical axis. The inclination of a linear approximate straight line connecting two plot points was calculated as f and an intercept was calculated as β. The linear approximate straight line could be calculated using spreadsheet software, and a scatter diagram was drawn using Microsoft Excel, to determine f and β additional command of the approximate straight line.

The IR spectroscopy according to the ATR method was performed by preparing calibration curve data of a zinc analysis value obtained by ICP-AES and the IR analysis value according to the ATR method in advance, and comparing the intensity obtained by the IR spectroscopy according to the ATR method with the analysis value of the ICP-AES to determine a deposition amount. When a coating film has many defects, an apparent layer thickness becomes thin and a thickness of the coated film area cannot be estimated. Therefore, a value obtained by dividing the mass film thickness calculated by XRF with the covering ratio calculated by XPS was calculated as an average layer thickness (thickness of coating film area=mass film thickness/covering ratio). The thickness of the coating film area by the IR spectroscopy according to the ATR method was calculated in the same manner as in XRF.

ICP-AES was performed on the test solution decomposed by sulfuric acid and nitric acid by means of ICPS-7500 available from Shimadzu Corporation. In the IR spectroscopy according to the ATR method, a size of the peak area at 1,540 $cm^{-1}$ using Ge crystal by means of FT/IR-6100 available from JASCO Corporation.

(3) Elemental Analysis of Fluorine on Surface of Photoconductor

As a quantitative analysis of a fluorine element on the surface of the photoconductor, after completing the test, 10 sample pieces each in the size of 15 mm×15 mm were cut out at equal gaps along the longitudinal direction of the photoconductor, and an amount (atom %) of the fluorine element was measured at the arbitrary 10 areas each in the size of 10 mm×10 mm through XPS analysis by means of Quantera SXM (available from ULVAC-PHI, INCORPORATED). An average value of the obtained values of the amount of the fluorine atom (atom %) was calculated.

(4) Measurement of Surface Profile of Photoconductor

A measurement of the surface profile of the photoconductor was performed by means of a surface roughness-outline shape measuring device (Surfcom 1800G, available from TOKYO SEIMITSU CO., LTD.) with pickup (E-DT-S01A) under the conditions that the measurement length was 10 mm, the number of the sampling points was 30,720, and the measuring speed was 0.06 mm/s.

The one-dimensional data array of the surface profile of the photoconductor obtained by the measurement was subjected to the wavelet transformation to separate into 6 frequency components of HHH, HHL, HMH, HML, HLH, and HLL, to thereby perform a first multiresolution analysis (MRA). Moreover, decimation was performed on the obtained one-dimensional data array of HLL to reduce the number of the data arrays to 1/40 to thereby generate a one-dimensional data array (B). The decimated one-dimensional data array (B) was further subjected to the wavelet transformation to separate into 6 frequency components of LHH, LHL, LMH, LML, LLH, and LLL, to thereby perform a second multiresolution analysis. Then, an arithmetic means roughness (WRa) of each of the obtained 12 frequency components was calculated. The obtained frequency components are as follows.

WRa(HHH): Ra in the band where a length of a cycle of a projection and a recess was from 0.3 μm through 3 μm WRa(HHL): Ra in the band where a length of a cycle of a projection and a recess was from 1 μm through 6 μm WRa(HMH): Ra in the band where a length of a cycle of a projection and a recess was from 2 μm through 13 μm WRa(HML): Ra in the band where a length of a cycle of a projection and a recess was from 4 μm through 25 μm WRa(HLH): Ra in the band where a length of a cycle of a projection and a recess was from 10 μm through 50 μm WRa(HLL): Ra in the band where a length of a cycle of a projection and a recess was from 24 μm through 99 μm WRa(LHH): Ra in the band where a length of a cycle of a projection and a recess was from 26 μm through 106 μm WRa(LHL): Ra in the band where a length of a cycle of a projection and a recess was from 53 μm through 183 μm WRa(LMH): Ra in the band where a length of a cycle of a projection and a recess was from 106 μm through 318 μm WRa(LML): Ra in the band where a length of a cycle of a projection and a recess was from 214 μm through 551 μm WRa(LLH): Ra in the band where a length of a cycle of a projection and a recess was from 431 μm through 954 μm WRa(LLL): Ra in the band where a length of a cycle of a projection and a recess was from 867 μm through 1,654 μm The measurement of the surface profile was performed at 4 positions at an interval of 70 mm per photoconductor, and an arithmetic mean roughness of each frequency component on each position was calculated.

Note that, WaveletToolbox of MATLAB (available from TheMathWorks) was used as it was for the wavelet transformation. As described above, the wavelet transformation was performed twice in the present Example.

An average value of the arithmetic mean roughness of each frequency component from the 4 positions was determined as arithmetic mean roughness (WRa) of each frequency component of the measurement result to thereby determine arithmetic mean surface roughness WRa(LML) of the underlying surface layer in the LML band.

TABLE 6

| | Ft/Fn | WRFt (LMH) [gf] | Coating film circulatory | Fluorine element in surface of photoconductor [atom %] | WRa (LML) [μm] | Ratio of alumina in developer [mass %] | Image evaluation [rank] |
|---|---|---|---|---|---|---|---|
| Ex. 1 | 0.90 | 1.6 | 0 | 0 | 0.005 | 0 | 4 |
| Ex. 2 | 0.85 | 1.6 | 0 | 0 | 0.005 | 0 | 3.5 |
| Ex. 3 | 1.10 | 1.6 | 0 | 0 | 0.005 | 0 | 3.5 |
| Ex. 4 | 0.90 | 3.5 | 0 | 0 | 0.005 | 0 | 3.5 |
| Ex. 5 | 0.90 | 2.5 | 0.03 | 0 | 0.005 | 0 | 3.5 |
| Ex. 6 | 0.90 | 1.5 | −0.1 | 0 | 0.005 | 0 | 4 |
| Ex. 7 | 0.90 | 1.6 | 0 | 0.5 | 0.020 | 0 | 5 |
| Ex. 8 | 0.95 | 1.8 | −0.05 | 30 | 0.030 | 0 | 5 |
| Ex. 9 | 0.90 | 1.8 | 0 | 0 | 0.030 | 0 | 5 |
| Ex. 10 | 0.90 | 1.6 | 0 | 0 | 0.040 | 0 | 5 |
| Ex. 11 | 0.90 | 1.8 | 0 | 0 | 0.005 | 0.1 | 5 |
| Ex. 12 | 0.95 | 2.6 | 0 | 0 | 0.005 | 0.2 | 5 |
| Ex. 13 | 1.00 | 3.3 | 0 | 0 | 0.005 | 0.3 | 5 |
| Comp. Ex. 1 | 0.90 | 1.0 | 0.02 | 0 | 0.005 | 0 | 2 |
| Comp. Ex. 2 | 0.80 | 1.6 | 0 | 0 | 0.005 | 0 | 2 |
| Comp. Ex. 3 | 1.20 | 1.6 | 0 | 0 | 0.005 | 0 | 2 |
| Comp. Ex. 4 | 0.90 | 4.0 | 0.05 | 0 | 0.005 | 0 | 2 |
| Comp. Ex. 5 | 0.90 | 1.2 | −0.12 | 0 | 0.005 | 0 | 2 |
| Comp. Ex. 6 | 1.10 | 1.1 | 0.15 | 0 | 0.005 | 0.4 | 2 |

The supply amount of the circulation material is large in Comparative Example 1 compared with Example 1. It was assumed that the small self-excited vibration WRFt(LMH) of the elastic body in the LMH band prevented removal of the lubricant. In case of Comparative Example 1, the print image to which the acceleration evaluation test was performed had partial image density unevenness.

Comparing Comparative Example 2, Example 2, Example 3, and Comparative Example 3 with Example 1, the friction coefficient Ft/Fn between the elastic body and the photoconductor was different. In these Examples and Comparative Examples, there was a difference in the print image to which the acceleration evaluation test was performed, even though the conditions of the self-excited vibration WRFt(LMH) of the shear force of the elastic body in the LMH band were the same. Therefore, it was found that the friction coefficient in the range of Examples was important.

Compared with Example 1, Example 4 and Comparative Example 4 were the experiment results for understanding the influence of the self-excited vibration WRFt (LMH) of the shear force of the elastic body in the LMH band. It was found that the particular size of the self-excited vibration was important in order to secure quality of the print image.

Compared with Example 1, Example 5, Example 6, and Comparative Example 5 were the experiment results for understanding the influence of the circulatory of the coating film of the fatty acid metal salt. It was found that the quality of the print image was higher as the circulatory of the coating film of the fatty acid metal salt was more excellent.

Compared with Example 1, Example 7 and Example 8 were the experiment results for understanding the influence of the fluorine element on the surface of the photoconductor. It was found that the print image of high quality was obtained when the fluorine element was included in the surface of the photoconductor.

Compared with Example 1, Example 9 and Example 10 were the experiment results for understanding the influence of the surface profile of the photoconductor. It was found that the surface profile specified in the present disclosure had an effect of increasing quality of a print image.

Compared with Example 1, Examples 11 to 13 and Comparative Example 6 were the experiment results for understanding the influence of the certain α-alumina included in the developer. It was found that use of the certain α-alumina in the developer has an effect of changing the self-excited vibration WRFt(LMH) of the shear force of the elastic body in the LMH band and the friction coefficient between the elastic body and the photoconductor. It is preferable that an appropriate amount of the α-alumina be included in the developer.

For example, embodiments of the present disclosure are as follows.

<1> An image forming apparatus including:

an image bearer capable of bearing a toner image, where a latent image is formed on the image bearer;

a developing unit configured to develop the latent image formed on the image bearer with a toner; and a cleaning unit including a blade-shaped elastic body, where the elastic body is brought into contact with a surface of the image bearer, wherein a friction coefficient Ft/Fn between the image bearer and the elastic body is 0.85 or greater but 1.1 or less, and wherein a size WRFt(LMH) of self-excited vibration of shear force of the elastic body in a LMH band as determined by a method described in (i) to (v) below is 1.5 gf or greater but 3.5 gf or less:

(i) generating waveform data WFt of a time change of shear force generated in the elastic body due to frictions with the image bearer;

(ii) performing a multiresolution analysis to transform the waveform data WFt through wavelet transformation to separate the waveform data WFt into 6 frequency components (HHH, HHL, HMH, HML, HLH, and HLL) of the waveform data of shear force ranging from a high frequency component to a low frequency component;

(iii) generating waveform data of shear force through decimation performed on the lowest frequency component of the waveform data WFt(HLL) of shear force among the obtained 6 frequency components in a manner that a sampling number is reduced to 1/40;

(iv) further performing a multiresolution analysis to transform the generated waveform data through wavelet transformation to separate the waveform data into additional 6 frequency components (LHH, LHL, LMH, LML, LLH, and LLL) of the waveform data of shear force ranging from a high frequency component to a low frequency component; and (v) determining self-excited vibration WRFt(LMH) of shear force of the elastic body in the LMH band from the waveform data WFt(LMH) of shear force in the LMH band obtained in (iv) according to Formula (1), $$WRFt(LMH) = \frac{1}{L}\int_0^L |WFt[LHM](x)|dx \qquad \text{Formula (1)}$$

(L: a duration of the entire measurement, x: time, WFt [LMH](x): waveform data of a time change of shear force in the LMH band) where each frequency band satisfies a relationship below:

TABLE 7

| Abbreviations of frequency bands | Duration of 1 cycle [msec] | Frequency band [Hz] | Median of duration of 1 cycle [msec] | Median of frequency band [Hz] |
|---|---|---|---|---|
| HHH | 0.0 to 3.8 | 260.4 to ∞ | 1.9 | 520.8 |
| HHL | 1.3 to 7.7 | 130.2 to 781.3 | 4.5 | 223.2 |
| HMH | 2.6 to 16.6 | 60.1 to 390.6 | 9.6 | 104.2 |
| HML | 5.1 to 32 | 31.3 to 195.3 | 18.6 | 53.9 |
| HLH | 12.8 to 64 | 15.6 to 78.1 | 38.4 | 26 |
| HLL | 30.7 to 126.7 | 7.9 to 32.6 | 78.7 | 12.7 |
| LHH | 33.3 to 135.7 | 7.4 to 30 | 84.5 | 11.8 |
| LHL | 67.8 to 234.2 | 4.3 to 14.7 | 151 | 6.6 |
| LMH | 135.7 to 407 | 2.5 to 7.4 | 271.4 | 3.7 |
| LML | 273.9 to 705.3 | 1.4 to 3.7 | 489.6 | 2 |
| LLH | 551.7 to 1221.1 | 0.8 to 1.8 | 886.4 | 1.1 |
| LLL | 1109.8 to 2117.1 | 0.5 to 0.9 | 1613.4 | 0.6 |

<2> The image forming apparatus according to <1>, further including a coating unit configured to coat a surface of the image bearer to form a coating film of wax, or a fatty acid metal salt, or both the wax and the fatty acid metal salt on the surface of the image bearer.

<3> The image forming apparatus according to <1> or <2>, wherein the coating film formed on the surface of the image bearer is a circulation surface layer.

<4> The image forming apparatus according to any one of <1> to <3>, wherein an amount of a fluorine element on the surface of the image bearer as measured by XPS is 0.5 atom % or greater but 30 atom % or less.

<5> The image forming apparatus according to any one of <1> to <4>, wherein the image bearer includes a conductive support, and a photoconductive layer and an underlying surface layer disposed on the conductive support in this order, and wherein an arithmetic means surface roughness WRa(LML) of the underlying surface layer in the LML band as measured in a method described in (I) to (V) below is 0.02 μm or greater:

(I) measuring a surface profile of the underlying surface layer by means of a surface roughness-outline shape measuring device to generate one-dimensional data array;

(II) performing a multiresolution analysis to transform the one-dimensional data array through the wavelet transformation to separate the one-dimensional data array into 6 frequency components (HHH, HHL, HMH, HML, HLH, and HLL) ranging from a high frequency component to a low frequency component;

(III) generating a one-dimensional data array through decimation performed on the lowest frequency component of the one-dimensional data array among the obtained 6 frequency components in a manner that the number of data arrays is reduced to 1/40;

(IV) further performing a multiresolution analysis to transform the generated one-dimensional data array through wavelet transformation into additional 6 frequency components (LHH, LHL, LMH, LML, LLH, and LLL) ranging from a high frequency component to a low frequency component; and (V) determining an arithmetic mean roughness (WRa) of each of the 12 frequency components obtained, where the obtained frequency components are as described below, WRa(HHH): Ra in a band where a length of one cycle of a projection and a recess is from 0.3 μm through 3 μm WRa(HHL): Ra in a band where a length of one cycle of a projection and a recess is from 1 μm through 6 μm WRa(HMH): Ra in a band where a length of one cycle of a projection and a recess is from 2 μm through 13 μm WRa(HML): Ra in a band where a length of one cycle of a projection and a recess is from 4 μm through 25 μm WRa(HLH): Ra in a band where a length of one cycle of a projection and a recess is from 10 μm through 50 μm WRa(HLL): Ra in a band where a length of one cycle of a projection and a recess is from 24 μm through 99 μm WRa(LHH): Ra in a band where a length of one cycle of a projection and a recess is from 26 μm through 106 μm WRa(LHL): Ra in a band where a length of one cycle of a projection and a recess is from 53 μm through 183 μm WRa(LMH): Ra in a band where a length of one cycle of a projection and a recess is from 106 μm through 318 μm WRa(LML): Ra in a band where a length of one cycle of a projection and a recess is from 214 μm through 551 μm WRa(LLH): Ra in a band where a length of one cycle of a projection and a recess is from 431 μm through 954 μm WRa(LLL): Ra in a band where a length of one cycle of a projection and a recess is from 867 μm through 1,654 μm.

<6> The image forming apparatus according to any one of <1> to <5>, wherein the developing unit includes a developer where the developer includes α-alumina having a hexagonal close-packed structure in an amount of 0.1% by mass or greater but 0.3% by mass or less.

The image forming apparatus according to any one of <1> to <6> can solve the above-described various problems existing in the art and can achieve the object of the present disclosure.

What is claimed is:

1. An image forming apparatus comprising:

an image bearer capable of bearing a toner image, where a latent image is formed on the image bearer;

a developing unit configured to develop the latent image formed on the image bearer with a toner; and a cleaning unit including a blade-shaped elastic body, where the elastic body is brought into contact with a surface of the image bearer, wherein a friction coefficient Ft/Fn between the image bearer and the elastic body is 0.85 or greater but 1.1 or less, and wherein a size WRFt(LMH) of self-excited vibration of shear force of the elastic body in a LMH band as determined by a method described in (i) to (v) below is 1.5 gf or greater but 3.5 gf or less:

(i) generating waveform data WFt of a time change of shear force generated in the elastic body due to frictions with the image bearer;

(ii) performing a multiresolution analysis to transform the waveform data WFt through wavelet transformation to separate the waveform data WFt into 6 frequency components (HHH, HHL, HMH, HML, HLH, and HLL) of the waveform data of shear force ranging from a high frequency component to a low frequency component;

(iii) generating waveform data of shear force through decimation performed on a lowest frequency component of the waveform data WFt(HLL) of shear force among the obtained 6 frequency components in a manner that a sampling number is reduced to 1/40;

(iv) further performing a multiresolution analysis to transform the generated waveform data through wavelet transformation to separate the waveform data into additional 6 frequency components (LHH, LHL, LMH, LML, LLH, and LLL) of the waveform data of shear force ranging from a high frequency component to a low frequency component; and (v) determining self-excited vibration WRFt(LMH) of shear force of the elastic body in the LMH band from the waveform data WFt(LMH) of shear force in the LMH band obtained in (iv) according to Formula (1), $$WRFt(LMH) = \frac{1}{L}\int_0^L |WFt[LHM](x)|dx \qquad \text{Formula (1)}$$

(L: a duration of the entire measurement, x: time, WFt [LMH](x): waveform data of a time change of shear force in the LMH band) where each frequency band satisfies a relationship below:

TABLE 1

| Abbreviations of frequency bands | Duration of 1 cycle [msec] | Frequency band [Hz] | Median of duration of 1 cycle [msec] | Median of frequency band [Hz] |
|---|---|---|---|---|
| HHH | 0.0 to 3.8 | 260.4 to ∞ | 1.9 | 520.8 |
| HHL | 1.3 to 7.7 | 130.2 to 781.3 | 4.5 | 223.2 |
| HMH | 2.6 to 16.6 | 60.1 to 390.6 | 9.6 | 104.2 |
| HML | 5.1 to 32 | 31.3 to 195.3 | 18.6 | 53.9 |
| HLH | 12.8 to 64 | 15.6 to 78.1 | 38.4 | 26 |
| HLL | 30.7 to 126.7 | 7.9 to 32.6 | 78.7 | 12.7 |
| LHH | 33.3 to 135.7 | 7.4 to 30 | 84.5 | 11.8 |
| LHL | 67.8 to 234.2 | 4.3 to 14.7 | 151 | 6.6 |
| LMH | 135.7 to 407 | 2.5 to 7.4 | 271.4 | 3.7 |
| LML | 273.9 to 705.3 | 1.4 to 3.7 | 489.6 | 2 |
| LLH | 551.7 to 1221.1 | 0.8 to 1.8 | 886.4 | 1.1 |
| LLL | 1109.8 to 2117.1 | 0.5 to 0.9 | 1613.4 | 0.6. |

2. The image forming apparatus according to claim 1, further comprising a coating unit configured to coat the surface of the image bearer to form a coating film of wax, or a fatty acid metal salt, or both the wax and the fatty acid metal salt on the surface of the image bearer.

3. The image forming apparatus according to claim 2, wherein the coating film formed on the surface of the image bearer is a circulation surface layer.

4. The image forming apparatus according to claim 1, wherein an amount of a fluorine element on the surface of the image bearer as measured by XPS is 0.5 atom % or greater but 30 atom % or less.

5. The image forming apparatus according to claim 1, wherein the image bearer includes a conductive support, and a photoconductive layer and an underlying surface layer disposed on the conductive support in this order, and wherein an arithmetic means surface roughness WRa (LML) of the underlying surface layer in the LML band as measured in a method described in (I) to (V) below is 0.02 μm or greater:

(I) measuring a surface profile of the underlying surface layer by means of a surface roughness-outline shape measuring device to generate one-dimensional data array;

(II) performing a multiresolution analysis to transform the one-dimensional data array through the wavelet transformation to separate the one-dimensional data array into 6 frequency components (HHH, HHL, HMH, HML, HLH, and HLL) ranging from a high frequency component to a low frequency component;

(III) generating a one-dimensional data array through decimation performed on the lowest frequency component of the one-dimensional data array among the obtained 6 frequency components in a manner that the number of data arrays is reduced to 1/40;

(IV) further performing a multiresolution analysis to transform the generated one-dimensional data array through wavelet transformation into additional 6 frequency components (LHH, LHL, LMH, LML, LLH, and LLL) ranging from a high frequency component to a low frequency component; and (V) determining an arithmetic mean roughness (WRa) of each of the 12 frequency components obtained, where the obtained frequency components are as described below, WRa(HHH): Ra in a band where a length of one cycle of a projection and a recess is from 0.3 μm through 3 μm, WRa(HHL): Ra in a band where a length of one cycle of a projection and a recess is from 1 μm through 6 μm, WRa(HMH): Ra in a band where a length of one cycle of a projection and a recess is from 2 μm through 13 μm, WRa(HML): Ra in a band where a length of one cycle of a projection and a recess is from 4 μm through 25 μm, WRa(HLH): Ra in a band where a length of one cycle of a projection and a recess is from 10 μm through 50 μm, WRa(HLL): Ra in a band where a length of one cycle of a projection and a recess is from 24 μm through 99 μm, WRa(LHH): Ra in a band where a length of one cycle of a projection and a recess is from 26 μm through 106 μm, WRa(LHL): Ra in a band where a length of one cycle of a projection and a recess is from 53 μm through 183 μm, WRa(LMH): Ra in a band where a length of one cycle of a projection and a recess is from 106 μm through 318 μm, WRa(LML): Ra in a band where a length of one cycle of a projection and a recess is from 214 μm through 551 μm, WRa (LLH): Ra in a band where a length of one cycle of a projection and a recess is from 431 μm through 954 μm, and WRa(LLL): Ra in a band where a length of one cycle of a projection and a recess is from 867 μm through 1,654 μm.

6. The image forming apparatus according to claim 1, wherein the developing unit includes a developer where the developer includes α-alumina having a hexagonal close-packed structure in an amount of 0.1% by mass or greater but 0.3% by mass or less.

* * * * *